US007651287B2

(12) United States Patent
Numata et al.

(10) Patent No.: US 7,651,287 B2
(45) Date of Patent: Jan. 26, 2010

(54) PRINTER DEVICE HAVING INK RIBBON CARTRIDGE WITH PROTECTION PLATE FOR THERMAL HEAD

(75) Inventors: Koichi Numata, Tokyo (JP); Kazuyoshi Murata, Kanagawa (JP); Hiroshi Katsuno, Kanagawa (JP); Sunao Kushiro, Chiba (JP); Atsushi Yanbe, Kanagawa (JP); Shuichi Ota, Saitama (JP); Hideki Yoneoka, Kanagawa (JP)

(73) Assignee: Sony Corporation, Tokyo (JP)

( * ) Notice: Subject to any disclaimer, the term of this patent is extended or adjusted under 35 U.S.C. 154(b) by 322 days.

(21) Appl. No.: 11/712,975

(22) Filed: Mar. 2, 2007

(65) Prior Publication Data

US 2007/0212148 A1 Sep. 13, 2007

(30) Foreign Application Priority Data

Mar. 2, 2006 (JP) ..... 2006-057013

(51) Int. Cl.
*B41J 2/32* (2006.01)

(52) U.S. Cl. ..... 400/120.01; 400/194; 400/196; 400/207; 400/247; 400/693.1; 347/214; 347/217

(58) Field of Classification Search ..... 400/120.01, 400/247
See application file for complete search history.

(56) References Cited

U.S. PATENT DOCUMENTS 4,632,585 A * 12/1986 Oyamatsu et al. ..... 400/613
4,754,290 A * 6/1988 Kitayama et al. ..... 400/207
4,910,602 A * 3/1990 Sakuragi ..... 400/207
5,017,942 A * 5/1991 Asakura et al. ..... 400/208
5,450,102 A * 9/1995 Ishida et al. ..... 346/136
5,672,020 A * 9/1997 Leonard et al. ..... 400/692
5,741,080 A * 4/1998 Tomoda et al. ..... 400/208
5,921,687 A * 7/1999 Koike et al. ..... 400/120.01
6,247,784 B1 6/2001 Obana et al.
6,412,897 B1 7/2002 Konishi et al.
6,758,614 B2 * 7/2004 Yamada et al. ..... 400/58
6,997,628 B2 * 2/2006 Tu ..... 400/208

FOREIGN PATENT DOCUMENTS

JP 05-116410 5/1993
JP 06-340136 12/1994

OTHER PUBLICATIONS

Extended European Search Report dated Jul. 25, 2008 for corresponding European Application No. 07 10 3393.

* cited by examiner

*Primary Examiner*—Jill E Culler
(74) *Attorney, Agent, or Firm*—Rader, Fishman & Grauer PLLC

(57) ABSTRACT

A printer device is disclosed. The printer device includes: a base chassis that accepts therein and ejects therefrom the printing medium; a top chassis that is disposed to be able to freely open and close in a direction vertical to the basis chassis; an ink ribbon cartridge holder that is disposed between the top chassis and the base chassis, and is attached with an ink ribbon cartridge including therein the ink ribbon; and a thermal head that prints an image to the printing medium by heating the ink ribbon in the ink ribbon cartridge attached to the ink ribbon cartridge holder.

10 Claims, 41 Drawing Sheets

PRINTER DEVICE HAVING INK RIBBON CARTRIDGE WITH PROTECTION PLATE FOR THERMAL HEAD

CROSS REFERENCES TO RELATED APPLICATIONS

The present invention contains subject matter related to Japanese Patent Application JP 2006-057013 filed in the Japanese Patent Office on Mar. 2, 2006, the entire contents of which being incorporated herein by reference.

BACKGROUND OF THE INVENTION

1. Field of the Invention

The present invention relates to a printer device that includes therein an ink-ribbon-housing ink ribbon cartridge, and using a thermal head, thermally transfers the color material of the ink ribbon to a printing medium.

2. Description of Related Art

A printer device for printing images and characters to a printing medium is typified by a printer device of thermal transfer type in which a color material of an ink layer formed to one surface of an ink ribbon is sublimed, and the color material is thermally transferred to a printing medium so that color images and characters are printed. The printer device of such a type is provided with a thermal head for use to thermally transfer the color material of the ink ribbon to the printing medium, and a platen disposed at a position opposing the thermal head for supporting the ink ribbon and the printing medium.

In the printer device, the ink ribbon is put together with the printing medium in such a manner that the ink ribbon comes on the thermal head side, and the printing medium comes on the platen side. The ink ribbon and the printing medium are made to run between the thermal head and the platen while being pressed against the thermal head by the platen. At this time, in the printer device, the ink ribbon running between the thermal head and the platen is applied with the thermal energy from the underside to the ink layer thereof. The thermal energy is used to sublime the color material so that the color material is thermally transferred to the printing medium. In such a manner, color images and characters are printed.

In such a printer device, the device body is provided therein with an attachment section for attachment of an ink ribbon cartridge, which carries therein a pair of spools each wound with an ink ribbon. In the ink-ribbon-housing ink ribbon cartridge, one of the spools is wound with the ink ribbon before use, and the other spool is wound with the ink ribbon after use. When attached to the printer device, the ink ribbon cartridge is operated by a running mechanism provided inside of the device body, and the ink ribbon is pulled from one of the spools. The ink ribbon is then subjected to the thermal transfer process by the thermal head, and then is wound around the other spool.

JP-A-6-340136 is exemplified as a related art.

SUMMARY OF THE INVENTION

For exchange of an ink ribbon cartridge, or for the first use of a printer device, with respect to the printer device, insertion and removal of an ink ribbon cartridge is performed. Assuming that a hole for use for insertion and removal of the ink ribbon cartridge is provided to the side surface of the device body, the side surface side of the device body is required to have a space for use of cartridge insertion and removal. Such a space adds constraints for users where to place the printer device, and thus the users find it not convenient. Moreover, because the ink ribbon cartridge is inserted to and removed from the side surface of the device body, such cartridge insertion and removal inhibits the provision of transfer mechanisms, e.g., printing medium and ink ribbon, on the side surface of the device body where an area is provided for allowing the ink ribbon cartridge to move or a hole is provided for cartridge insertion and removal. This causes many restrictions, i.e., the device body cannot be reduced in size, the design flexibility is reduced in terms of space saving, some extra configuration and operation are required to make the thermal head to face the ink ribbon after the ink ribbon cartridge is attached, the configuration of the device body becomes complicated, and the printing operation takes considerably longer. Moreover, users have to face the front of the device body to insert the ink ribbon cartridge to the hole provided on the side surface for cartridge insertion and removal, thereby finding it difficult to go through the cartridge insertion/removal operation.

It is thus desirable to provide a printer device offering ease of insertion and removal of an ink ribbon cartridge, and advantages in terms of size reduction of the device body and layout space.

According to an embodiment of the present invention, there is provided a printer device that prints an image to a printing medium by heating the printing medium with an ink ribbon closely attached thereto. The printer device includes: a base chassis that accepts therein and ejects therefrom the printing medium; a top chassis that is disposed to be able to freely open and close in a direction vertical to the basis chassis; an ink ribbon cartridge holder that is disposed between the top chassis and the base chassis, and is attached with an ink ribbon cartridge including therein the ink ribbon; and a thermal head that prints an image to the printing medium by heating the ink ribbon in the ink ribbon cartridge attached to the ink ribbon cartridge holder. In the printer device, when the top chassis is located at a position where the base chassis is open, the ink ribbon cartridge holder is moved to an insertion/removal position where the ink ribbon cartridge is inserted to and removed from the side of a front surface of the base chassis while being faced outside from an upper surface thereof, and when the top chassis is located at a position where the base chassis is closed, the ink ribbon cartridge is moved to a printing position where the printing medium is printed.

The printer device according to the embodiment of the invention is so configured as to allow a printing medium to be inserted to and ejected from the front surface side, and an ink ribbon cartridge to be inserted to and removed from the front side surface. Accordingly, compared with a printer device in which an ink ribbon cartridge is inserted to and removed from the side surface of the device body, there is no more need to keep some space on the side surface side of the device body for insertion and removal of the ink ribbon cartridge. The printer device thus does not need that much space for placement, thereby favorably increasing the users' usability.

What is more, the users are allowed to face the front of the device body to insert and remove the ink ribbon cartridge to/from the ink ribbon cartridge holder formed on the front surface side of the device body, whereby the users find it easy to go through the insertion/removal operation.

Moreover, compared with a printer device in which an ink ribbon cartridge is inserted to and removed from the side surface of the device body, the printer device of the above configuration allows disposition of various types of mechanisms on the side surface portion of the device body, e.g., transfer mechanism for a printing medium, or running mechanism for an ink ribbon. With such a printer device, a thermal head can face an ink ribbon simultaneously with the attachment of an ink ribbon cartridge.

DETAILED DESCRIPTION OF THE INVENTION

Figure 1:
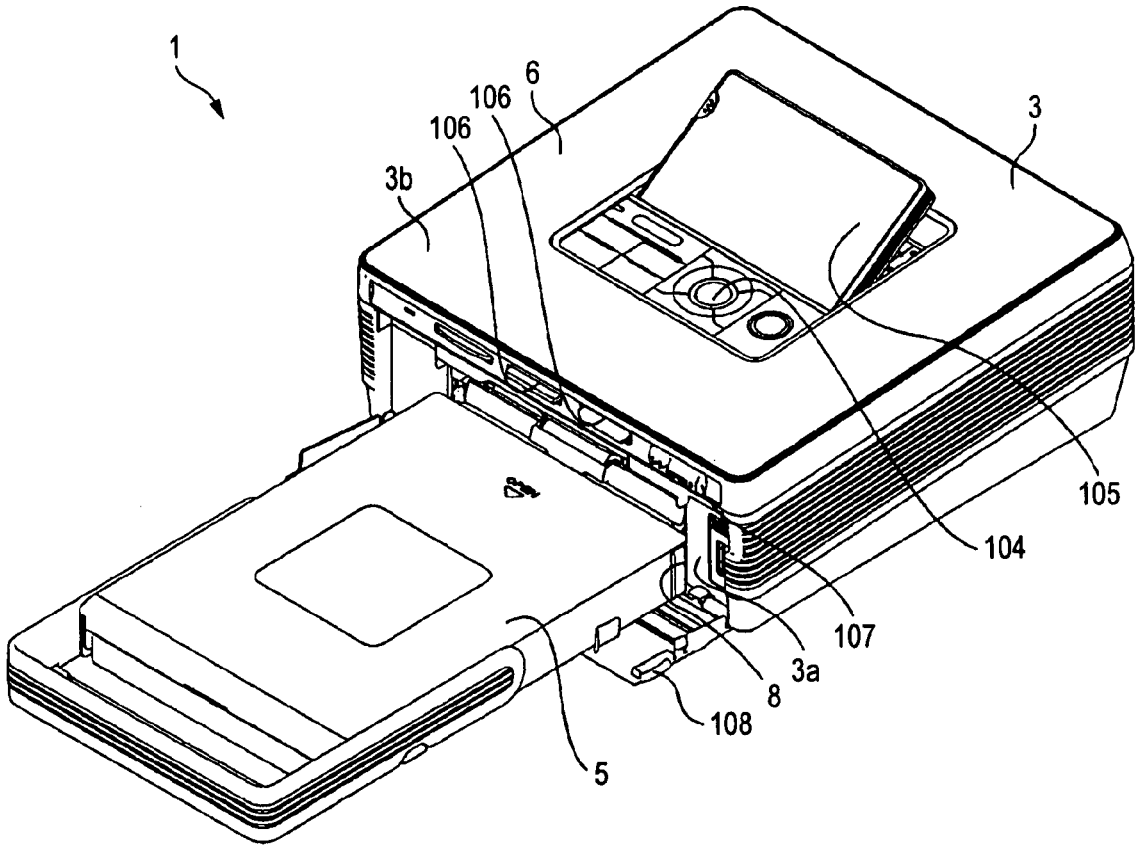
FIG. 1 is an external perspective view of a printer device whose top plate is closed.

In the below, by referring to the accompanying drawings, described in detail is an ink ribbon cartridge to which the invention is applied and a printer device using the ink ribbon cartridge. This printer device 1 is attached with an ink ribbon cartridge 2, which carries therein an ink ribbon. The printer device 1 includes a thermal head, and a platen roller that is disposed at the position opposing the thermal head. Between the thermal head and the platen roller, an ink ribbon and a printing paper are made to run so that the ink ribbon receives the thermal energy from the thermal head. In this manner, the coloring material of the ink ribbon is thermally transferred to the printing paper so that the printing paper is printed with images. As shown in FIG. 1, the printer device 1 is provided with a device body 3 being substantially rectangular. The device body 3 is attached with the ink ribbon cartridge 2, and transfers, for printing, the printing paper from/to inside to/from outside.

Figure 2:
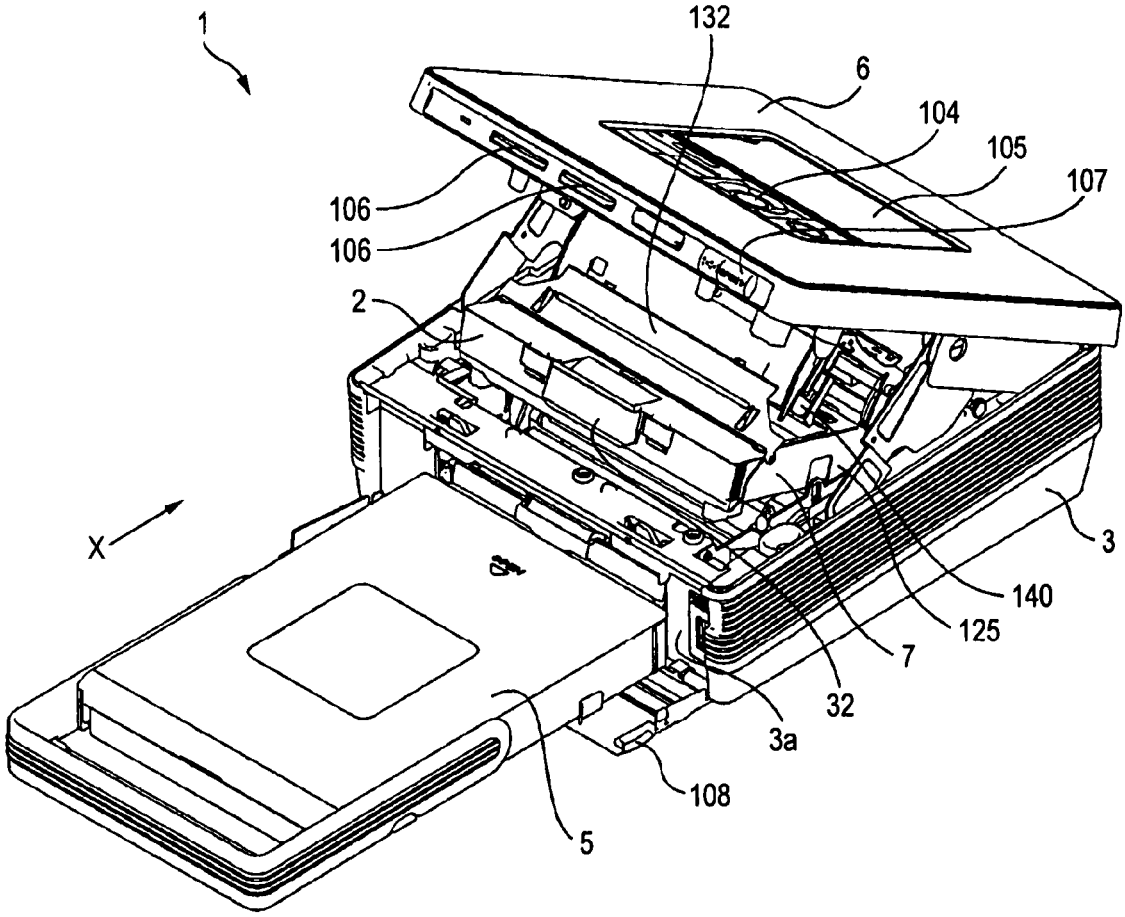
FIG. 2 is another external perspective view of the printer device whose top plate is open.

In the printer device 1, an aperture section 8 is formed to a front surface 3*a* of the device body 3 for attachment of a printing paper tray 5, which carries thereon a printing paper 4. With the aperture section 8 formed as such, the printing paper 4 is inserted to and ejected from the device body 3 from the side of the front surface 3*a*. As shown in FIG. 2, the printer device 1 includes a top plate 6 that is provided to be able to freely rotate in the vertical direction, and configures an upper surface 3*b* of the device body 3. When the top plate 6 is rotated upward, an ink ribbon cartridge holder 7 is rotated upward together with the top plate 6, and made to face the outside from the side of the front surface 3*a* so that the ink ribbon cartridge 2 is inserted to and removed from the side of the front surface 3*a*.

The printer device 1 then receives image information from any recording media attached to a slot provided to the device body 3 for use by the recording media or any recording media varying in type, e.g., digital still camera connected via USB, or others. Based on the image information, the thermal head applies the thermal energy to the ink ribbon, and the printing paper 4 on the printing paper tray 5 is transferred. As such, any predetermined image is printed.

Such a printer device 1 is so configured as to allow the printing paper 4 to be inserted to and ejected from the side of the front surface 3*a*, and the ink ribbon cartridge 2 to be inserted to and removed from the side of the front surface 3*a*. With such a configuration, compared with a printer device in which an ink ribbon cartridge is inserted to and removed from the side surface of the device body, there is no more need to keep some space on the side surface side of the device body for insertion and removal of the ink ribbon cartridge 2. The printer device 1 thus does not need that much space for placement, thereby favorably increasing the users' usability.

What is more, the users are allowed to face the front of the device body 3 to insert and remove the ink ribbon cartridge 2 to/from the ink ribbon cartridge holder 7 formed on the side of the front surface 3*a* of the device body 3, whereby the users find it easy to go through the insertion/removal operation. Moreover, compared with a printer device in which an ink ribbon cartridge is inserted to and removed from the side surface of a device body, the printer device 1 allows disposition of a transfer mechanism 220 for the printing paper 4, a running mechanism 210 for an ink ribbon 10, or others on the side surface portion of the device body 3. Also with the printer device 1, a thermal head 140 can face the ink ribbon 10 simultaneously with the attachment of the ink ribbon cartridge 2.

Described next is the ink ribbon cartridge 2 to be housed in such a printer device 1, and then the configuration of the printer device 1.

Figure 3:
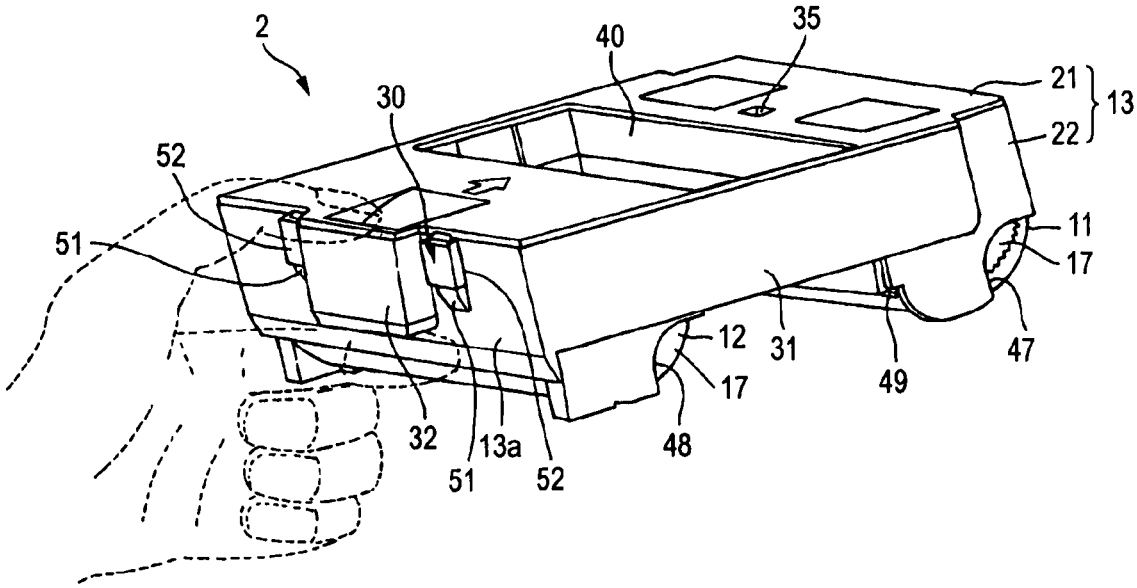
FIG. 3 is an external perspective view of an ink ribbon cartridge to be attached to the printer device.
Figure 4:
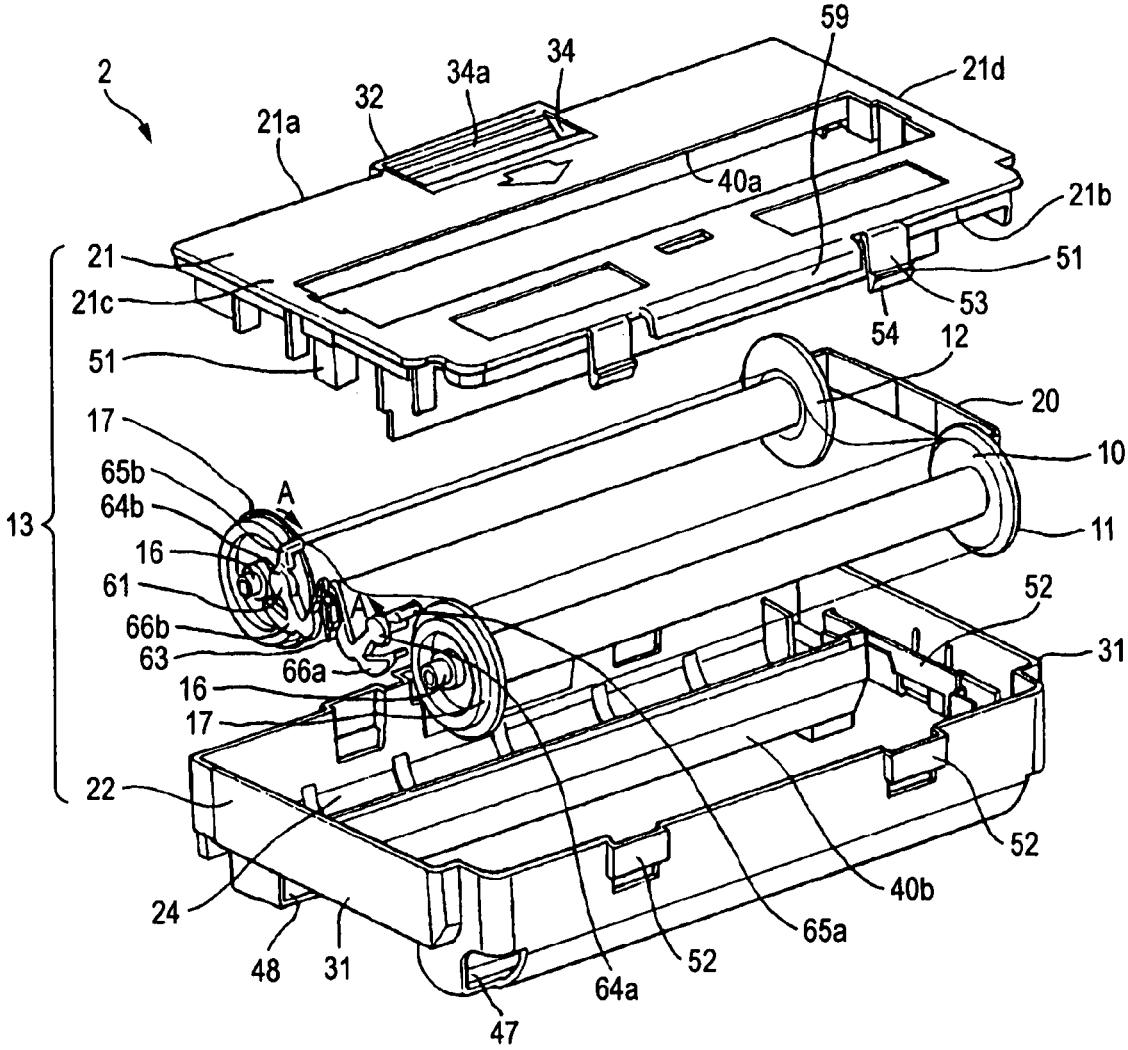
FIG. 4 is an exploded perspective view of the ink ribbon cartridge to be attached to the printer device.

The ink ribbon cartridge 2 is attached to the printer device 1 of a type that performs color printing by thermally transferring the coloring material to the printing paper 4. As shown in FIGS. 3 and 4, this ink ribbon cartridge 2 is provided with a supply spool 11, a take-up spool 12, and a cartridge body 13. The supply spool 11 is wound with the ink ribbon 10 formed with a coloring material layer, which is to be transferred to the printing paper 4. The take-up spool 12 is in charge of taking up the ink ribbon 10. The cartridge body 13 is provided for housing therein the supply spool 11 wound with the ink ribbon 10, and the take-up spool 12.

Figure 5:
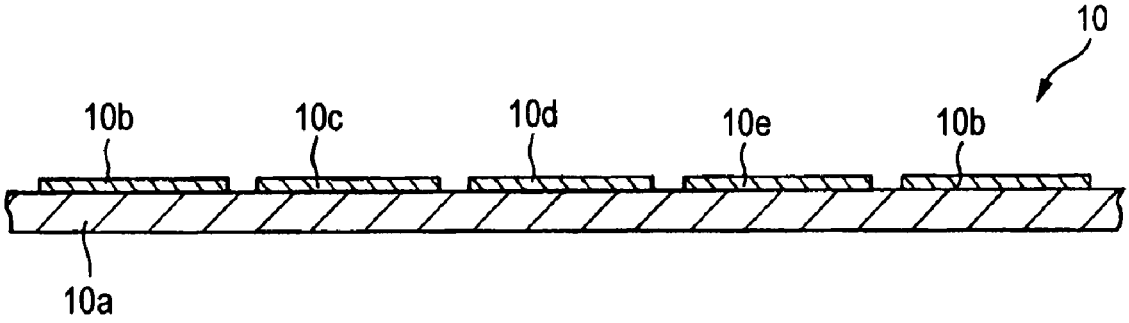
FIG. 5 is a cross sectional view of an ink ribbon.

As shown in FIG. 5, the ink ribbon 10 is so configured that a base material 10*a* is provided with, on one surface, coloring material layers 10*b*, 10*c*, and 10*d*, and a protection layer 10*e*. The base material 10*a* is a synthetic resin film such as polyester film or polyethylene film. The coloring material layers 10*b*, 10*c*, and 10*d* are each formed by a coloring material and a thermoplastic resin, and the protection layer 10*e* is formed by the same thermoplastic resin as that of the coloring material layers 10*b*, 10*c*, and 10*d*, for example. The coloring material is of various colors forming an image, e.g., yellow (Y), magenta (M), and cyan (C). The coloring material layers 10*b*, 10*c*, and 10*d*, and the protection layer 10*e* are provided repeatedly in a row in the longitudinal direction at regular intervals. As such, the base material 10*a* includes a set of the coloring material layers 10*b*, 10*c*, and 10*d*, and the protection layer 10*e* arranged in this order in the longitudinal direction. In response to the thermal energy applied by the thermal head 140 to suit image data to be printed, the coloring material layers 10*b*, 10*c*, and 10*d*, and the protection layer 10*e* are thermally transferred in a sequential manner to a reception layer 4*b* of the printing paper 4, which will be described later.

Such an ink ribbon 10 is provided for use to print a piece of image using the coloring material layers 10*b* to 10*d* of yellow (Y), magenta (M), and cyan (C), and the protection layer 10*e*. One end portion of the ink ribbon 10 is latched to the supply spool 11, and the other end portion thereof is wound around the take-up spool 12. As a printing job proceeds, the ink ribbon 10 sequentially comes from the supply spool 11, and is taken up by the take-up spool 12.

The ink ribbon 10 for use in the invention is not restricted in configuration as long as the ink ribbon includes at least a coloring material layer and a protection layer. For example, the ink ribbon 10 maybe configured by a coloring material layer of black (K) and a protection layer, or may be configured by coloring material layers of yellow (Y), magenta (M), cyan (C), and black (K), and a protection layer.

Figure 6:
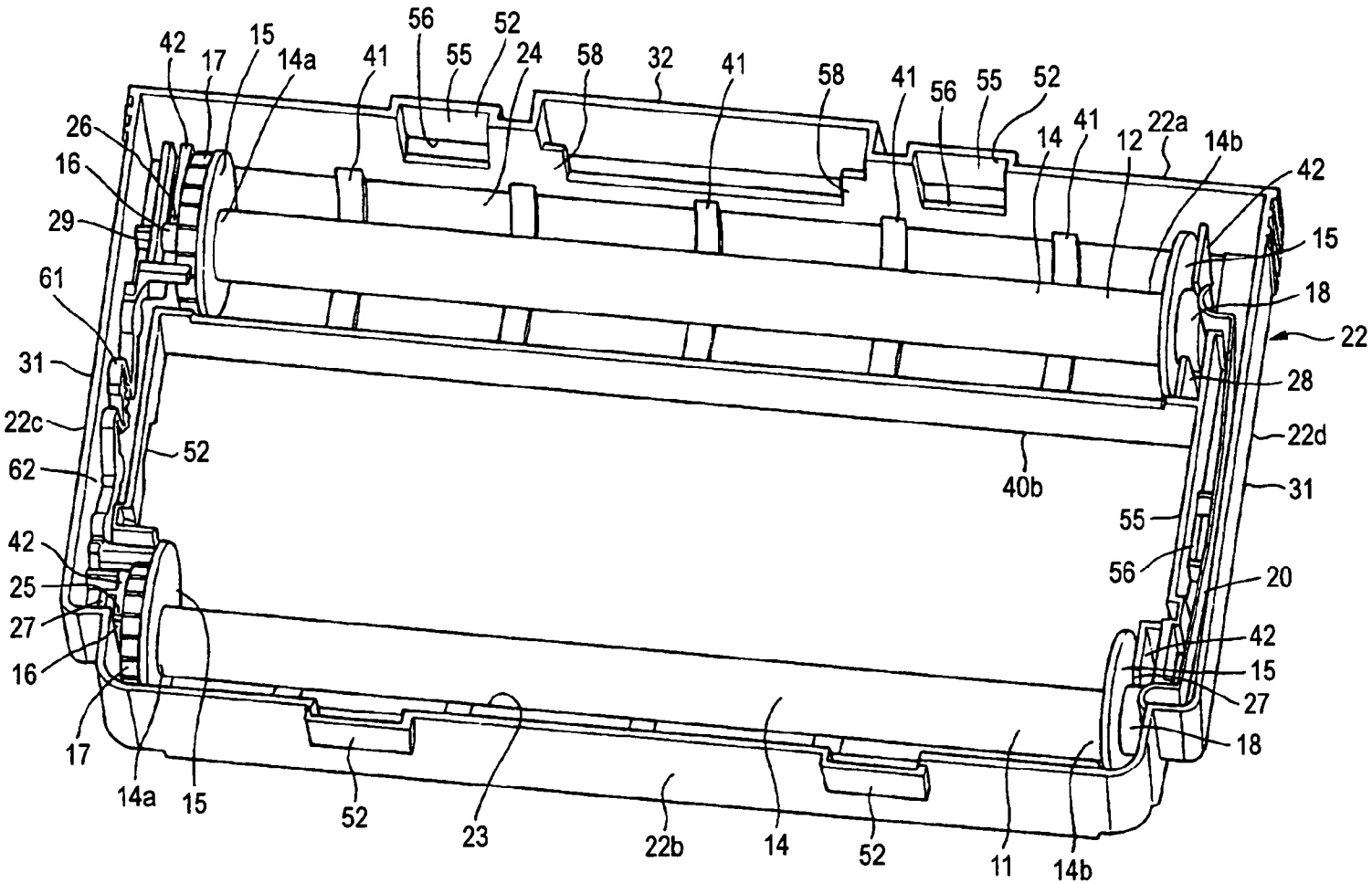
FIG. 6 is a perspective view of a lower shell of the ink ribbon cartridge.

As shown in FIGS. 4 and 6, the supply spool 11 and the take-up spool 12 are each provided with an axis section 14 for winding of the ink ribbon 10. On both sides of the axis section 14, flange sections 15 and 15 are formed. At the axis section 14 of the supply spool 11, one end portion of the ink ribbon 10 is latched using an adhesive or by a latching member. At the axis section 14 of the take-up spool 12, the other end portion of the ink ribbon 10 is latched using an adhesive or by a latching member. The flange sections 15 and 15 each regulate the position for winding of the ink ribbon 10 around the axis section 14 in the axis direction.

One end portions 14*a* of the axis sections 14 of the supply spool 11 and the take-up spool 12 are each formed with a ratchet gear 17. The ratchet gear 17 is formed around the perimeter of the corresponding flange section 15 via a spindle section 16 concentric to the axis section 14. The ratchet gears 17 are latched to a spool lock 61 that will be described later, thereby regulating the rotation of the supply spool 11 and the take-up spool 12. After being attached to the printer device 1, the latchet gear 17 is engaged with the ink ribbon running mechanism 210 of the printer device 1, and rotates the take-up spool 12. The spindle sections 16 provided at the tip of the flange sections 15 are supported, respectively, by bearing sections 25 and 26 to be able to freely rotate, and are both disposed to abut an abutting wall 29 that is provided adjacent to the bearing sections 25 and 26. The bearing sections 25 and 26 are those respectively provided to a supply spool housing section 23 and a take-up spool housing section 24. The supply spool housing section 23 carries therein the supply spool 11, and the take-up spool housing section 24 carries therein the take-up spool 12.

The other end portions 14*b* of the axis sections 14 of the supply spool 11 and the take-up spool 12 are each formed with a protrusion section 18 at the tip of the corresponding flange section 15. The other end portions 14*b* of the axis sections 14 are those located opposite to the ends formed with the latchet gears 17. These protrusion sections 18 are supported by bearing sections 27 and 28, and are always biased by a biasing member 20 in the axis direction of the axis sections 14. The bearing sections 27 and 28 are those provided to the supply spool housing section 23 and the take-up spool housing section 24, respectively.

The biasing member 20 is formed by bending a thin metal plate, and is disposed inside of a guide section 31, which is formed on the side surface of the cartridge body 13 that will be described later. The biasing member 20 is formed long in length and is entirely warped, and its ends in the longitudinal direction are both bent toward the side of the axis sections 14 of the supply spool 11 and the take-up spool 12. The tip end portions of the biasing member 20 are curved like an arc so as to abut the protrusion sections 18 of the axis sections 14. The biasing member 20 is so disposed that its end portions are each located between the side surface of the cartridge body 13 and the corresponding protrusion section 18, thereby always biasing the protrusion sections 18 in the axis direction of the axis sections 14.

The bearing sections 25 to 28 provided for supporting the supply spool 11 and the take-up spool 12 are disposed at intervals being slightly longer than those for the flange sections 15 and 15. Accordingly, the supply spool 11 and the take-up spool 12 are thus allowed to rotate smoothly without causing the flange sections 15 and 15 to slide in contact with the bearing sections 25 to 28. Although there is a possibility of causing the supply spool 11 and the take-up spool 12 to rattle in the axis direction, such a possibility is favorably eliminated by the protrusion sections 18 being always biased by the biasing member 20 in the axis direction, i.e., the tip end of the spindle section 16 provided to one end portion 14*a* of the axis section 14 is made to abut the abutting wall 29, and the supply spool 11 and the take-up spool 12 are thus housed in the supply spool housing section 23 and the take-up spool housing section 24, respectively, without rattling. That is, by being abut with the spindle sections 16 on the side of the ratchet gears 17 of the supply spool 11 and the take-up spool 12, the abutting wall 29 is used as a reference for positioning of the supply spool 11 and the take-up spool 12 inside of the cartridge body 13 in the axis direction. With such a configuration, the ink ribbon 10 to be wound around the supply spool 11 and the take-up spool 12 is stabilized, in terms of position, for winding inside of the cartridge body 13. The ink ribbon 10 is also allowed to face the thermal head 140 and the platen roller 155 with high accuracy when the ink ribbon cartridge 2 comes at the position for attachment.

The protrusion sections 18 to be abut the biasing member 20 are formed larger in diameter than the spindle sections 16 that are made to abut the abutting wall 29. That is, the supply spool 11 and the take-up spool 12 receive the biasing force of the biasing member 20 at the tip ends of the protrusion sections 18 larger in diameter, and are pressed against the abutting wall 29 at the tip ends of the spindle sections 16 smaller in diameter. This favorably allows the spindle sections 16 to slide in contact with the abutting wall 29 with a low friction, thereby favorably reducing any torque loss and torque fluctuations that are often caused by rotation drive, and suppressing the power consumption.

Note here that bending a thin metal plate is not the only option for forming the biasing member 20, and using a coil spring will also do.

Figure 7A:
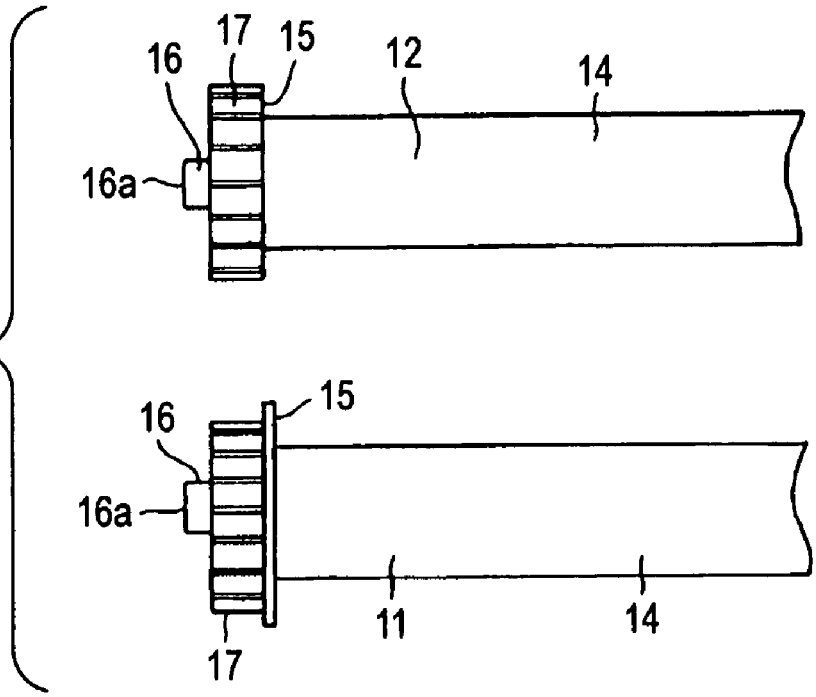
FIGS. 7A and 7B are both a side view of a tip end surface of a protrusion section provided to a spool.
Figure 7B:
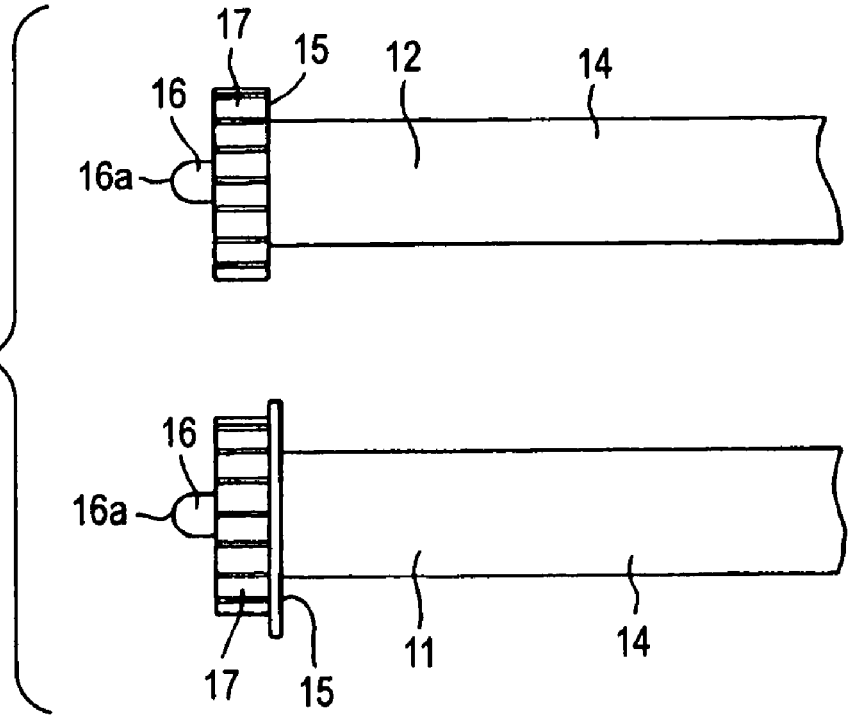

The bearing section 16 is a cylindrical body concentric to the axis section 14, and is so formed that its tip end surface 16*a* to be abut the abutting wall 29 is made flat as shown in FIG. 7A or made curved like an arc as shown in FIG. 7B. With the tip end surface 16*a* being curved like an arc, the friction with the abutting wall 29 is reduced so that the spindle section 16 becomes able to rotate smoothly.

The supply spool 11 and the take-up spool 12 configured as such are housed in the cartridge body 13 to be able to freely rotate. As shown in FIG. 4, the cartridge body 13 is configured to include an upper shell 21 and a lower shell 22. The upper shell 21 configures the upper surface of the cartridge body 13, and the lower shell 22 houses therein the supply spool 11 and the take-up spool 12 to be able to freely rotate. The upper shell 21 and the lower shell 22 are butt-coupled together by an engagement mechanism 30 so that the coupling body 13 is formed.

The cartridge body 13 is formed substantially rectangular in its entirety. The cartridge body 13 is formed with, on both side surfaces in the longitudinal direction, guide sections 31 that guide insertion to and removal from the ink ribbon cartridge holder 7 of the printer device 1 (will be described later). The cartridge body 13 is also formed with, on its front surface portion 13*a*, a holding section 32 that is held by a user at the time of insertion to and removal from the printer device 1.

The guide sections 31 are formed parallel along the side surfaces of the cartridge body 13, and are bulging sideways at positions higher than the lower surface of the cartridge body 13 where the supply spool housing section 23 and the take-up spool housing section 24 are provided. Such guide sections 31 are supported by the ink ribbon cartridge holder 7 whose cross section looks like substantially a laterally-inverted-letter-U so that insertion to and removal from the printer device 1 is guided thereby. The guide sections 31 are supported by the ink ribbon cartridge holder 7, the lower surface of which is shaped like substantially a laterally-inverted-letter-U. Beneath the guide sections 31, a space can be reserved for the placement of the components on the side of the printer device 1. That is, because the guide sections 31 are bulging sideways at positions higher than the lower surface of the cartridge body 13, when supported by the ink ribbon cartridge holder 7 whose cross section looks like substantially a laterally-inverted-letter-U, the space appears therebeneath. This space becomes available for the placement of the components of the printer device 1, thereby contributing to the increase of design flexibility, the reduction of size, and the saving of space of the printer device 1.

Note here that, to the guide sections 31, the spool lock 61 (will be described later) is facing from aperture sections 33 that are punched in the lower surface. When the guide sections 31 are supported by the ink ribbon cartridge 7, the spool lock 61 is pressed so that the supply spool 11 and the take-up spool 12 become able to freely rotate (refer to FIGS. 12, 10, and others).

The holding section 32 is formed to bulge at substantially the center portion of the front surface portion 13*a* of the cartridge body 13. The holding section 32 is a handle for use by a user when he or she attaches and ejects the ink ribbon cartridge 2 to/from the printer device 1. The holding section 32 is formed substantially rectangular in its entirety, and is bulging frontward at a position higher than the lower surface of the cartridge body 13. As shown in FIG. 4, such a holding section 32 is formed with, on its upper surface, a concave section 34 where the user's thumb is placed. The concave section 34 includes a slanted surface 34*a*, which is curved downward toward the rear surface side of the cartridge body 13. The slanted surface 34*a* is formed with a plurality of convex sections in the longitudinal direction of the cartridge body 13 for non-slip use.

The upper shell 21 configures the upper surface 13*b* of the cartridge body 13 through butt-coupling with the lower shell 22. As shown in FIG. 4, the substantially-rectangular shell body is formed with the concave section 34 of the above-described holding section 32, a concave section 35, and a latch lug 51. The concave section 35 is used for temporary positioning of the ink ribbon cartridge 2 in the printer device 1 when the cartridge is inserted into the ink ribbon cartridge holder 7. The latch lug 51 is latched to the lower shell 22 that will be described later.

The concave section 35 for temporary positioning use is engaged with a convex section 131 provided to the ink ribbon cartridge holder 7 also for temporary positioning use. Through such engagement, the concave section 35 serves to temporarily position the ink ribbon cartridge 2 inside of the device body 3 of the printer device 1. As such, the ink ribbon cartridge 2 is temporarily positioned in the rotated-upward ink ribbon cartridge holder 7, and the ink ribbon cartridge holder 7 being rotated inside of the device body 3 accordingly eases the insertion of first and second positioning convex sections 162 and 163 into positioning holes 72 and 73. The positioning holes 72 and 73 are those provided to a lower surface portion 13*c* of the cartridge body 13, and the first and second positioning convex sections 162 and 163 are those protruding inside of the device body 3.

The latch lug 51 will be described in detail later together with a latch hole 52 formed to the lower shell 22.

As shown in FIG. 6, to the lower shell 22 to be butt-coupled with such an upper shell 21, the supply spool housing section 23 housing therein the supply spool 11 is provided parallel to the take-up spool housing section 24 housing therein the take-up spool 12 with a space therebetween. The spool housing sections 23 and 24 are both so formed that their cross sections are substantially half-round, thereby housing therein the supply spool 11 and the take-up spool 12 to be able to freely rotate.

The supply spool housing section 23 and the take-up spool housing section 24 are each formed with a plurality of ribs 41 at intermittent intervals in the direction orthogonal to the longitudinal direction. The ribs 41 are each a protruding body, and are provided along the arc-shaped inner wall of the supply spool housing section 23 and that of the take-up spool housing section 24. The ribs 41 serve to support, in an intermittent manner, the supply spool 11 and the take-up spool 12 wound with the ink ribbon 10. With such a configuration, the ribs 41 serve well to keep the ink ribbon 10 from contact with the inner wall of the supply spool housing section 23 and that of the take-up spool housing section 24 even with static drag force. Even if the ink ribbon 10 comes in contact with the inner walls, the ribbon can easily come off, thereby ensuring the smooth rotation of the supply spool 11 and the take-up spool 12.

The supply spool housing section 23 is provided with the bearing section 25 at its one end in the longitudinal direction, and the bearing section 27 at its other end in the longitudinal direction. The bearing section 25 is provided for supporting the spindle section 16 of the supply spool 11 at the outer side of corresponding the flange section 15, and the bearing section 27 is provided for supporting the protrusion section 18 of the supply spool 11 at the outer side of the corresponding flange section 15. The take-up spool housing section 24 is provided with the bearing section 26 at its one end in the longitudinal direction, and the bearing section 28 at its other end in the longitudinal direction. The bearing section 26 is provided for supporting the spindle section 16 of the take-up spool 12 at the outer side of the corresponding flange section 15, and the bearing section 28 is provided for supporting the protrusion section 18 of the take-up spool 12 at the outer side of the corresponding flange section 15.

Figure 8:
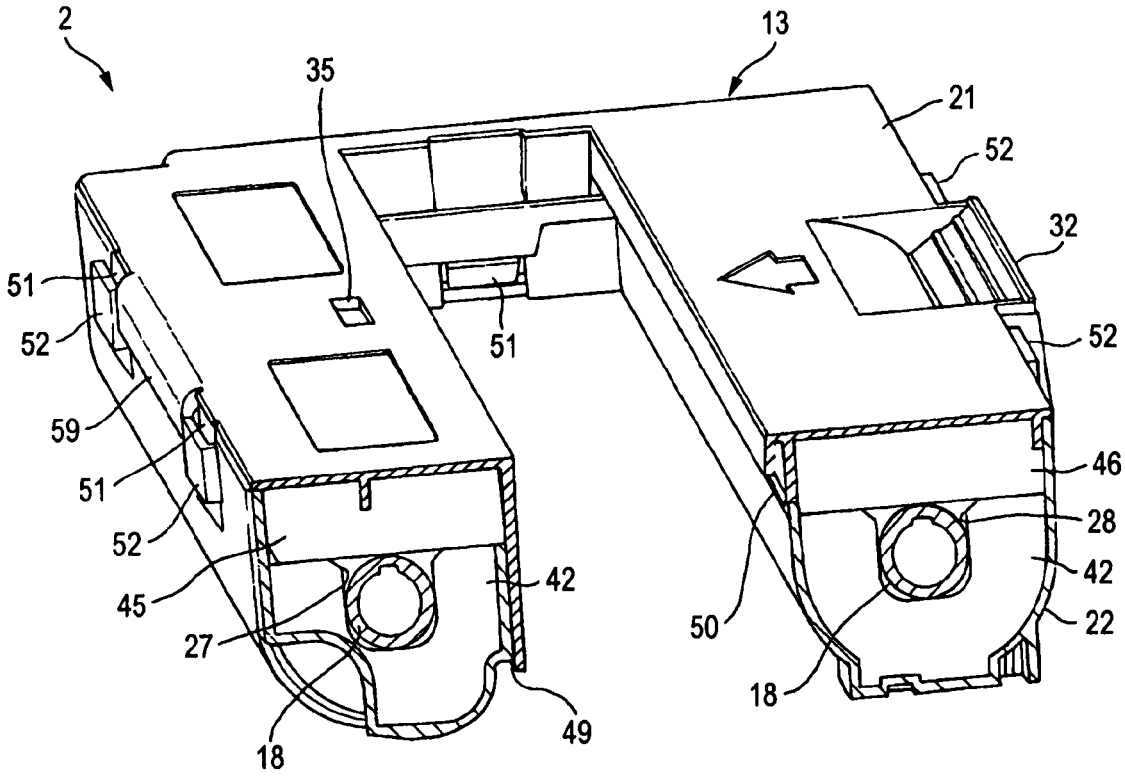
FIG. 8 is a cross sectional view of a support section of the spool, and a support wall and a support piece thereof for sandwiching therebetween the protrusion section.

As shown in FIG. 8, these bearing sections 25 to 28 are each provided by notching a support wall 42 to be substantially concave with an open upper surface. The support wall 42 is the one formed at both end portions of the supply spool housing section 23 and those of the take-up spool housing section 24 in the longitudinal direction. The bearing sections 25 to 28 formed as such serve to support the spindle sections 16, and three spots of each of the protrusion sections 18, i.e., the lower portion and the right and left side portions. As to the bearing sections 25 to 28, when the upper shell 21 is butt-coupled with the lower shell 22, the support walls 42 are made to abut support pieces 43 to 46, and their open upper surface sides are closed by these support pieces 43 to 46. The support pieces 43 to 46 are those provided to protrude toward the side of the upper shell 21 corresponding to the support walls 42. As a result, the spindle sections 16 and the protrusion sections 18 are supported at their upper one spot by the support pieces 43 to 46. As such, by the spindle sections 16 and the protrusion sections 18 being supported in all directions by the bearing sections 25 to 28 and the support pieces 43 to 46, the supply spool 11 and the take-up spool 12 are accordingly positioned in the supply spool housing section 23 and in the take-up spool housing section 24, respectively.

As shown in FIGS. 3 and 4, the supply spool housing section 23 and the take-up spool housing section 24 are formed with, respectively, gear-use aperture sections 47 and 48. These gear-use aperture sections 47 and 48 are provided for the ratchet gears 17 of the supply spool 11 and the take-up spool 12 to partially face the outside from the lower surface side of the cartridge body 13. From the gear-use aperture section 47, the ratchet gear 17 formed to the supply spool 11 is made visible, and is engaged with a gear section 137 of a coupling member 135 attached to a top chassis 102 that will be described later. Through such engagement, when the ink ribbon cartridge holder 7 is open, the supply-spool 11 is rotated in the direction of rewinding the ink ribbon 10. From the gear-use aperture section 48, the ratchet gear 17 formed to the take-up spool 12 is made visible, and is engaged with a running gear 212 of the ink ribbon running mechanism 210 of the printer device 1 when the ink ribbon cartridge 2 is moved to the printing position of the printer device 1 and is positioned thereat. Through such engagement, the take-up spool 12 is allowed to rotate in the take-up direction along which the ink ribbon 10 is made to run.

The supply spool housing section 23 and the take-up spool housing section 24 are both formed with, respectively, slits 49 and 50. The slit 49 serves as a pull-out aperture for the ink ribbon 10, and the slit 50 serves as a bring-in aperture therefor. Such slits are formed by the upper shell 21 being butt-coupled with the lower shell 22. With such a configuration, the ink ribbon 10 is extended across the supply spool housing section 23 and the take-up spool housing section 24.

Note here that apertures 40*a* and 40*b* (hereinafter, simply referred to also as aperture section 40) are formed between the upper shell 21 and the supply spool housing section 23 and the take-up spool housing section 24 of the lower shell 22. When the upper and lower shells 21 and 22 are butt-coupled together, the aperture section 40 configured by the aperture sections 40*a* and 40*b* is placed across the supply spool 11 and the take-up spool 12 so that the ink ribbon 10 is faced outside. Here, the ink ribbon 10 is extended to the slit 50 of the take-up spool housing section 24 from the slit 49 of the supply spool housing section 23. The aperture section 40 also serves as an area where the thermal head 140 of the printer device 1 enters so that the ink ribbon 10 is pressed against the printing paper 4, and an area where a ribbon guide 165 protruding toward the side of the printer device 1 enters so that a ribbon path is formed.

Figure 9:
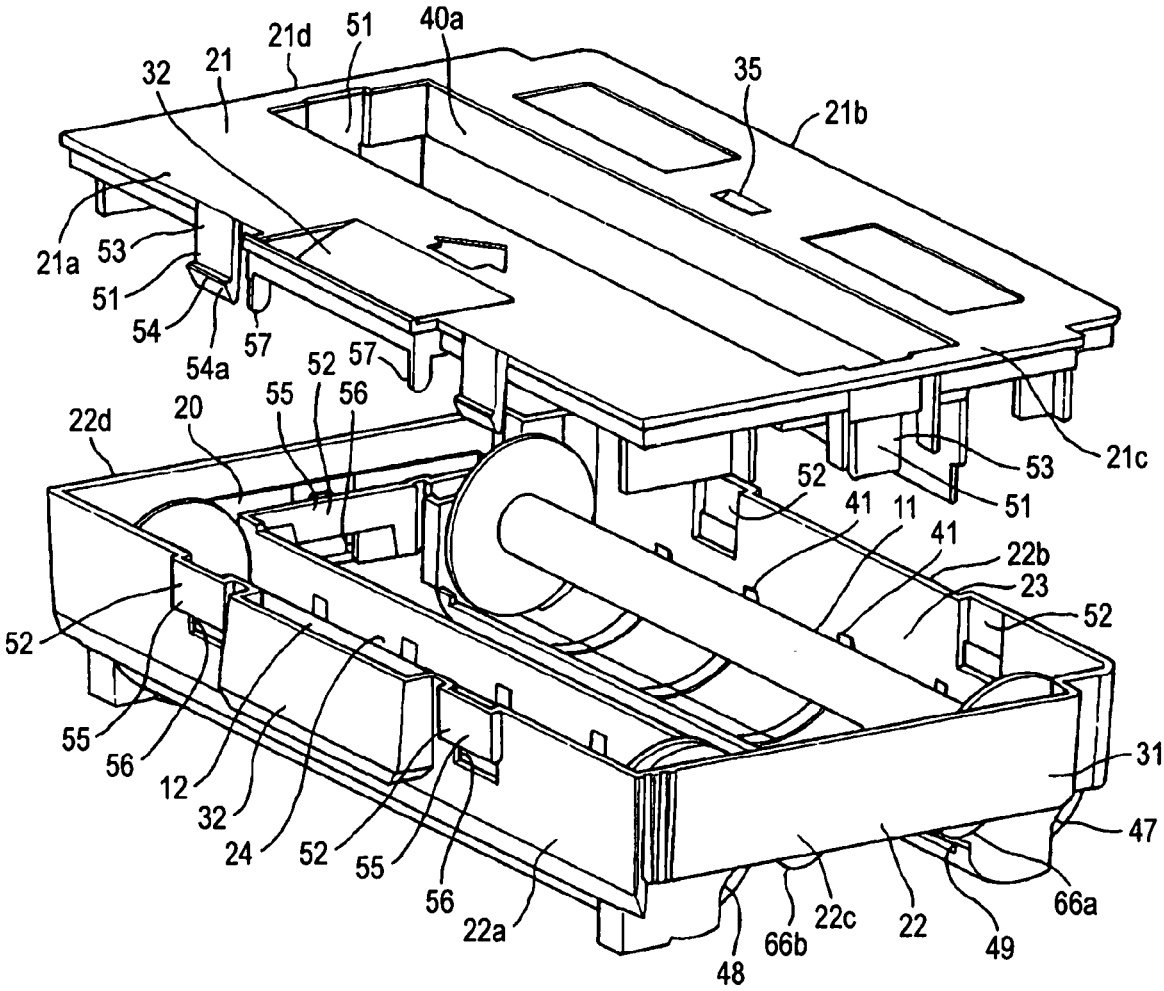
FIG. 9 is an exploded perspective view of an ink ribbon cartridge to be attached to the printer device.

Described now is the engagement mechanism 30 serving to couple together the upper shell 21 and the lower shell 22. The engagement mechanism 30 latches the latch lug 51 protruding from the side edge portion of the upper shell 21 to the latch hole 52 formed to the side edge portion of the lower shell 22 so that the upper shell 21 is coupled with the lower shell 22. As shown in FIGS. 4 and 9, the latch lug 51 is plurally formed to the upper shell 21, i.e., two each to an upper surface 21*a* and a rear surface 21*b*, and one each to side surfaces 21*c* and 21*d*. The latch lugs 51 are each provided with a body section 53 being substantially a rectangular plate directing downward, and a hook-shaped section 54 at the tip end of the body section 53. The hook-shaped section 54 includes a slanted surface 54*a* slanting toward the tip end of the body section 53, and is ready to be engaged easily with the latch hole 52 formed to the lower shell 22. As shown in FIG. 9, the latch hole 52 is plurally formed to the lower shell 22, i.e., two each to an upper surface 22*a* and a rear surface 22*b*, and one each to side surfaces 22*c* and 22*d*. The latch holes 52 are each provided with a latch wall section 55 at which the hook-shaped section 54 of the latch lug 51 is latched, and an aperture section 56 through which the hook-shaped section 54 goes. When the upper shell 21 is made to abut the lower shell 22, the hook-shaped sections 54 move the latch wall sections 55 to slide and go through the aperture sections 56 so that the latch lugs 51 are latched to the latch wall sections 55.

The upper shell 21 is provided with control release pieces 57 and 57, protruding between the latch lugs 51 and 51 of the front surface 21*a*. The lower shell 22 is provided with control release walls 58 and 58, standing between the latch holes 52 and 52 of the front surface 22*a* for abutting with the control release pieces 57 and 57. As shown in FIGS. 9 and 6, the control release pieces 57 and the control release walls 58 are all provided inside of the holding section 32 of the cartridge body 13.

The control release pieces 57 are directed downward from both sides, in the longitudinal direction, of the holding section 32 bulging toward the side of the front surface 21*a* of the upper shell 21. When the upper shell 21 is made to abut the lower shell 22, the control release pieces 57 are inserted into the holding section 32 on the side of the lower shell 22. Corresponding to such control release pieces 57, the control release walls 58 are provided on both sides, in the longitudinal direction, of the holding section 32 bulging toward the front surface 22*a* of the lower shell 22. These control release walls 58 form a clearance with the front surface wall being a bulge toward the front surface 22*a* of the lower shell 22 for insertion of the control release pieces 57.

When the upper shell 21 is made to abut the lower shell 22, the latch lugs 51 are each inserted into the corresponding aperture section 56 while the hook-shaped sections 54 are moving, to slide, the latch wall sections 55 of the latch holes 52. The control release pieces 57 are also inserted between the control release wall 58 and the front wall of the lower shell 22. At this time, because the hook-shaped sections 54 of the latch lugs 51 are each formed with the slanted surface 54*a*, the tip end of the hook-shaped sections 54 are allowed to smoothly abut the latch wall section 55. Moreover, the body sections 53 of the latch lugs 51 are moved to slide while the body sections 53 are being changed in shape, and the elasticity of the body sections 53 is recovered in response when the hook-shaped sections 54 are inserted into the aperture sections 56 so that the hook-shaped sections 54 and the latch wall sections 55 are latched together with reliability. With such reliable latching, the control release pieces 57 are supported, on the front surface side, by the front surface wall of the lower shell 22, and are supported, on the rear surface side, by the control release walls 58 so that the upper shell 21 is protected not to fall toward the rear surface side. It means that the latch lugs 51 and 51 protruding from the front surface 21*a* of the upper shell 21 are protected not to tilt toward the rear surface side, i.e., the direction of releasing the engagement with the latch holes 52 and 52 provided to the front surface 22*a* of the lower shell 22. As such, the engagement release is prevented between the upper and lower shells 21 and 22.

As shown in FIG. 4, the upper shell 21 is provided with an engagement piece 59 between the latch lugs 51 and 51 of the rear surface 21*b* for engagement with the rear surface wall of the lower shell 22 in the longitudinal direction. The engagement piece 59 is curved downward from the rear surface 21*b* of the upper shell 21. When being made to abut the lower shell 22, the engagement piece 59 is so engaged as to cover the rear surface wall of the lower shell 22. Through such engagement, the front surface side of the engagement piece 59 abuts the rear surface wall of the lower shell 22 so that the upper shell 21 is protected not to fall toward the side of the front surface 21*a*. It means that the latch lugs 51 and 51 protruding from the rear surface 22*b* of the upper shell 21 are protected not to tilt toward the front surface side, i.e., the direction of releasing the engagement with the latch holes 52 and 52 provided to the rear surface 22*b* of the lower shell 22. As such, the engagement release is prevented between the upper and lower shells 21 and 22.

Note here that, as to such an engagement mechanism 30, providing the control release pieces 57 and the control release walls 58 to the holding section 32 is not restrictive, and any arbitrary positions of the upper shell 21 and the lower shell 22 will also do. As an example, the latch lugs 51 and the control release pieces 57 may be provided to the lower shell 22, and the latch holes 52 and the control release walls 58 maybe provided to the upper shell 21.

As shown in FIGS. 4 and 6, the lower shell 22 configuring the cartridge body 13 is provided with the spool lock 61 at the side of one end portion where the abutting wall 29 is formed. The spool lock 61 serves to prevent the rotation of the supply spool 11 and the take-up spool 12, which are housed to be able to freely rotate. This spool lock 61 is disposed at a coupling section 62, which is provided on the side of one end portion of the lower shell 22 between the supply spool housing section 23 and the take-up spool housing section 24.

Figure 10:
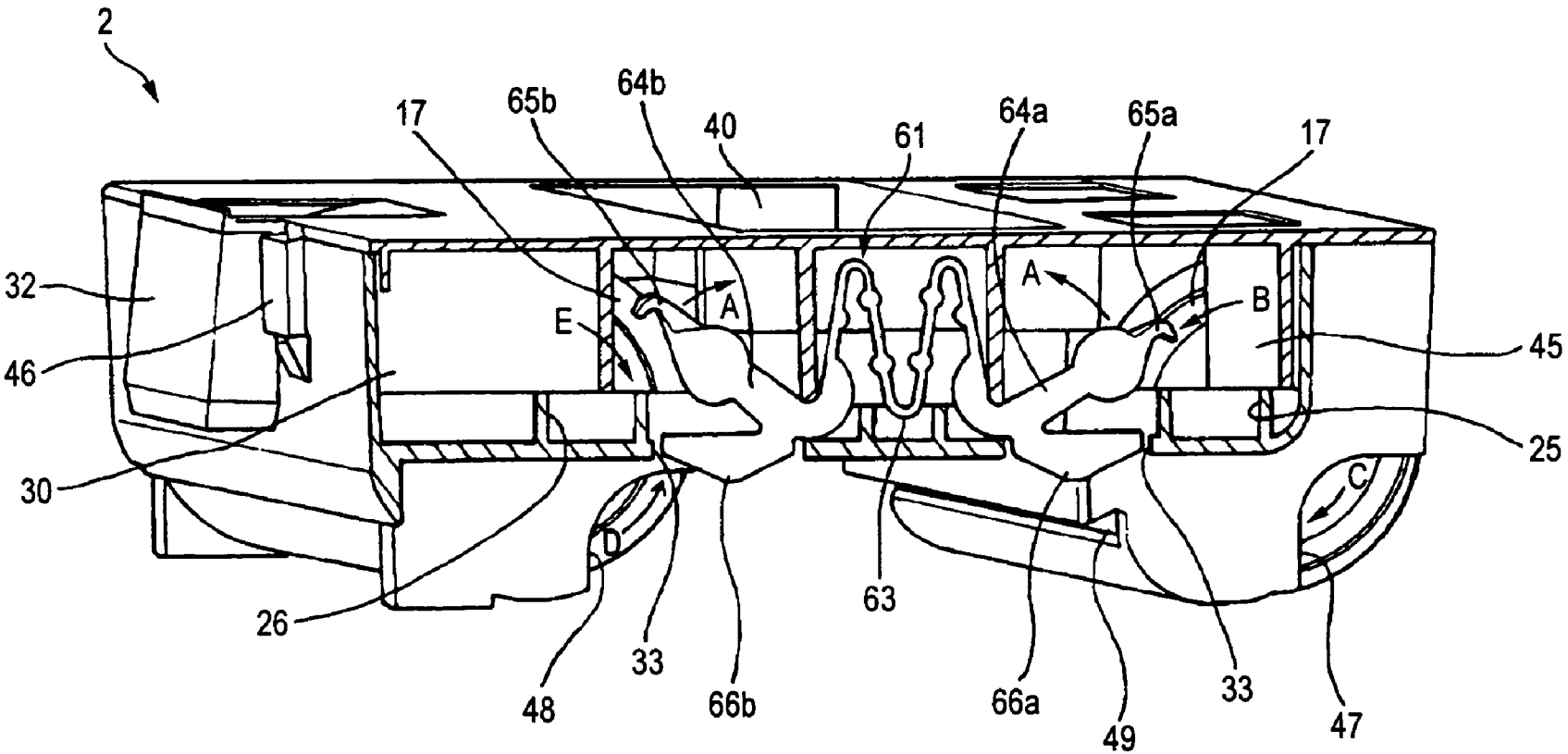
FIG. 10 is a diagram showing an ink ribbon cartridge in which the spool is restricted in rotation by a spool lock.

As shown in FIG. 10, this spool lock 61 is provided with a substantially-M-shaped elastic support section 63 disposed to the coupling section 62, and a pair of elastic engagement pieces 64*a* and 64*b*. The elastic engagement pieces 64*a* and 64*b* are extending from the elastic support section 63 toward the supply spool housing section 23 and the take-up spool housing section 24, respectively. The elastic engagement pieces 64*a* and 64*b* are respectively formed with, on their upper end sides, protruding latchet portions 65*a* and 65*b* for engagement with the latchet gears 17 and 17 of the supply spool 11 and the take-up spool 12. These latchet portions 65*a* and 65*b* are so formed as to displace in the direction of an arrow A of FIG. 10, and in the direction opposite to the arrow A, i.e., the latchet portions 65*a* and 65*b* are engaged with or released from the latchet gears 17 and 17 of the supply spool 11 and the take-up spool 12 based on the elastic support section 63.

On the lower end side, the elastic engagement pieces 64*a* and 64*b* are both made visible below the guide sections 31 from the aperture sections 33. The aperture sections 33 are those punched in the lower surface of the guide sections 31 of the cartridge body 13, thereby forming to-be-pressed portions 66*a* and 66*b* for pressing by a guide support section 125 of the ink ribbon cartridge holder 7. When pressed by the guide support section 125, the to-be-pressed portions 66*a* and 66*b* elastically displace the latchet portions 65*a* and 65*b* in the direction of an arrow A of FIG. 4, i.e., the direction of releasing the engagement with the latchet gears 17 and 17 of the supply spool 11 and the take-up spool 12.

As shown in FIG. 10, in such a spool lock 61, with the elastic support section 63 being disposed to the coupling section 62 of the lower shell 22, the to-be-pressed portions 66*a* and 66*b* are both made visible below the guide sections 31 from the aperture sections 33 punched in the lower surface of the guide sections 31 of the cartridge body 13, thereby being ready to be pressed by the guide support section 125 of the ink ribbon cartridge holder 7. At this time, through the engagement of the latchet portions 65*a* and 65*b* with the latchet gears 17 and 17, the spool lock 61 is preventing the supply spool 11 and the take-up spool 12 from rotating.

More specifically, the latchet portions 65*a* and 65*b* of the spool lock 61 are respectively engaged with the latchet gears 17 and 17 of the spools 11 and 12 at the diagonally upward portion of the opposing surface side. As such, the spool lock 61 regulates the rotation of the supply spool 11 and the take-up spool 12 in the feeding direction of the ink ribbon 10 but not in the take-up direction thereof. The spool lock 61 thus can prevent the ink ribbon 10 from sagging or being pulled out outside by the spools 11 and 12 erroneously rotating in the feeding direction even if the ink ribbon cartridge 2 is not yet attached to the printer device 1.

Figure 11:
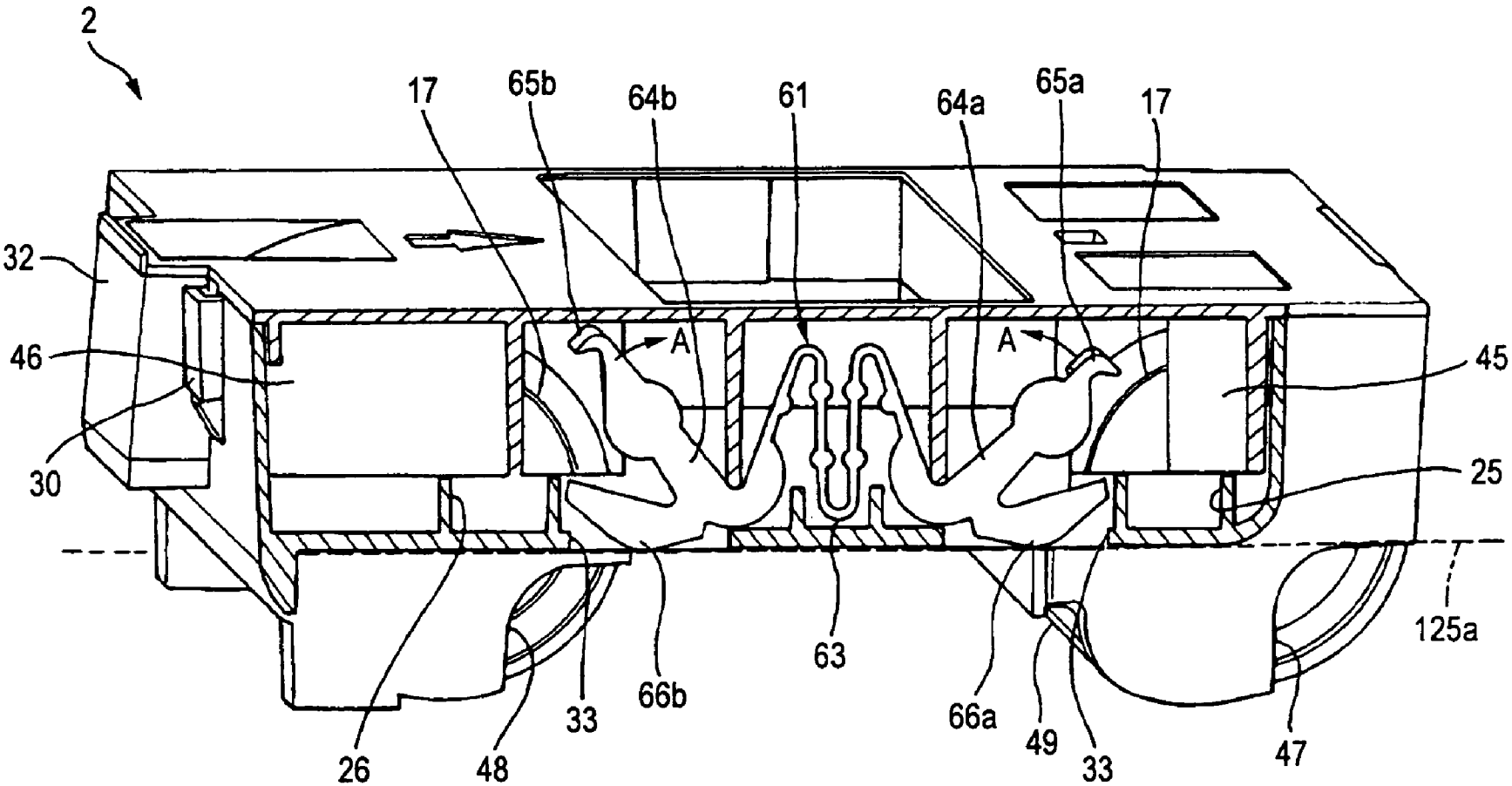
FIG. 11 is a diagram showing the ink ribbon cartridge in which the spool is free from rotation restrictions applied by the spool lock.

As shown in FIG. 11, when the cartridge body 13 is attached to the ink ribbon cartridge holder 7, in the spool lock 61, the to-be-pressed portions 66*a* and 66*b* being made to face outside from the lower surface of the guide sections 31 are pressed against the guide support section 125. This is because the lower surfaces of the guide sections 31 are moved to slide in contact with the guide support section 125. In response thereto, in the spool lock 61, the elastic engagement pieces 64*a* and 64*b* are deformed upward based on the elastic support section 63 so that the engagement is released between the latchet sections 65 and the latchet gears 17 and 17 of the spools 11 and 12. As such, when the ink ribbon cartridge 2 is attached to the printer device 1, the spool lock 61 allows the spools 11 and 12 to rotate and the ink ribbon 10 to run.

Figure 12:
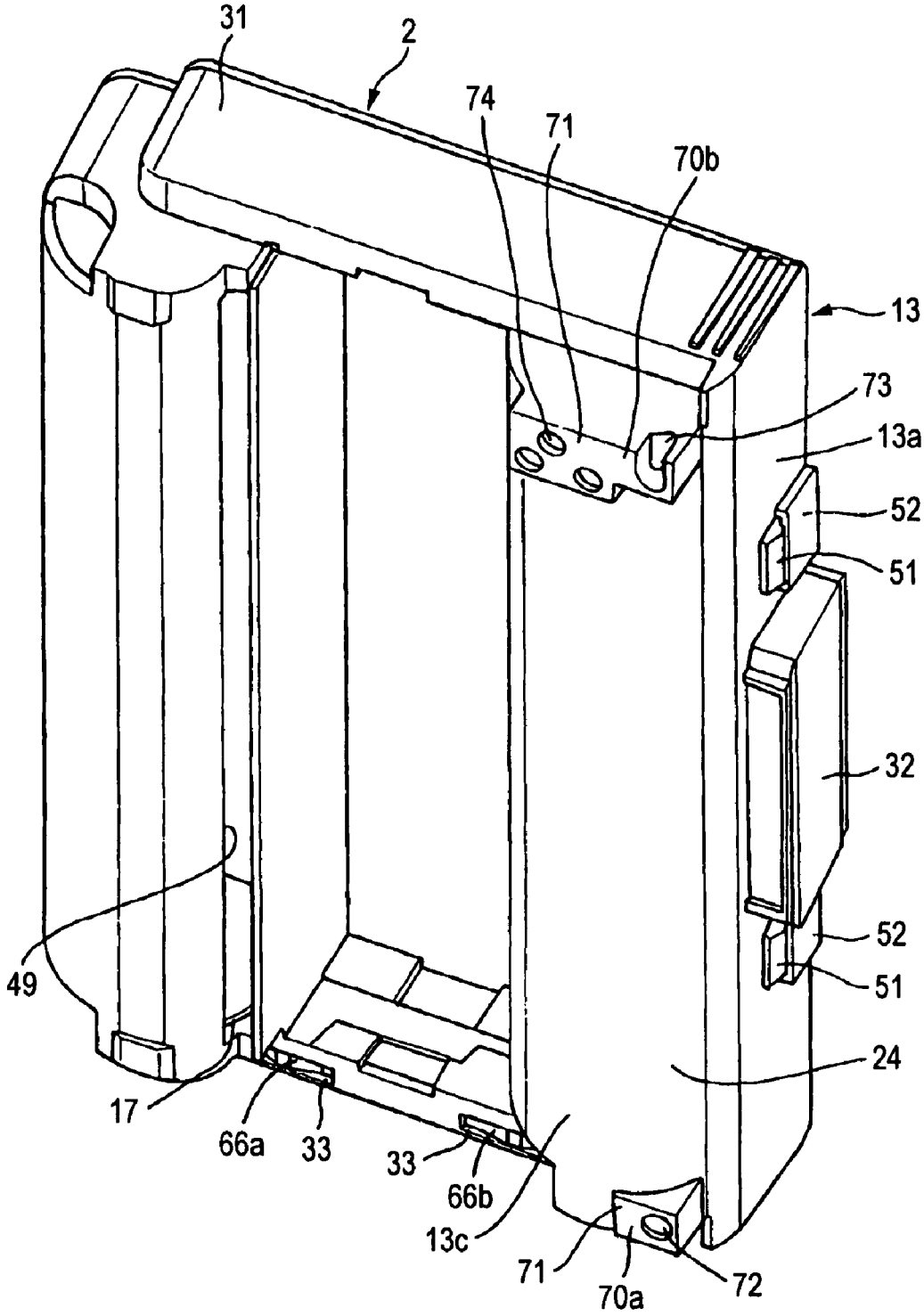
FIG. 12 is a perspective view of the ink ribbon cartridge viewed from the bottom.

Described next is a placement surface 70 for use as a reference for positioning of the ink ribbon cartridge 2 in the printer device 1. The placement surface 70 is disposed to the lower surface of the cartridge body 13. As shown in FIG. 12, the placement surface 70 is formed, on both ends, to the lower surface portion of the take-up spool housing section 24, which is provided on the side of the front surface portion 13*a* of the cartridge body 13. When the cartridge body 13 inserted into the ink ribbon cartridge holder 7 is moved into the device body 3 of the printer device 1, the placement surface 70 is supported by a cartridge support unit 160 disposed in the device body 3, thereby serving as a reference for positioning of the ink ribbon cartridge 2. By the placement surface 70 being supported by the cartridge support unit 160 as such, in the ink ribbon cartridge 2, the components, i.e., the ink ribbon 10, the printing paper 4, and the thermal head 140, are all located at positions ready for an image printing job.

More specifically, the placement surface 70 is provided with a first placement surface 70*a* and a second placement surface 70*b*. The first placement surface 70*a* is formed to the lower surface portion of one end side of the take-up spool housing section 24, and the second placement surface 70*b* is formed to the lower surface portion of the other end side thereof. These first and second placement surfaces 70*a* and 70*b* are formed with, respectively, the first and second positioning holes 72 and 73. The first and second positioning holes 72 and 73 are those punched in main surface sections 71, which are flat and substantially parallel to each other. These first and second positioning holes 72 and 73 are inserted with a pair of positioning convex sections 162 and 163, which are formed protruding from the cartridge support unit 160 of the device body 3 shown in FIG. 13.

The first positioning hole 72 is of substantially circular shape corresponding to the positioning convex section 162 being substantially conical in shape. The second positioning hole 73 is formed long in length, and one end thereof remains open up to the side wall of the take-up spool housing section 24. These first and second positioning holes 72 and 73 are inserted with the positioning convex sections 162 and 163 by the placement surface 70 being supported by the cartridge support unit 160. As to the first and second positioning holes 72 and 73, because the second positioning hole 73 is formed long in length, even if the second positioning hole 73 is not correctly abut with the second positioning convex section 163 with accuracy, such position displacement can be absorbed by the first positioning hole 72 being inserted with the first positioning convex section 162. As such, by using the first positioning hole 72 as a reference, the ink ribbon cartridge 2 can be positioned inside of the device body 3 without fail.

In the vicinity of the second positioning hole 73, an ID hole 74 is formed for type identification of the ink ribbon cartridge 2. The ID hole 74 is singly or plurally punched in, and are detected whether closed or open so that the ink ribbon cartridge 2 is defined by type.

The ink ribbon cartridge 2 varies in type, e.g., the length in the width direction of the ink ribbon 10 is of a so-called post card size (about the width of 100 mm), or of an L size (about the width of 89 mm). Such cartridge types are used as a basis to open or close the ID hole(s) 74.

To detect the state of the ID hole(s) 74 whether open or not using a detection switch 164 provided protruding from the cartridge support unit 160. This detection switch 164 is singly or plurally formed depending on where the ID hole(s) 74 are punched in. When the ID hole(s) 74 are closed, the detection switch(es) 164 are pressed by the closed portions of the ID hole(s) 74 (refer to FIG. 13). Based thereon, the printer device 1 determines the state of the detection switch(es) 164 whether pressed or not so that the ink ribbon cartridge 2 is defined by type. In an exemplary case where the printer device 1 prints a printing paper of a post card size, the state of the detection switch(es) 164 is detected, i.e., whether pressed or not, to see whether the attached ink ribbon cartridge 2 includes the ink ribbon 10 whose width is appropriate for printing of the post card size.

The ID hole(s) 74 are formed in the vicinity of the second positioning hole 73. This thus allows the ID hole(s) 74 of the ink ribbon cartridge 2 positioned in the device body 3 are to face the detection switch(es) 164 without fail so that the ink ribbon cartridge 2 can be defined by type.

Figure 14A:
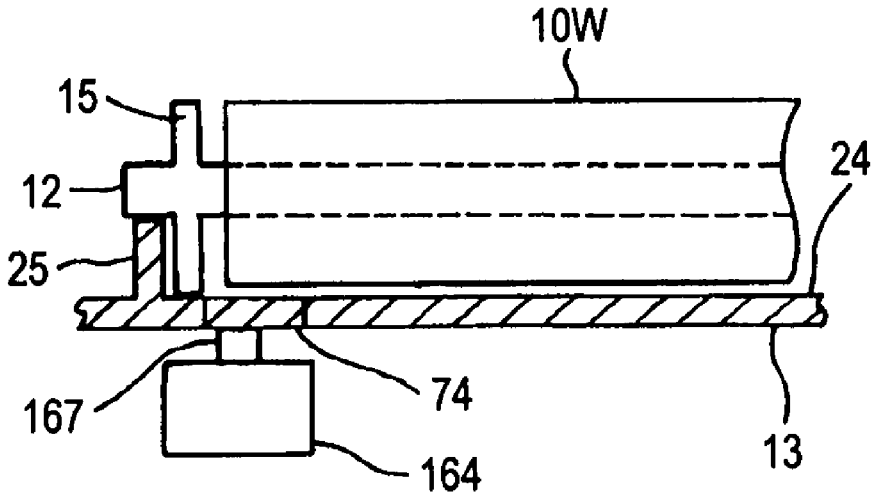
FIGS. 14A and 14B are both a diagram for illustrating the configuration for defining the ink ribbon cartridge by type.
Figure 14B:
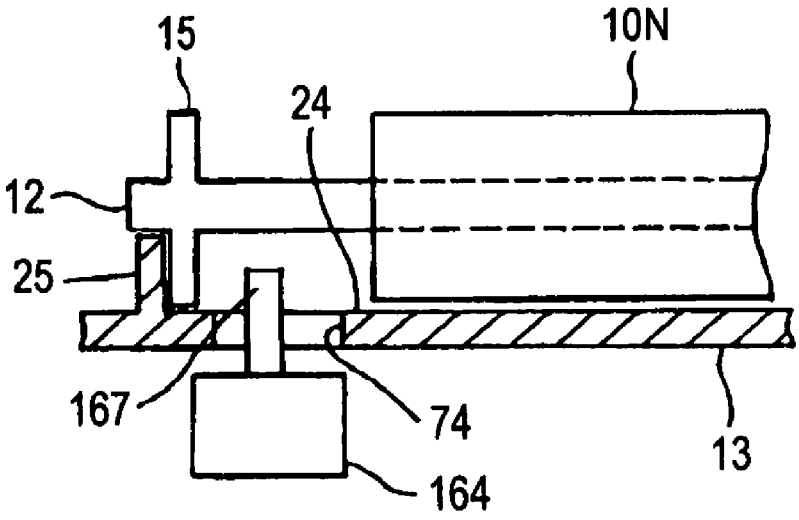

As shown in FIGS. 14A and 14B, such an ID hole(s) 74 are so disposed as to overlay the end portion of an area where an ink ribbon 10W is wound around the take-up spool 12, but not to overlay the end portion of an area where an ink ribbon 10N is wound around the take-up spool 12. Herein, the ink ribbon 10W is wide in width to suit the A6 size or the post card size, and the ink ribbon 10N is narrower in width compared with the ink ribbon 10W to suit the L size, for example. The ID hole(s) 74 are closed when the ink ribbon 10W is wound around the spool, and are opened when the ink ribbon 10N is wound therearound.

That is, as shown in FIG. 14A, when the wide ink ribbon 10W is wound around the spool, because the ID hole 74 is closed, the detection switch 164 inserted into the take-up spool housing section 24 never comes in contact with the ink ribbon 10W even if the ID hole 74 is formed at the position facing the end portion of the ink ribbon 10W. On the other hand, as shown in FIG. 14B, when the narrow ink ribbon 10N is wound around the spool, even if the ID hole 74 is open and the detection switch 164 is inserted, the inserted detection switch 164 never comes in contact with the ink ribbon 10N because the ID hole 74 is not formed at the position facing the ink ribbon 10N.

The ink ribbon cartridge 2 can be defined by type using the detection switch(es) 164 as such, i.e., the ID hole(s) 74 are disposed at positions facing the position of winding the wide ink ribbon 10W but not disposed at positions facing the position of winding the narrow ink ribbon 10N, and when the wide ink ribbon 10W is wound around the spool, the ID hole(s) 74 are closed, and when the narrow ink ribbon 10N is wound around the spool, the ID hole(s) 74 are opened. This favorably allows the ink ribbon cartridge 2 to be defined by type using the detection switch(es) 164, and the ID hole(s) 74 to be disposed at positions facing the position of winding the ink ribbon 10, thereby successfully contributing to the saving of space of the cartridge body 13, and the increase of design flexibility. What is better, in accordance with the space saving achieved for the cartridge body 13, the device body 3 can be reduced in size in the printer device 1 in which the detection switch(es) 164 are disposed at positions corresponding to the ID hole(s) 74.

As shown in FIG. 3, as to the ink ribbon cartridge 2 configured as such, the holding section 32 formed to the front surface portion 13*a* of the cartridge body 13 is held by a user, and is then inserted into the printer device 1 in the direction of a narrow X of FIG. 2 with the rear surface side of the cartridge body 13 as an insertion end. At this time, in the printer device 1, the ink ribbon cartridge holder 7 is moved to the cartridge insertion/removal position when the top plate 6 is rotated upward so that the ink ribbon cartridge 2 is ready for insertion and removal from the side of the front surface 3*a* of the device body 3. The ink ribbon cartridge 2 is then inserted while the guide sections 31 are being guided by the guide support section 125 of the ink ribbon cartridge holder 7. When the ink ribbon cartridge 2 is attached to the ink ribbon cartridge holder 7, the concave section 35 provided to the upper surface 13*b* of the cartridge body 13 for temporary positioning use is engaged with the convex section 131 provided to the ink ribbon cartridge holder 7 also for temporary positioning use. Through such engagement, the ink ribbon cartridge 2 is temporarily positioned in the ink ribbon cartridge holder 7.

At the same time, the guide support section 125 of the ink ribbon cartridge holder 7 presses the to-be-pressed portions 66*a* and 66*b* of the elastic engagement pieces 64*a* and 64*b* protruding from the aperture sections 33 of the lower shell 22. In response to such pressing, the elastic engagement pieces 64*a* and 64*b* whose ratchet portions 65*a* and 65*b* are being engaged with the latched gears 17 and 17 are elastically changed in shape toward the direction opposite to the arrow A of FIG. 10 based on the elastic support section 63. The engagement is thus released between the ratchet gears 17 and 17 and the latchet portions 65*a* and 65*b*. With such engagement release, the ink ribbon running mechanism 210 of the ink ribbon 10 provided to the printer device 1 puts the supply spool 11 and the take-up spool 12 in the state of being able to smoothly rotate.

After the ink ribbon cartridge 2 is inserted into the ink ribbon cartridge holder 7, after the top plate 6 of the printer device 1 is closed, and after the ink ribbon cartridge 2 is moved to the position where a printing job is executed to the printing paper 4 in the device body 3, the thermal head 140 attached to the top plate 6 is inserted into the aperture section 40 of the cartridge body 13. In response thereto, the ink ribbon 10 extended to the aperture section 40 becomes ready for printing to the printing paper 4 through abutment to the thermal head 140, and a ribbon path is formed for use as an ink ribbon running path.

When the ink ribbon cartridge 2 is moved to the printing position, the latchet gears 17 are engaged with the ink ribbon running gear 212 of the feeding mechanism 210. The latchet gears 17 are those formed to the flange sections 15 of the supply spool 11 and the take-up spool 12 to face outside from the gear-use aperture sections 47 and 48. The ink ribbon cartridge 2 is then positioned in the device body 3 of the cartridge body 13 by the first and second positioning holes 72 and 73 provided to the first and second placement surfaces 70*a* and 70*b* being inserted with a pair of positioning concave sections 162 and 163 protruding from the cartridge support unit 160. Here, the cartridge body 13 is already positioned to some degree by the concave section 35 being engaged with the convex section 131 provided to the ink ribbon cartridge holder 7 for temporary positioning use. This thus enables smooth engagement of the first and second positioning holes 72 and 73 with the pair of positioning convex sections 162 and 163 so that the positioning can be done with ease. The ink ribbon cartridge 2 is then defined by type when the ID hole(s) 74 are made to abut the detection switch(es) 164 protruding from the cartridge support unit 160, or are inserted therewith.

Thereafter, in the ink ribbon cartridge 2, the supply spool 11 and the take-up spool 12 are rotated by the ink ribbon running mechanism 210 of the printer device 1 so that the ink ribbon 10 is made to run. The thermal head 140 inserted from the aperture section 40 of the cartridge body 13 applies the thermal energy to the ink ribbon 10 extended up to the aperture section 40, thereby thermally transferring the coloring material to the printing paper 4 provided by the transfer mechanism 220, which will be described later. When the ink ribbon 10 is running, the elastic engagement pieces 64*a* and 64*b* make no sound during operation because the ratchet portions 65*a* and 65*b* are not engaged with the latchet gears 17 and 17.

When the ink ribbon cartridge 2 is not attached to the ink ribbon cartridge 7 as is not in use, e.g., in storage or during transportation, as shown in FIG. 10, the elastic engagement pieces 64*a* and 64*b* are biased in the direction opposite to the arrow A in FIG. 10, and the latchet portions 65*a* and 65*b* are engaged with the latchet gears 17 and 17.

In such a state, considered is a case where the supply spool 11 receives the rotation force by vibration or others in the direction of an arrow B of FIG. 10 along which the ink ribbon 10 is made to run. In this case, the force is applied in the direction along which the latchet portion 65*a* of the elastic engagement piece 64*a* digs in the latchet gear 17, thereby enabling to prevent the rotation in the direction B. This accordingly prevents any not-yet-used ink ribbon 10 from extending to the aperture section 40 when the ink ribbon cartridge 2 is not in use. If any rotation force is applied to rotate the supply spool 11 in the direction of an arrow C of FIG. 10, i.e., the direction of taking up the ink ribbon 10, the latchet portion 65*a* of the elastic engagement piece 64*a* comes above the latchet gear 17 so that the supply spool 11 is allowed to rotate in the direction of the arrow C of FIG. 10. As such, if the ink ribbon 10 is guided to the aperture section 40 and sags, thus sagged ink ribbon 10 can be taken up by rotating, in the direction of the arrow C of FIG. 10, the flange section 15 of the supply spool 11 being visible from the gear-use aperture section 47.

Also considered is a case where the take-up spool 12 receives the rotation force by vibration or others in the direction of an arrow D of FIG. 10, i.e., the direction of taking up the ink ribbon 10. In this case, the latchet portion 65*b* of the elastic engagement piece 64*b* comes above the latchet gear 17, and thus the take-up spool 12 rotates in the direction of the arrow D of FIG. 10, i.e., the direction of taking up the ink ribbon 10. On. the other hand, when the take-up spool 12 receives the rotation force in the direction of an arrow E of FIG. 10, the force is applied in the direction along which the latchet portion 65*b* of the elastic engagement piece 64*b* digs in the latchet gear 17, thereby enabling to prevent the rotation in the direction E. This accordingly prevents any used ink ribbon 10 from extending to the aperture section 40 when the ink ribbon cartridge 2 is not in use. If the used ink ribbon 10 is guided to the aperture section 40 and sags, thus sagged ink ribbon 10 can be taken up by rotating, in the direction of the arrow D of FIG. 10, the flange section 15 of the take-up spool 12 being visible from the gear-use aperture section 48.

That is, the spool lock 61 prohibits the supply spool 11 not to rotate in the direction of the arrow B of FIG. 10, i.e., the direction of feeding the ink ribbon 10 to the aperture section 40. The spool lock 61 also prohibits the take-up spool 12 not to rotate in the direction of the arrow E of FIG. 10, i.e., direction opposite to the winding direction of the ink ribbon 10. By prohibiting rotations as such, the spool lock 61 can prevent the ink ribbon 10 from sagging.

Figure 15:
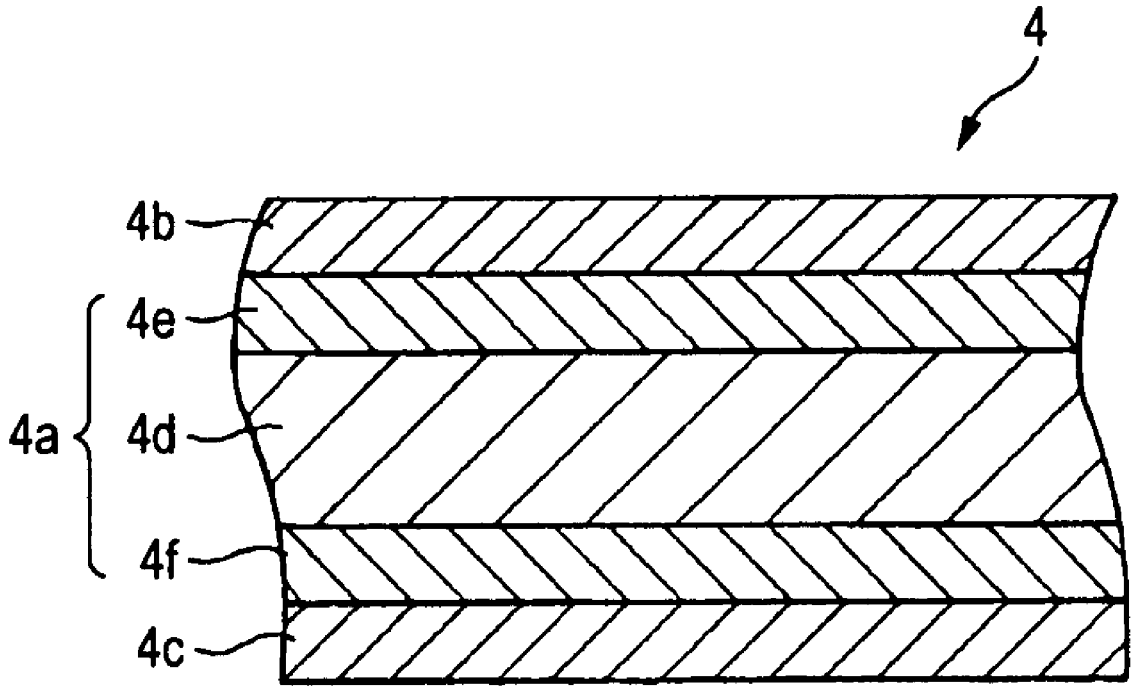
FIG. 15 is a cross sectional diagram showing the configuration of a printing paper.

By referring to FIG. 15, the printing paper 4 is described. The printing paper 4 is so configured that a base material 4*a* is formed with the reception layer 4*b* on one surface, and on the other surface, a back layer 4*c* is formed.

The base material 4*a* is configured by resin layers 4*e* and 4*f* formed, respectively, to upper and lower surfaces of a base paper 4*d* made from pulp or others. The resin layers 4*e* and 4*f* are made of thermoplastic resin such as polyethylene terephthalate or polypropylene, is of microvoid structure, and has the cushion effect. Therefore, especially, the resin layer 4*e* on the side of the reception layer 4*b* serves to tightly attach the base paper 4*d* and the reception layer 4*b* to a further extent, increase the thermal insulation, and improve the thermal tracking from the thermal head 140. The resin layers 4*e* and 4*f* both serve to get better contact with the thermal head 140. Moreover, as being made of thermoplastic resin, characteristically, the reception layer 4*b* and the resin layer 4*e* are thermally deformed by the thermal energy coming from the thermal head 140, and are crushed with the pressure of a predetermined level applied by the thermal head 140 and thus lose the cushion effect.

The reception layer 4*b* has the thickness of about 1 to 10 μm. The reception layer 4*b* receives the coloring material to be transferred from the ink ribbon 10, and keeps thus received coloring material. The reception layer 4*b* is made of a resin such as acrylic resin, polyester, polycarbonate, or polyvinyl chloride. The back layer 4*c* reduces the friction between a capstan roller 225 and the platen roller 155 for the aim of achieving the stable running of the printing paper 4. Note here that the printing paper 4 is not specifically restrictive in configuration as long as it includes the reception layer 4*b* and the resin layer 4*e*.

Figure 16:
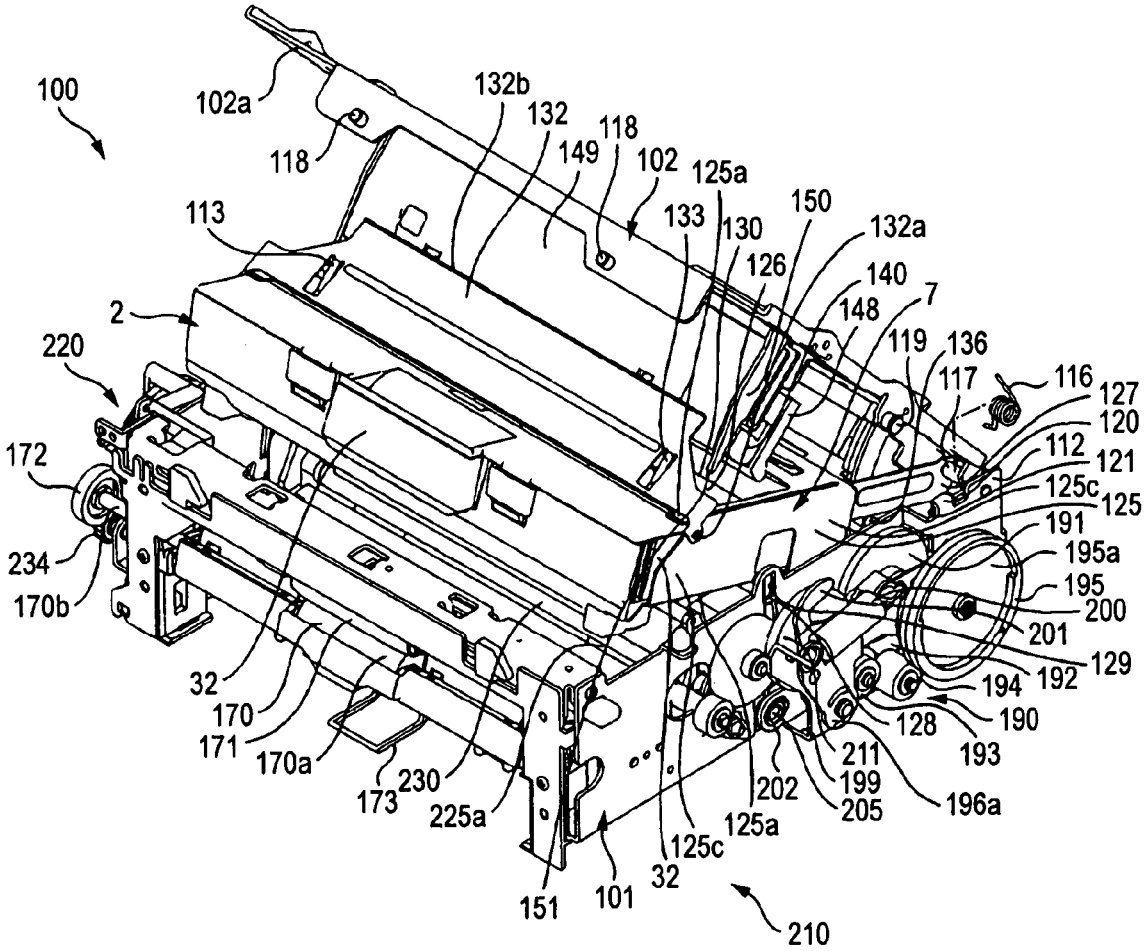
FIG. 16 is a perspective view of a main chassis with a top chassis rotated upward.
Figure 17:
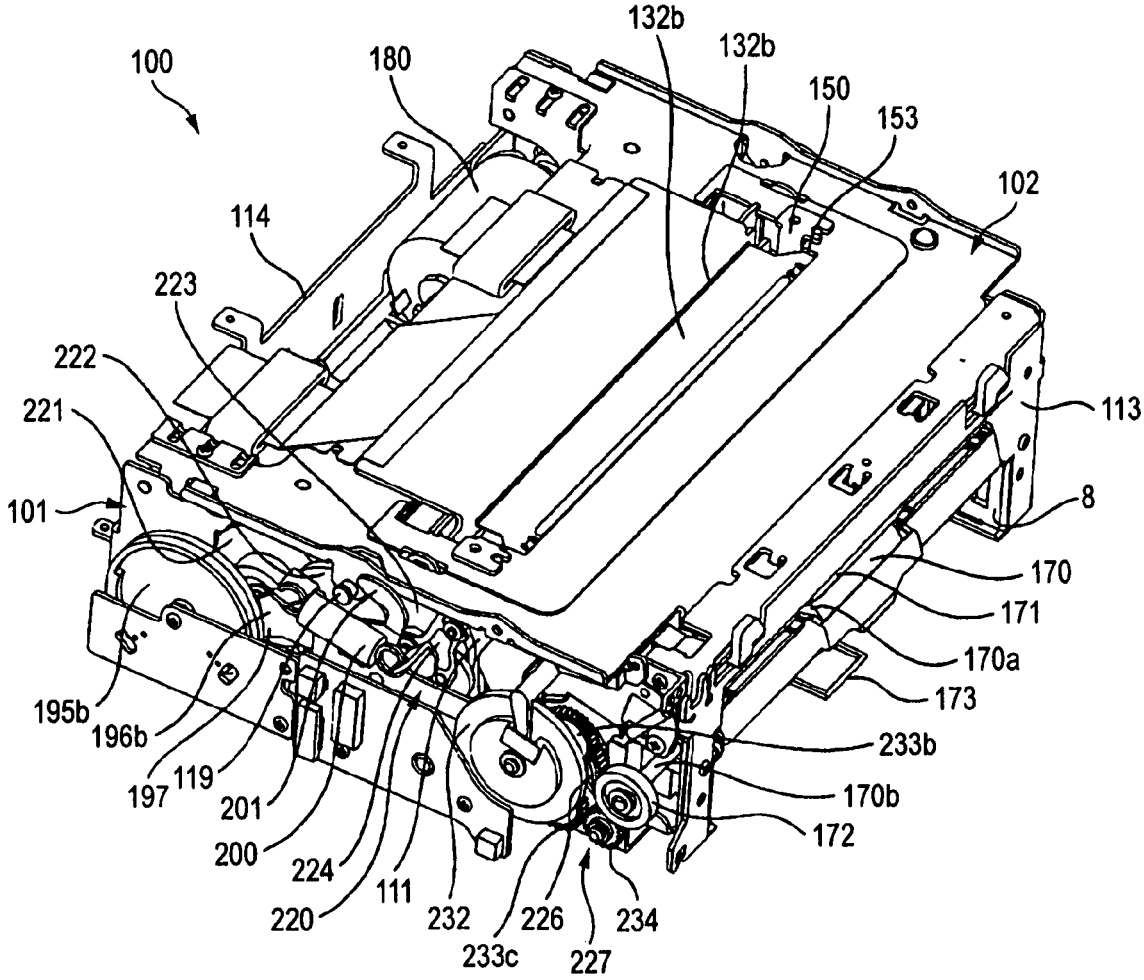
FIG. 17 is a perspective view of the main chassis with the top chassis closed.

Described next is the printer device 1 to be attached with the ink ribbon cartridge 2, and prints images to the printing paper 4. As shown in FIGS. 1 and 2, the printer device 1 is provided with the device body 3 being substantially a rectangular box, and the top plate 6 configuring the upper surface 3*b* of the device body 3 to be able to freely rotate in the vertical direction. The device body 3 includes therein a main chassis 100. As shown in FIGS. 16 and 17, the main chassis 100 is provided with a base chassis 101 and the top chassis 102. The top chassis 102 is connected to the top plate 6, and is attached to the base chassis 101 to be able to rotate in the vertical direction.

As shown in FIG. 1, in the device body 3, the top plate 6 configuring the upper surface 3*b* is provided with an operation panel 104 for use of the printer device 1, and an LCD panel 105 for display of images for printing or others. The top plate 6 is attached with the top chassis 102 that will be described later, and is configured to be able to rotate in the vertical direction together with the ink ribbon cartridge 7 connected with the top chassis 102.

The device body 3 is provided with, on the front surface 3*a*, the aperture section 8, a slot 106 for use of recording media, and an open button 107. The aperture section 8 is attached with the printing paper tray 5 carrying thereon the printing paper 4. The slot 106 is attached with various types of recording media, and the open button 107 is used to rotate upward the top plate 6. The aperture section 8 is so configured as to be freely opened or closed by a shutter 108, and when the shutter 108 is opened, the printing paper tray 5 is attached thereto.

The printer device 1 is made ready for a printing operation in the following manner. That is, the printer paper tray is attached from the aperture section 8, and the open button 107 is operated so that the top plate 6 is rotated upward. In response thereto, the ink ribbon cartridge 2 is attached to the ink ribbon cartridge holder 7 being made to face the side of the front surface 3*a*, and the top plate 6 is put back to the side of the device body 3. The printer device 1 is capable of various types of operations, e.g., selection of images for printing, setting of paper size, setting of the number of copies, or starting and stopping of a printing job. Such operations are executed through operation of the operation panel 104 with images displayed on the LCD panel 105, i.e., images recorded on a recording medium, or images recorded on various types of recording devices, e.g., memory device or digital still camera, connected via USB or others.

Described next is the main chassis 100 disposed inside of the device body 3 of such a printer device 1. As shown in FIGS. 16 and 17, the main chassis 100 is provided with the base chassis 101 and the top chassis 102. The base chassis 101 is disposed thereon with the ink ribbon cartridge 2 through transfer of the ink ribbon cartridge holder 7, and is provided with the running mechanism 210 for the ink ribbon 10 and the transfer mechanism 220 for the printing paper 4. The top chassis 102 is provided with the ink ribbon cartridge holder 7 and the thermal head 140, and is connected with the top plate 6 and attached to the base chassis 101 to be able to rotate in the vertical direction.

Figure 18:
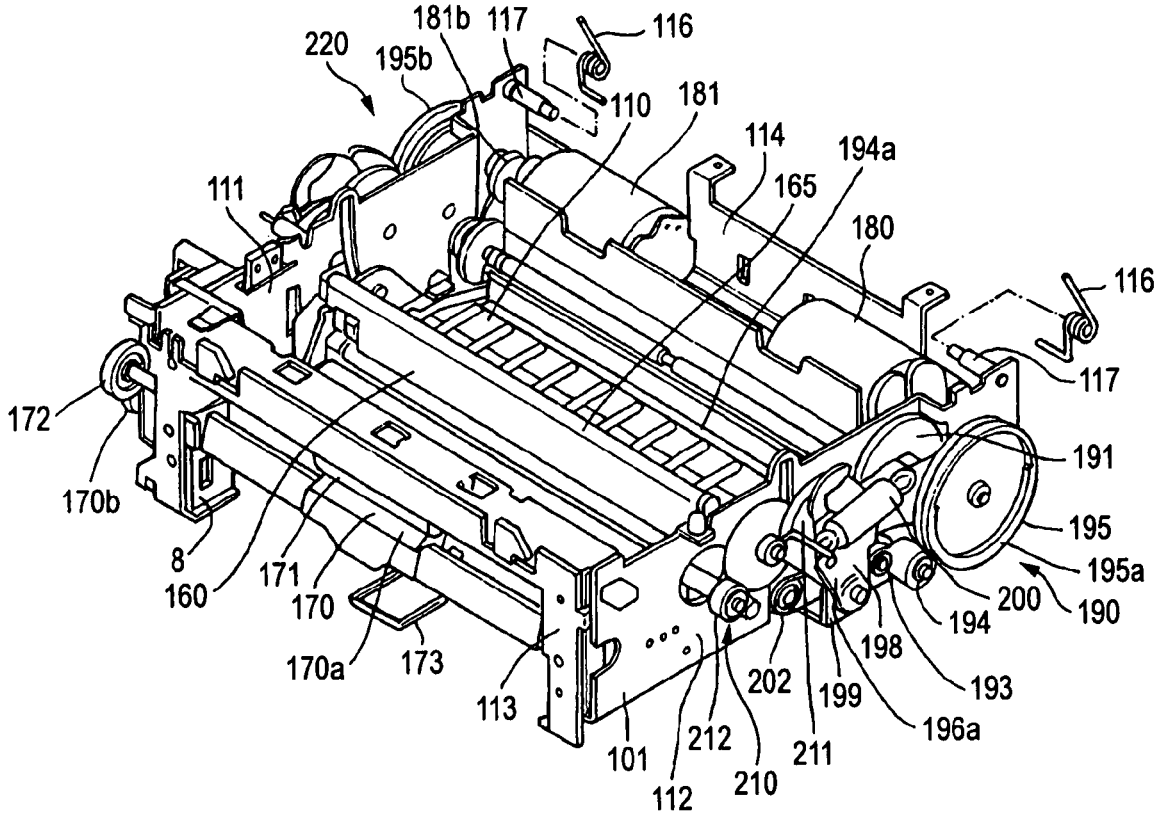
FIG. 18 is a perspective view of a base chassis.
Figure 19:
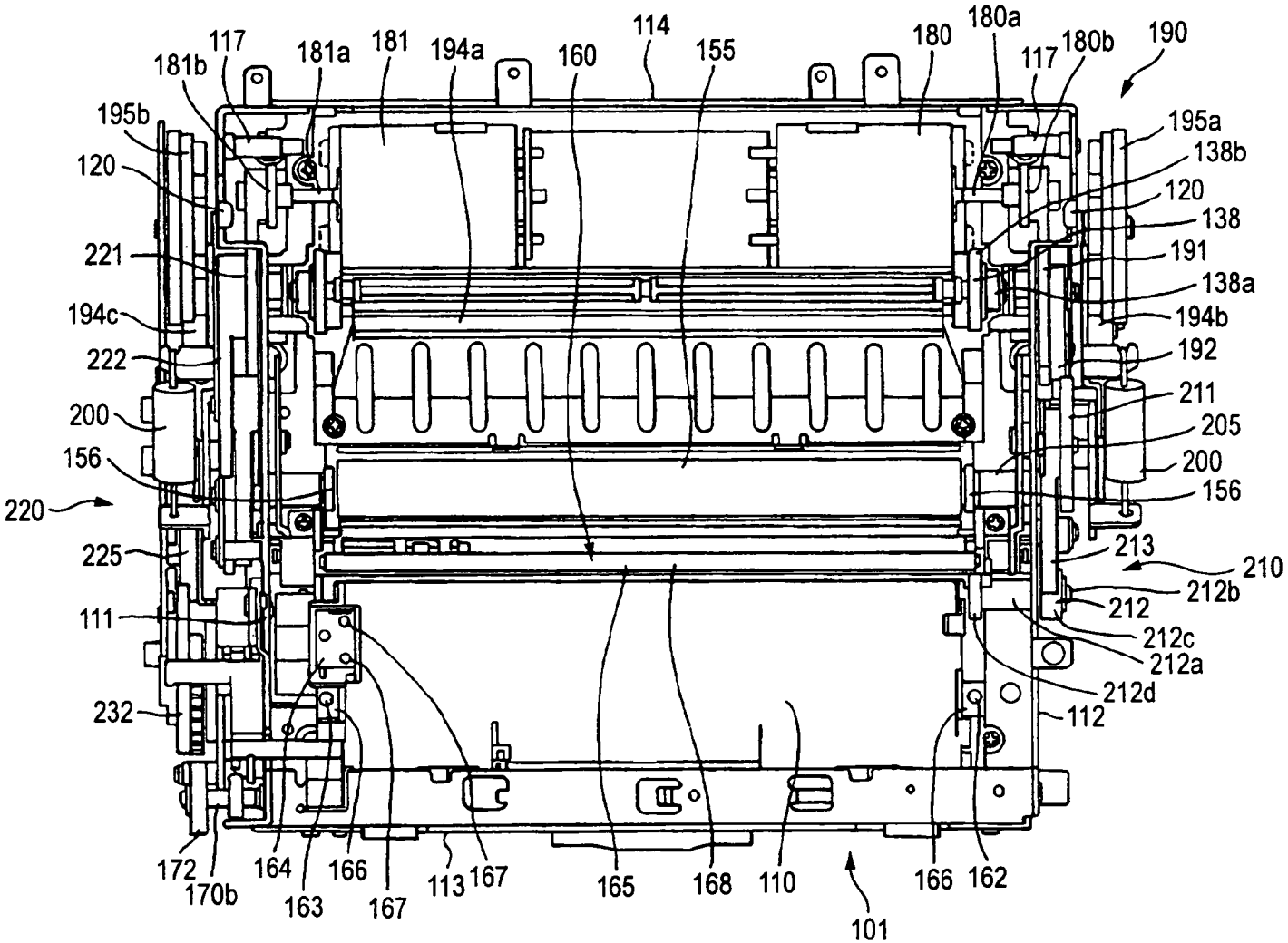
FIG. 19 is a plan view of the base chassis.

As shown in FIGS. 18 and 19, the base chassis 101 is configured by a main surface 110, right and left side walls 111 and 112, a front surface wall 113, and a rear surface wall 114. The base chassis 101 is formed substantially like a box with the upper surface side opened. This base chassis 101 is attached with the printing paper tray 5 on the side of the front surface wall 113, and the ink ribbon cartridge holder 7 comes from the upper surface side with the ink ribbon cartridge 2 attached thereto. The base chassis 101 is formed with the transfer mechanism 220, the ink ribbon running mechanism 210, a switch mechanism 190, and the cartridge support unit 160. Specifically, the transfer mechanism 220 serves to transfer the printing paper 4 from the side of the front surface 3*a* of the device body 3 to the side of the rear surface 3*c* thereof. The ink ribbon running mechanism 210 serves to run the ink ribbon 10 by rotating the take-up spool 12 housed in the ink ribbon cartridge 2. The switch mechanism 190 serves to change the relative position between the platen roller 155 and the thermal head 140. The platen roller 155 is the one provided to the main surface 110 to be able to freely move in the vertical direction, and the thermal head 140 is the one attached to the top chassis 102. The cartridge support unit 160 is disposed on the main surface 110, and enters the aperture section 40 of the ink ribbon cartridge 2 so that the running path is formed for the ink ribbon 10.

The top chassis 102 is formed substantially like a plate, and is provided with the thermal head 140 and the ink ribbon cartridge holder 7 on the side of an under surface 102*a* facing inside of the base chassis 101. The top chassis 102 is supported, at both end portions on the rear surface side, by the right and left side walls 111 and 112 of the base chassis 101 to be able to freely rotate. The top chassis 102 is always biased to rotate upward, i.e., in the direction that the ink ribbon cartridge holder 7 is faced to the side of the front surface 3*a* of the device body 3 by one end of a twisted coil spring 116 being latched (refer to FIG. 16). The other end of the twisted coil spring 116 is being latched to the rear surface wall 114 of the base chassis 101. When the open button 107 is operated, the top chassis 102 receives the biasing force of the twisted coil spring 116, and is rotated upward of the device body 3 together with the top plate 6. The ink ribbon cartridge holder 7 is supported also by the right and left side walls 111 and 112 of the base chassis to be able to freely rotate, and is latched by the coupling member 135 protruding from the under surface 102*a* of the top chassis 102. Through such supporting and latching, the ink ribbon cartridge holder 7 is rotated upward in synchronous with the rotation of the top chassis 102, and then is faced outside from the front surface of the device body 3.

That is, in the printer device 1, three members, i.e., the top plate 6, the top chassis 102, and the ink ribbon cartridge holder 7 connected to the top chassis 102, are disposed to be able to rotate upward with respect to the device body 3 or the base chassis 101. The biasing force of the twisted coil spring 116 is received via the top chassis 102, and bias application is made for upward rotation. Also in the printer device 1, by the top chassis 102 being latched by the base chassis 101, the components, i.e., the top chassis 102, the top plate 6, and the ink ribbon cartridge holder 7, are rotated downward for retention in the direction of closing the base chassis 101.

When rotated upward of the device body 3, the ink ribbon cartridge holder 7 is moved to the insertion/removal position where the ink ribbon cartridge 2 is inserted and removed thereto/therefrom. After moved as such, the ink ribbon cartridge holder 7 is rotated inside of the device body so that the ink ribbon cartridge 2 is moved to the printing position where the ink ribbon 10 and the thermal head 140 are facing to each other.

To be specific, as shown in FIGS. 18 and 19, the base chassis 101 is inserted with the twisted coil spring 116 on the rear surface side of the right and left side walls 111 112. From the base chassis 101, support protrusion sections 117 and 117 are protruded for supporting the top chassis 102 and the ink ribbon cartridge holder 7 to be able to freely rotate.

The top chassis 102 to be supported by the support protrusion sections 117 is formed substantially like a rectangular plate, and as shown in FIGS. 16 and 17, is formed with the thermal head 140 that is protruding toward the side of the base chassis 101. The top chassis 102 is also formed with, on the front side surface, a first latching protrusion section 118 to be latched to the base chassis 101 as opposing the biasing force of the twisted coil spring 116. The top chassis 102 is also formed with, on the right and left side surfaces, a second latching protrusion section 119 to be latched to a latching piece 201 of the switch mechanism 190 that will be described later.

The top chassis 102 is formed with latching pieces 121 and 121 on the right and left side surfaces. The latching pieces 121 are to be latched to rotation control pieces 120 and 120, which are provided in the vicinity of the support protrusion sections 117 and 117 formed to the right and left side walls 111 and 112 of the base chassis 101. When these latching pieces 121 and 121 are latched to the rotation control pieces 120 and 120, the top chassis 102 is put under the control in terms of a rotation are a with respect to the base chassis 101. In response to such control application over the rotation area of the top chassis 102, the top plate 6 and the ink ribbon cartridge holder 7 to be rotated together with the top chassis 102 are also put under the control in terms of a rotation area.

To be specific, as shown in FIG. 2, the rotation area of the top chassis 102 is so controlled as to open at an acute angle with respect to the base chassis 101. With such control application, the top plate 6 and the ink ribbon cartridge holder 7 to be rotated together with the top chassis 102 are also opened at an acute angle with respect to the base chassis 101. At this time, the ink ribbon cartridge holder 7 is moved to the insertion/removal position of the ink ribbon cartridge 2, which is to be faced outside from the side of the front surface 3*a* of the device body 3 of the printer device 1. As such, the ink ribbon cartridge holder 7 moved to the insertion/removal position is opened at an acute angle with respect to the device body 3, and is made to face outside from the side of the front surface 3*a*, thereby easing insertion and removal of the ink ribbon cartridge 2. Note that when the top chassis 102 is rotated to the position of closing the base chassis 101, the ink ribbon cartridge holder 7 moves the attached ink ribbon cartridge 2 to the printing position where the ink ribbon 10 faces the thermal head 140 and the printing paper 4.

The ink ribbon cartridge holder 7 to be engaged with the top chassis 102 is formed by bending a sheet metal, and includes a pair of guide support sections 125 and 125, a coupling section 126, and support piece sections 127 and 127. The guide support sections 125 are provided to support the guide sections 31 formed on both side surfaces of the ink ribbon cartridge 2, and the coupling section 126 is disposed across the guide support sections 125 and 125. The support piece sections 127 and 127 are extended from the guide support sections 125 and 125 toward the rear surface side, and are supported by the base chassis 101 to be able to freely rotate.

The guide support sections 125 are provided to guide the insertion and removal of the ink ribbon cartridge 2 by supporting the guide sections 31 bulging from both side surfaces of the ink ribbon cartridge 2, and keep the cartridge body 13 inside of the ink ribbon cartridge holder 7. Such guide support sections 125 are each formed to have the cross section looking like substantially a laterally-inverted-letter-U, and guides the ink ribbon cartridge 2 to enter into the ink ribbon cartridge holder 7 while supporting the guide sections 31, i.e., the lower surfaces, the side surfaces, and the upper surfaces. The lower surfaces of the guide support section 125 are each a reception section 125*a* for receiving the lower surface of the guide section 31. The reception section 125*a* is so configured as to easily accept the corresponding guide section 31, i.e., the end portion on the front surface side of the device body 3 is disposed more frontward than an upper surface 125*b* and is bent downward. As to the guide support section 125, the end portion on the rear surface side of a side surface 125*c* is bent up to the area where the guide section 31 enters, and thereto, the guide sections 31 of the ink ribbon cartridge 2 abut after entering as far as it can go in the ink ribbon cartridge holder 7.

As to such a guide support section 125, a space between the reception sections 125*a* and 125*a* provided to a pair of guide support sections 125 and 125, i.e., a distance between the side surfaces 125*c* and 125*c*, is provided to be substantially the same or slightly longer than a distance between the guide sections 31 and 31 of the cartridge body 13. This is because if the distance between the reception sections 125*a* and 125*a* is shorter than the distance between the guide sections 31 and 31, the cartridge body 13 cannot enter thereinto. When the distance between the reception sections 125*a* and 125*a* is longer than the distance between the guide sections 31 and 31, the cartridge body 13 resultantly rattles in the ink ribbon cartridge holder 7. The width of the reception section 125*a* is set to be substantially the same or slightly longer than the width of the guide section 31. This is because if the width of the reception section 125*a* is longer than the width of the guide section 31, it means that the space is too large between the guide section 31 and the side surface 125*c* of the guide support section 125. If the width of the reception section 125*a* is much shorter than the width of the guide section 31, the cartridge body 13 cannot be securely held, and a to-be-pressed section 66 protruding from the lower surface of the guide section 31 cannot be pressed.

When the guide support section 125 supports the ink ribbon cartridge 2, the reception section 125*a* presses the to-be-pressed section 66 of the spool lock 61, which is protruding from the aperture section 33 formed to the lower surface of the guide section 31 (refer to FIG. 11). As such, in the ink ribbon cartridge 2 attached to the ink ribbon cartridge holder 7, the supply spool 11 and the take-up spool 12 are allowed to rotate.

The guide support section 125 is provided with, on the side surface 125*c*, a latching protrusion section 128. The latching protrusion section 128 puts the ink ribbon cartridge holder 7 under the control in terms of a rotation area by being latched to the right and left side walls 111 and 112 of the base chassis 101. The latching protrusion section 128 is being engaged with a long hole 129 to be able to freely move. The long hole 129 is formed to the right and left side walls 111 and 112 of the base chassis 101 to open in the vertical direction. When the ink ribbon cartridge holder 7 is rotated upward with respect to the base chassis 101 together with the top chassis 102, the latching protrusion section 128 is latched at the upper end of the long hole 129. With such latching, the ink ribbon cartridge holder 7 is controlled not to rotate at the position after rotated at an acute angle with respect to the base chassis 101, and is stopped at the insertion/removal position facing outside from the front surface 3*a* of the device body 3.

The coupling section 126 disposed across a pair of the guide support sections 125 and 125 configures the upper surface of the ink ribbon cartridge holder 7. At the center portion of the coupling section 126, a head-use aperture section 130 is provided for insertion of the thermal head 140 provided to the top chassis 102. The coupling section 126 is formed with the convex section 131 for temporary positioning use. The convex section 131 is formed closer to the rear surface side of the device body 3 than the head-use aperture section 130, and is engaged with the concave section 35 provided to the upper surface 13*b* of the cartridge body 13 also for temporary positioning use (refer to FIGS. 24, 37, and others).

The convex section 131 is engaged with the concave section 35 so as to position the ink ribbon cartridge 2 in the ink ribbon cartridge holder 7. When the cartridge body 13 is entered to the position where the guide sections 31 abut the bent portions of the side surfaces 125*c* of the guide support sections 125 while being guided by the guide support sections 125 and 125, the convex section 131 is engaged with the concave section 35. With such engagement, when the ink ribbon cartridge 2 is moved into the device body 3, insertion of the first and second positioning convex sections 162 and 163 is eased to the first and second positioning holes 72 and 73 provided to the lower surface portion 13*c* of the cartridge body 13. The first and second positioning convex sections 162 and 163 are those used to position the ink ribbon cartridge 2 in the device body 3. Note here that the same effects can be achieved if the ink ribbon cartridge 2 is formed with a convex section for temporary positioning use, and the coupling section 126 of the ink ribbon cartridge holder 7 is formed with a concave section also for temporary positioning use.

As shown in FIG. 16, the coupling section 126 is provided with a protection plate 132 closer to the side of the front surface 3*a* of the device body 3 than the head-use aperture section 130. The protection plate 132 is provided to cover the thermal head 140, which is protruding from the top chassis 102. The protection plate 132 serves to protect users from injuries, e.g., erroneous touching to the thermal head 140, prevent the thermal head 140 from getting dirty, or others. This is because the top chassis 102 and the ink ribbon cartridge holder 7 are made to face outside from the side of the front surface 3*a* when rotated upward of the device body 3, and when the top plate 6 is open, the thermal head 140 sagging from the top chassis 102 to the side of the ink ribbon cartridge holder 7 is thus exposed.

This protection plate 132 is formed like a rectangular plate, and is supported, on both end portions in the longitudinal direction, by the side surfaces 125*c* and 125*c* of the guide support section 125. With such supporting, on the coupling section 126, a side surface portion 132*b* on the rear surface side is allowed to rotate in the vertical direction based on a support portion 132*a* of the side surfaces 125*c* and 125*c*. The protection plate 132 forms, by pressing the coupling section 126, a press piece 133 for rotation in the vertical direction. The press piece 133 is made flexible by notching long the main surface of the protection plate 132 in the short-side direction, and bending the portion downward. With such flexibility, the press piece 133 always presses the protection plate 132 upward against the coupling section 126.

Figure 20:
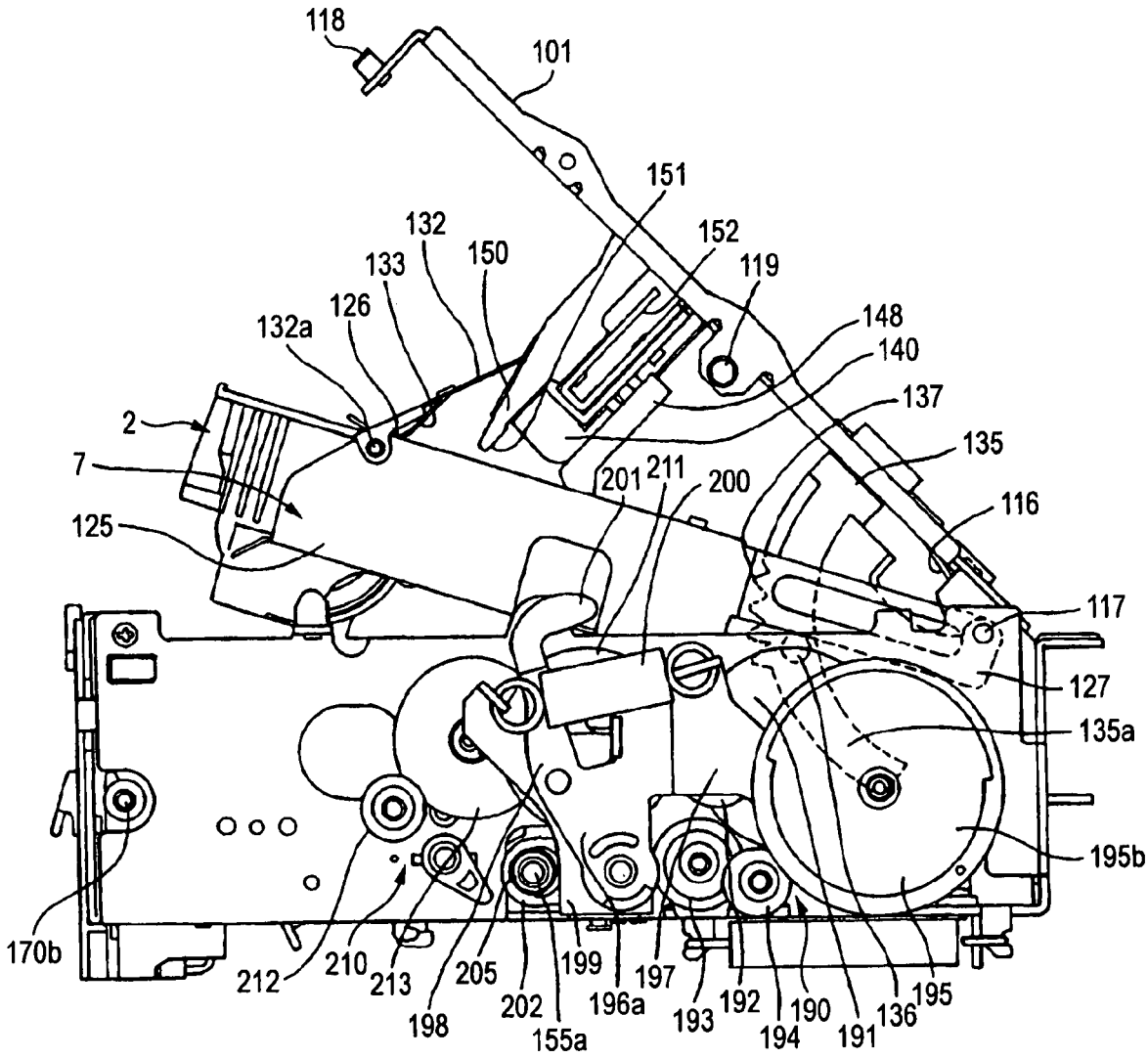
FIG. 20 is a side view of the main chassis with the top chassis rotated upward.

As shown in FIGS. 2 and 20, when the top chassis 102 is rotated upward, the press piece 133 presses the coupling section 126, and the side surface portion 132*b* on the rear surface side slides in contact with the thermal head 140 moving upward so that the protection plate 132 is rotated upward. This enables the protection plate 132 to shield the thermal head 140 from the front surface 3*a*, and make it not visible from the users. As such, the printer device 1 favorably prevents users' injuries, accidents, and others, e.g., prevents users from accidentally touching the thermal head 140 when the top chassis 102 is open.

As shown in FIG. 17, when the top chassis 102 closes the base chassis 101, the protection plate 132 is made to slide in contact with the side edge of an aperture section 153, which is formed to the top chassis 102 for attachment of the thermal head 140. While opposing the pressing force of the press piece 133, the protection plate 132 is rotated toward the side of the coupling section 126. At this time, the top chassis 102 abuts the main surface of the protection plate 132 as opposing the pressing force of the press piece 133 so that the ink ribbon cartridge holder 7 is biased in the opposite direction, i.e., to the side of the main surface 110 of the base chassis 101.

The support piece sections 127 and 127 are each formed with a support hole (not shown), and are latched, at the lower side surface, by the coupling member 135, which is coupled to the top chassis 102. Herein, the support piece sections 127 and 127 are those extended from the guide support sections 125 and 125 toward the rear surface side, and are supported by the base chassis 101 to be able to freely rotate. The support hole is supported by, to be able to freely rotate, the support protrusion sections 117 and 117, which are those protruding at the end portion on the rear surface side from the right and left side walls 111 and 112 of the base chassis 101.

As shown in FIG. 20, the coupling member 135 for use to couple together the top chassis 102 and the ink ribbon cartridge holder 7 is a resin member being curved like an arc in its entirety. One side of the coupling member 135 is connected to the top chassis 102, and is provided with an arm portion 135*a* that is curved toward the rear surface side of the device body 3. From the arm portion 135*a*, a rotation protrusion section 136 is protruding to latch the support piece sections 127 of the ink ribbon cartridge holder 7 for upward rotation. The rotation protrusion section 136 is protruding from the side surface of the arm portion 135*a*, and when the top chassis 102 is rotated upward, is made to abut, from below, the support piece sections 127 of the ink ribbon cartridge holder 7. As such, the coupling member 135 couples the ink ribbon cartridge holder 7 to the top chassis 102, and rotates upward the ink ribbon cartridge holder 7 as the top chassis 102 rotates.

As described in the foregoing, the top chassis 102 is put under the rotation control by the latching piece 121 being latched to the rotation control piece 120 formed to the base chassis 101. The ink ribbon cartridge holder 7 is also put under the rotation control by the latching protrusion section 128 provided to the side surface 125*c* of the guide support section 125 being latched by the long hole 129 provided to the right and left sidewalls 111 and 112 of the base chassis 101. Through such latching, the ink ribbon cartridge holder 7 is stopped at the insertion/removal position of the ink ribbon cartridge 2. As to the top chassis 102 and the ink ribbon cartridge holder 7, the top chassis 102 has the larger amount of rotation. After the top chassis 102 is rotated upward to some degree from the position where the base chassis 101 is closed thereby, the rotation protrusion section 136 of the coupling member 135 latches to the support piece section 127, and the ink ribbon cartridge holder 7 is rotated.

That is, the top chassis 102 is rotated by a predetermined amount when the engagement with the base chassis 101 is released. During such rotation, the rotation protrusion section 136 of the coupling member 135 is latched to the lower surface of the support piece section 127, and is coupled with the ink ribbon cartridge holder 7. As such, because the top chassis 102 rotates prior to the ink ribbon cartridge holder 7, when the top chassis is rotated and reaches the rotation-allowed area, as shown in FIG. 20, the ink ribbon cartridge holder 7 comes between the top chassis 102 and the base chassis 101.

When the top chassis 102 is rotated from above toward the side of the base chassis 101, the ink ribbon cartridge holder 7 follows and rotates together downward. When the ink ribbon cartridge holder 7 is rotated and reaches the printing position in the device body 3, only the top chassis 102 is rotated downward until the base chassis 101 is closed.

The arm portion 135*a* of the coupling member 135 is formed with a gear section 137. The gear section 137 is engaged with the latchet gear 17 of the supply spool 11, and serves to eliminate the sag of the ink ribbon 10 when the ink ribbon cartridge 2 is taken out. The latchet gear 17 is of the supply spool 11 being visible from the gear-use aperture section 47 of the ink ribbon cartridge 2 attached in the ribbon cartridge holder 7 via a take-up gear 138 provided inside of the base chassis 101. Such sag elimination is achieved by rotating the supply spool 11 in the direction of an arrow C of FIG. 21, i.e., the direction of rewinding the ink ribbon 10 when the top chassis 102 is rotated upward.

That is, as described above, when the ink ribbon cartridge 2 is rotated to reach the insertion/removal position from the printing position, the ink ribbon cartridge holder 7 is first rotated upward to some degree, and then the rotation protrusion section 136 is latched to the support piece section 127. At this time, the gear section 137 formed to the arm portion 135*a* of the coupling member 135 is engaged with the latchet gear 17 of the supply spool 11 being visible from the gear-use aperture section 47 of the ink ribbon cartridge 2 via the take-up gear 138. After engagement as such, the supply spool 11 is rotated in the direction of rewinding the ink ribbon 10.

Figure 21:
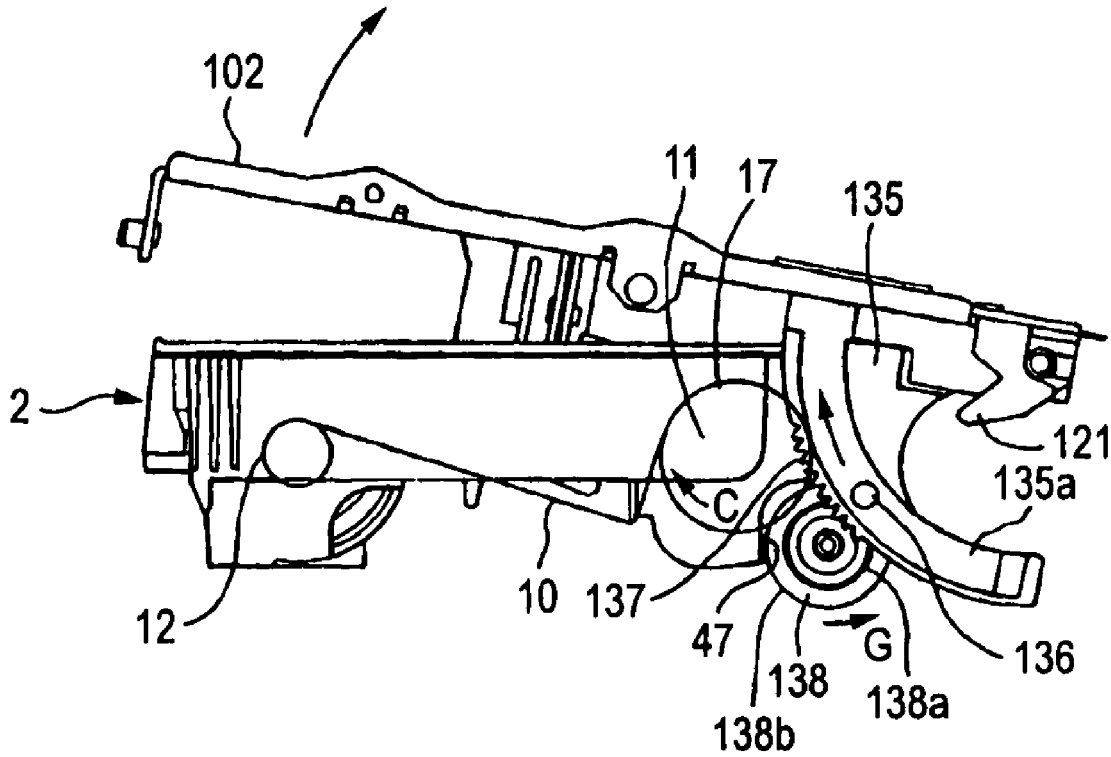
FIG. 21 is a diagram for illustrating the configuration for taking up the ink ribbon when the top chassis is rotated.
Figure 22:
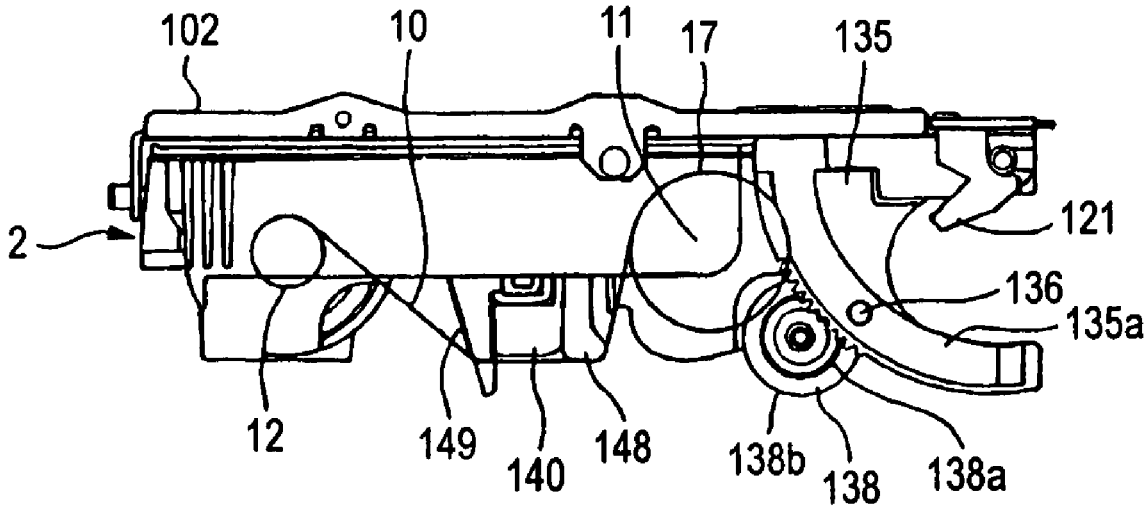
FIG. 22 is another diagram for illustrating the configuration for taking up the ink ribbon when the top chassis is rotated.

To be specific, when the gear section 137 is rotated upward, a small-diameter gear 138*a* of the take-up gear 138 in the base chassis 101 is engaged with the gear section 137, and is rotated in the direction of an arrow G of FIG. 22. In response, a large-diameter gear 138*b* that is supposed to be rotated together with the small-diameter gear 138*a* is rotated in the same direction, and the latchet gear 17 being engaged with the large-diameter gear 138*b* is rotated in the direction of an arrow C of FIG. 21, i.e., the direction of rewinding the ink ribbon 10. At this time, as the top chassis 102 is rotated upward, the components, i.e., the thermal head 140, a head cover 148, and a cover member 149, are moved away from the aperture section 40. The thermal head 140 here is entering the aperture section 40 of the ink ribbon cartridge 2, and forming a ribbon path by pulling out the ink ribbon 10.

As such, to attach and eject the ink ribbon cartridge 2 to/from the ink ribbon cartridge holder 7, opening the top chassis 102 takes up the ink ribbon 10 as shown in FIG. 21 that has been pulled outside as shown in FIG. 22 so that the ink ribbon cartridge 2 can be ejected from the ink ribbon cartridge holder 7 immediately.

Figure 23:
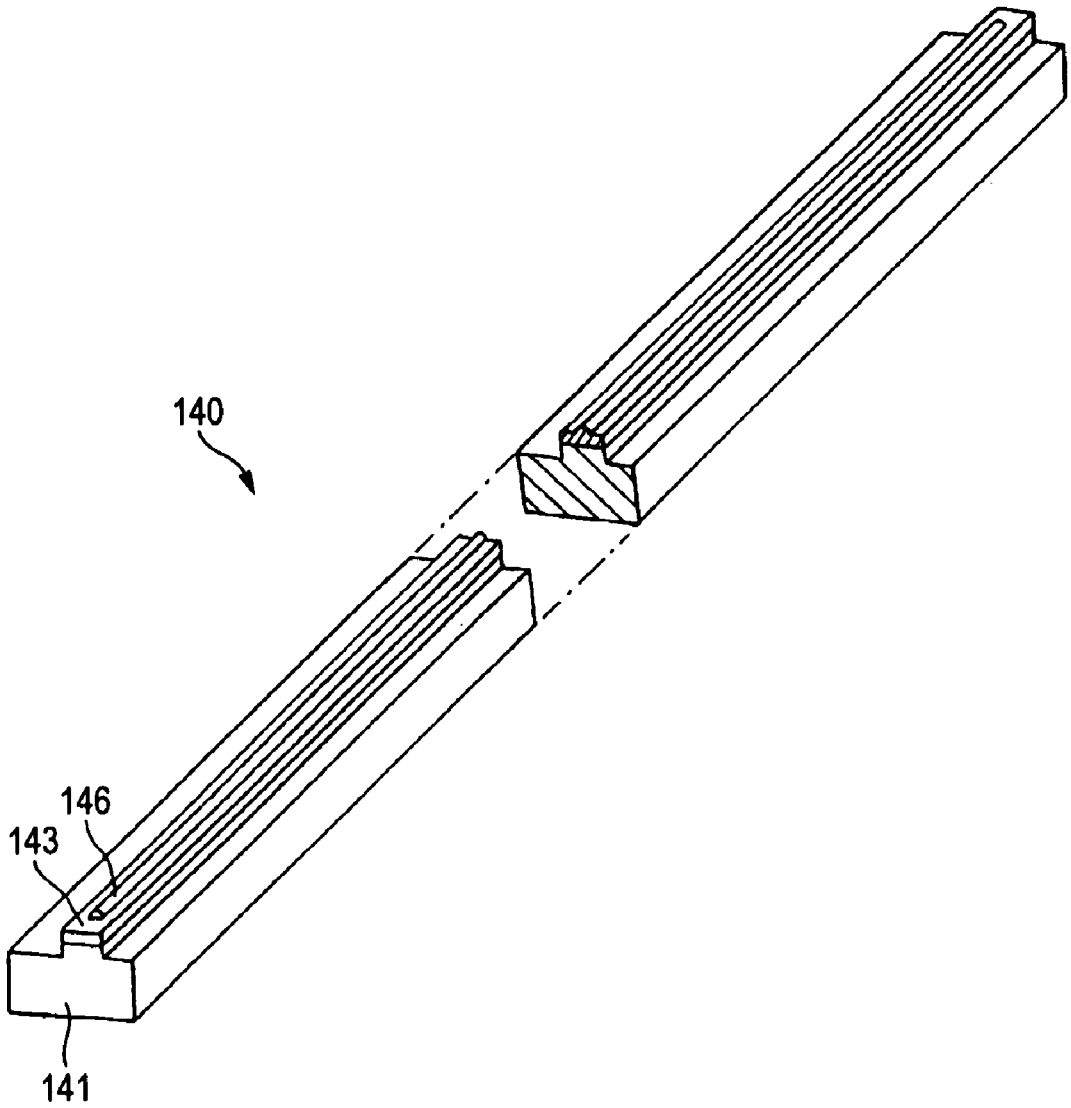
FIG. 23 is a perspective view of a thermal head.

Described now is the thermal head 140 that is protruding from the top chassis 102 toward the side of the base chassis 101. As shown in FIG. 23, the thermal head 140 is provided with a radiation member 141 and a head section 143. The radiation member 141 radiates the heat to be generated when a coloring material is thermally transferred, and the head section 143 applies the thermal energy to the ink ribbon 10.

The radiation member 141 radiates the thermal energy, which is generated by the head section 143 at the time of thermal transfer of a coloring material. This radiation member 141 is made of a material having a high thermal conductivity, e.g., aluminum.

The head section 143 provided above the radiation member 141 is provided with a glass layer, a heating resistor, a pair of electrodes for power supply and signal use, and a resistor protection layer. The heating resistor is provided on the glass layer, and the electrodes are provided on both sides of the heating resistor. The resistor protection layer is provided on and around the heating resistor. The pair of electrodes are each plurally formed at small intervals along the longitudinal direction of the head section 143. The head section 143. is formed with a substantially-arc-shaped protrusion section 146 on the outer surface opposing the ink ribbon 10. Via this protrusion section 146, the thermal energy coming from the heating resistor is applied to the ink ribbon 10. By forming such a substantially-arc-shaped protrusion section 146 to the head section 143, the thermal head 140 smoothly abuts the ink ribbon 10 at the time of heating the ink ribbon 10.

As shown in FIG. 17, in such a thermal head 140, when the top chassis 102 closes the base chassis 101, the protrusion section 146 of the head section 143 is faced to the platen roller 155 disposed in the base chassis 101 via the ink ribbon 10. After the printing paper 4 and the ink ribbon 10 are both transferred in the direction orthogonal to the longitudinal direction of the head section 143, the thermal head 140 heats the ink ribbon 10 using the heating resistor, and the coloring materials varying in color, i.e., yellow (Y), magenta (M), and cyan (C), are thermally transferred sequentially to the reception layer 4*b* of the printing paper 4.

Figure 24:
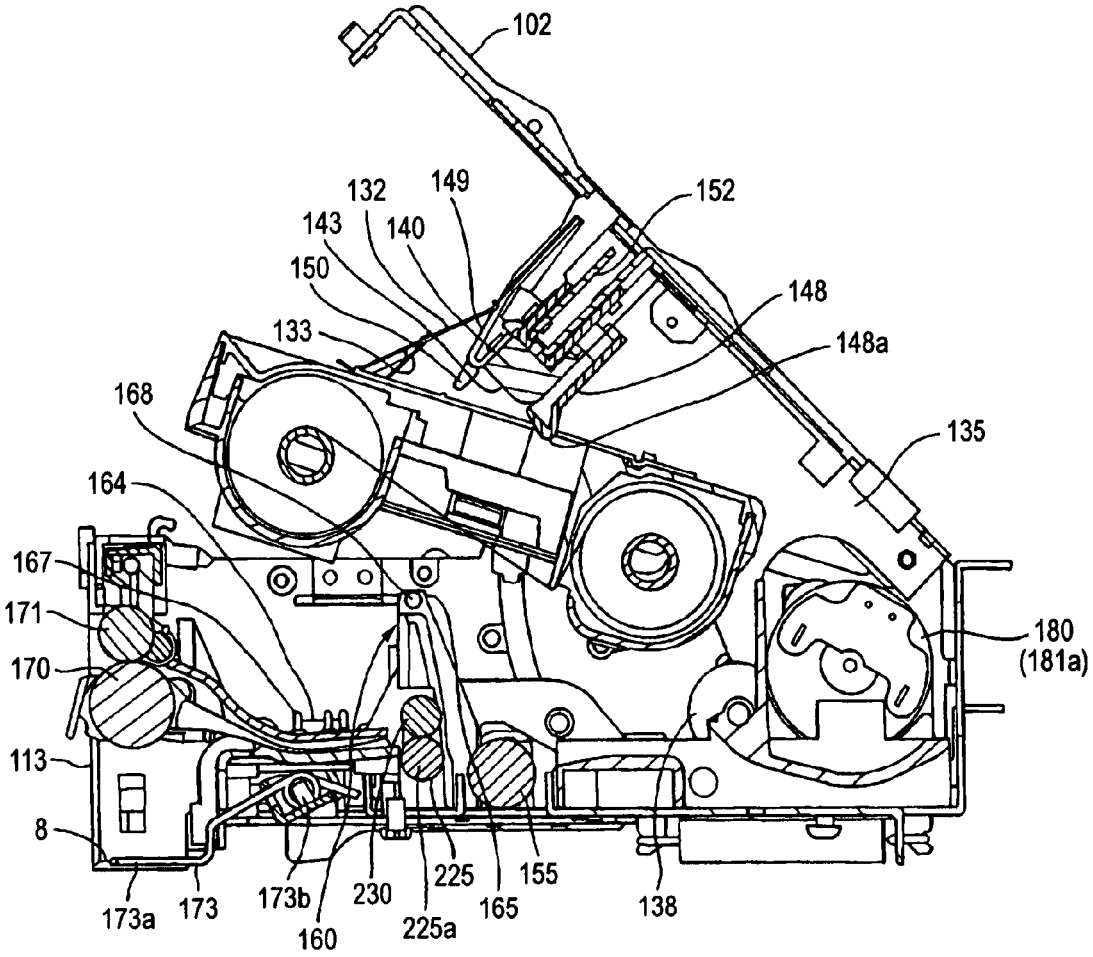
FIG. 24 is a cross sectional view of the main chassis with the top chassis rotated upward.

As shown in FIG. 16, the thermal head 140 is provided with the head cover 148, which forms a ribbon path when the thermal head 140 is inserted into the aperture section 40 of the ink ribbon cartridge 2. The ribbon path here serves as a running path for the ink ribbon 10 being extended up to the aperture section 40. The head cover 148 is substantially a rectangular plate made of synthetic resin, and the length in the longitudinal direction is almost the same as that of the thermal head 140. By aligning the thermal head 140 and the head cover 148 in the longitudinal direction, one main surface is attached from the rear surface side. As shown in FIG. 24, the lower side edge of the head cover 148 is so curved as to look substantially like a letter L, i.e., so curved that the tip end surface is directed to the rear surface side. Thus curved portion is a guide portion 148*a* whose tip end surface is shaped like an arc. The guide portion 148*a* is so disposed as to be substantially parallel to the head section 143 of the thermal head 140, and serves to guide the ink ribbon 10 to run in the direction substantially parallel to the head section 143.

Figure 25:
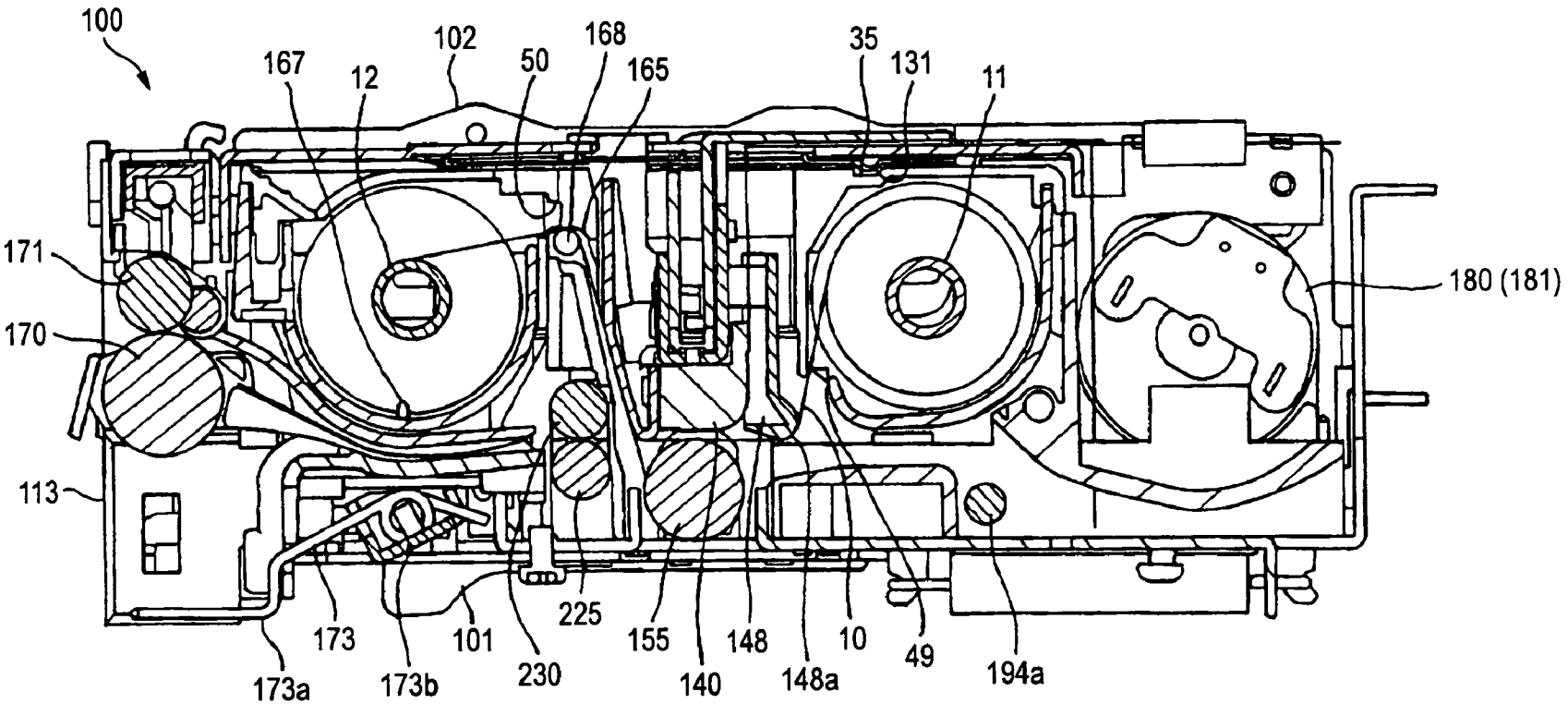
FIG. 25 is a cross sectional view of the main chassis with the top chassis is closed.

As shown in FIG. 25, when the top chassis 102 closes the base chassis 101, such a head cover 148 is directed into the aperture section 40 of the ink ribbon cartridge 2 together with the thermal head 140. When the head cover 148 entering as such, the guide portion 148*a* presses the ink ribbon 10 being extended to the aperture section 40 so that a ribbon path is formed. To be specific, the head cover 148 serves to guide the ink ribbon 10 to go in the direction substantially orthogonal to the direction of the platen roller 155 facing the thermal head 140. This is helped by the guide portion 148*a* being an entrance end to the aperture section 40 is pressing the ink ribbon 10 extended across the supply spool housing section 23 and the take-up spool housing section 24. In the printer device 1, for a printing operation, the ink ribbon 10 and the printing paper 4 are heated by the thermal head 140 while being transferred from the rear surface side of the device body 3 to the front surface side thereof. As such, before the printing operation, the ink ribbon 10 is directed parallel to the printing paper 4 that is also directed in the direction substantially orthogonal to the direction of the platen roller 155 facing the thermal head 140. This thus enables to tightly attach the ink ribbon 10 to the printing paper 4 to a further extent so that the printer device 1 can have better printing characteristics.

As shown in FIG. 16, the thermal head 140 is attached with, also on the front surface side, the synthetic-resin-made cover member 149. The lower side edge of the cover member 149 is formed substantially like an arc, and similarly to the head cover 148, is disposed to be substantially parallel to the head section 143 of the thermal head 140. This cover member 149 is made to slide in contact with the ink ribbon 10 that goes over the thermal head 140, and is guided to the take-up spool 12 by the ribbon guide 165, which will be described later. The cover member 149 is abut with the side surface portion 132*b* on the rear surface side of the protection plate 132 provided to the ink ribbon cartridge holder 7, and the thermal head 140 is covered from the side of the front surface 3*a*.

The thermal head 140 is formed with a sliding piece 150 on both end portions of the cover member 149 in the longitudinal direction. The sliding pieces 150 each serve to position the head section 143 and the platen roller 155 to face each other by sliding in contact with a flange section 156. This flange section 156 is the one provided to a rotation axis 155*a* supporting the platen roller 155. The sliding piece 150 is a metal plate long in length, and as shown in FIGS. 16 and 20, the tip end portion thereof is provided to protrude lower than the head section 143 of the thermal head 140. The tip end portion of the sliding piece 150 is tapered, and serves as a slide-contact section 151 for sliding in contact with the flange section 156 of the platen roller 155 provided to the main surface 110 of the base chassis 101 to be able to freely move in the vertical direction.

This sliding piece 150 has a connection section 152 that is formed to be apiece with the sliding piece 150, and protruding downward from the right and left end portions of the aperture section 153 of the top chassis 102. Such connection sections 152 are connected with the thermal head 140, the head cover 148, and the cover member 149, and the connection result is a piece with the top chassis 102. When the top chassis 102 is closed, together with the thermal head 140 and others, the sliding pieces 150 enter into the aperture section 40 of the ink ribbon cartridge 2 attached to the ink ribbon cartridge holder 7. At this time, as are provided on the both end portions of the thermal head 140 in the longitudinal direction, the sliding pieces 150 do not abut the ink ribbon 10 located in the aperture section 40 but are inserted along the sides of the ink ribbon 10 in the width direction. The slide-contact sections 151 are then rotated to reach the position for sliding in contact with the flange section 156 of the platen roller 155.

Described next is the platen roller 155 being disposed to face the head section 143 of the thermal head 140. The platen roller 155 is configured by an elastic cylindrical body being pivoted about the metal-made rotation axis 155*a*. Both end portions of the rotation axis 155*a* are inserted to the right and left side walls 111 and 112 of the base chassis 101, and are supported by the switch mechanism 190 that will be described later. The platen roller 155 is thus allowed to move the main surface 110 of the base chassis 101 in the longitudinal direction. As shown in FIG. 19, the both end portions of the rotation axis 155*a* are each formed with the flange section 156 for sliding with the sliding piece 150, which is provided to the top chassis 102 to be a piece with the thermal head 140.

Figure 27:
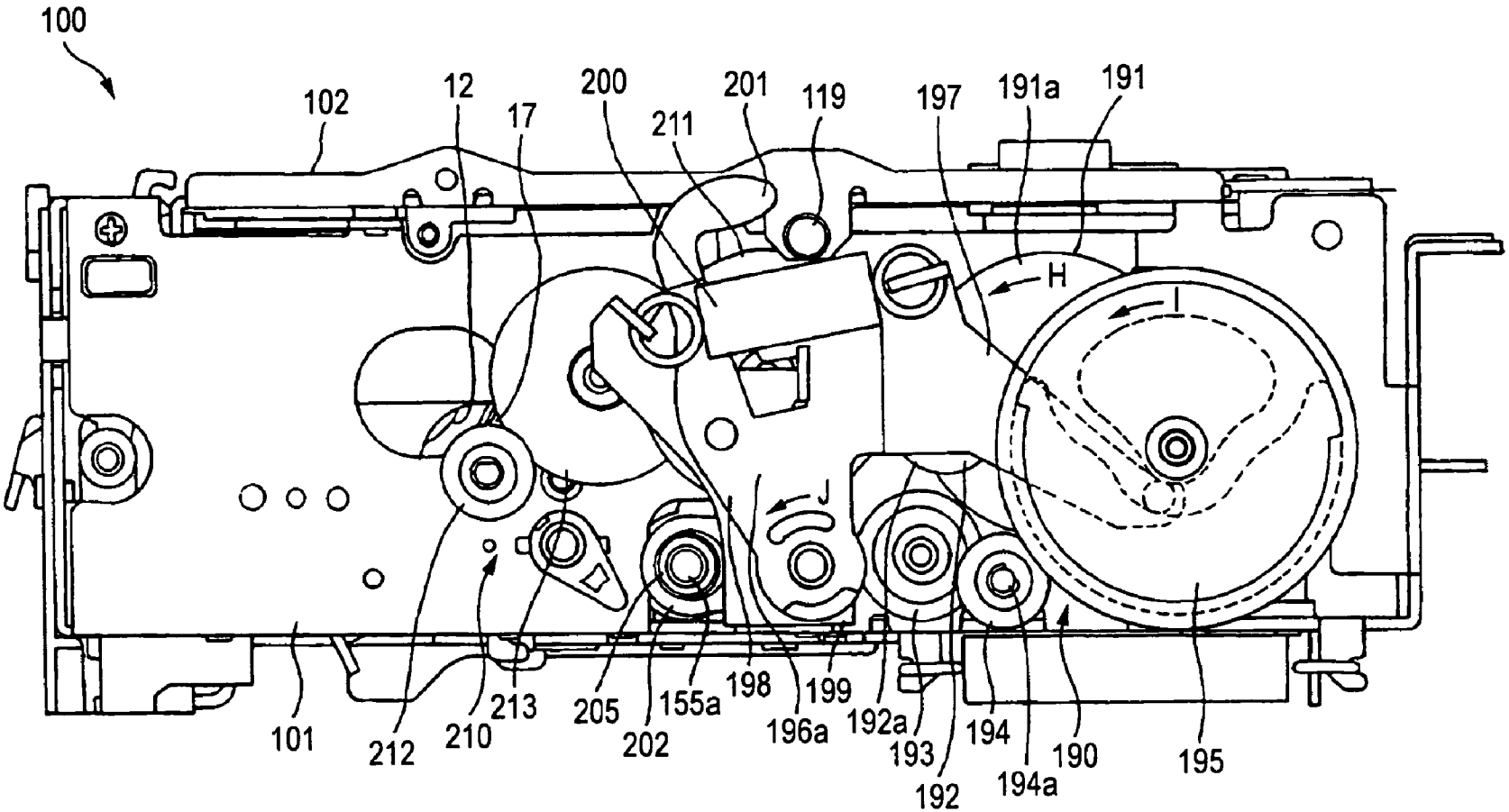
FIG. 27 is a side view of a switch mechanism in which the platen roller is moved down.
Figure 28:
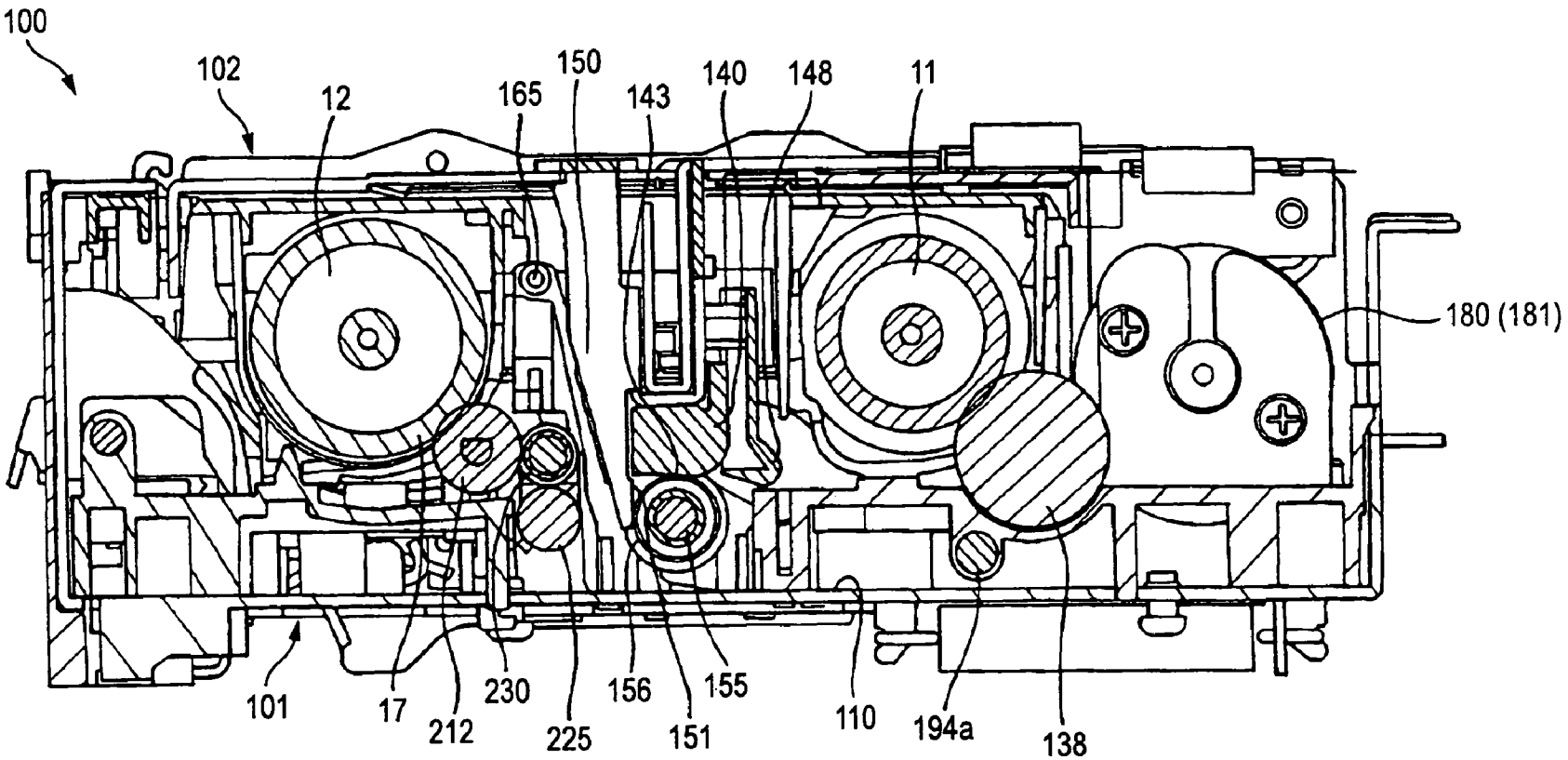
FIG. 28 is a cross sectional view of the main chassis in which the platen roller is moved up.
Figure 29:
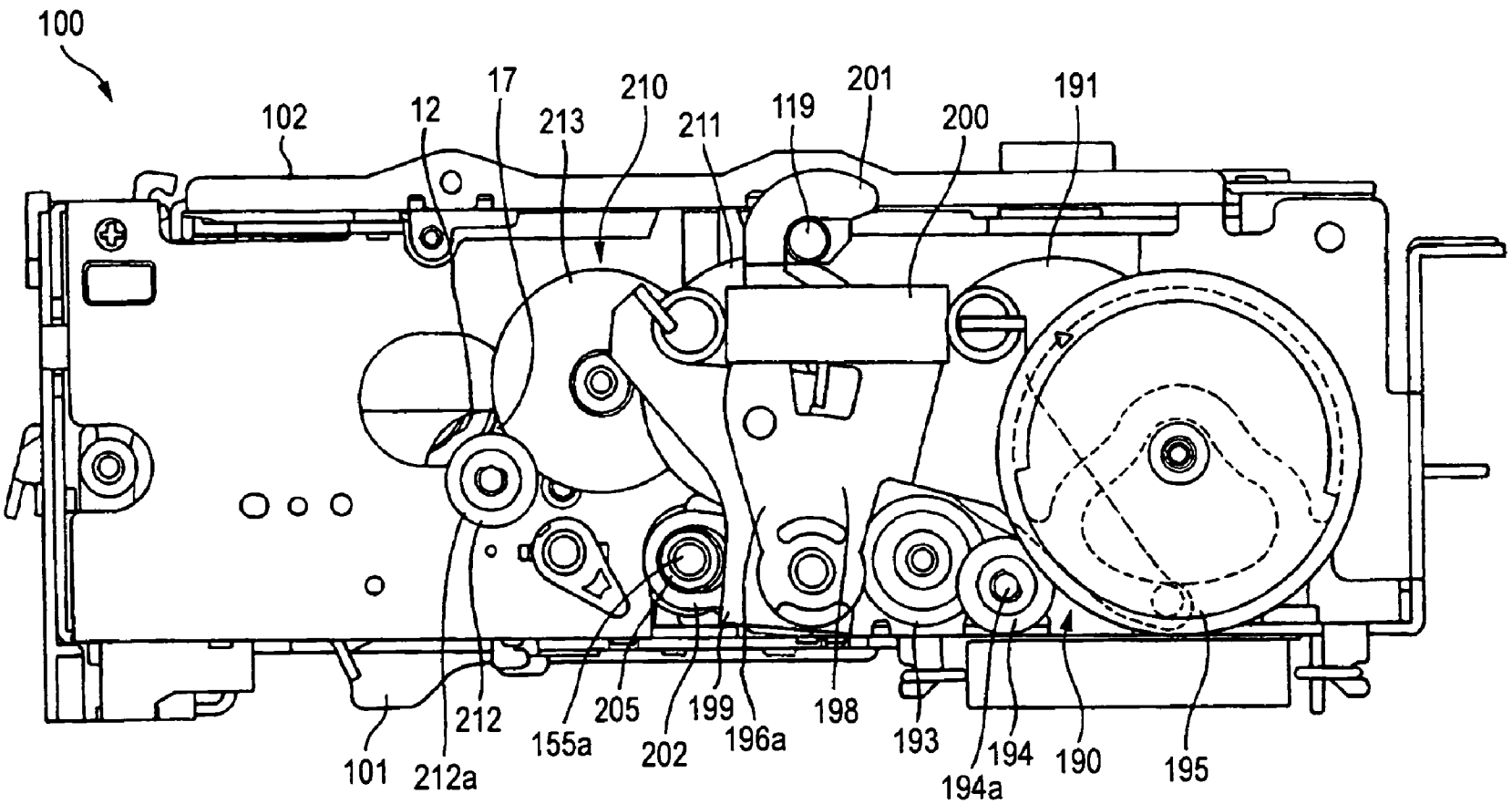
FIG. 29 is a side view of the switch mechanism in which the platen roller is moved up.
Figure 30A:
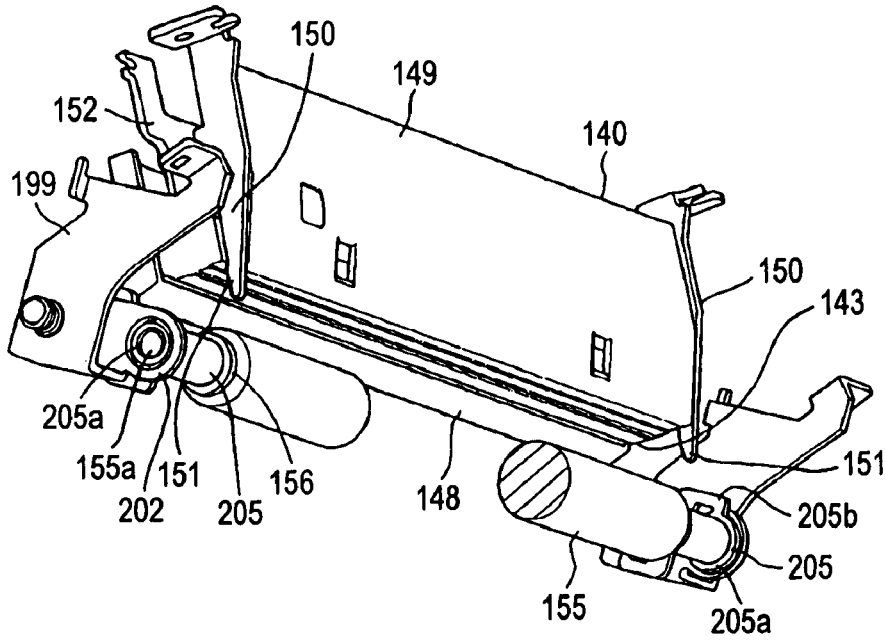
FIG. 30A is a perspective view showing the state in which the platen roller and the thermal head are moved away from each other.
Figure 30B:
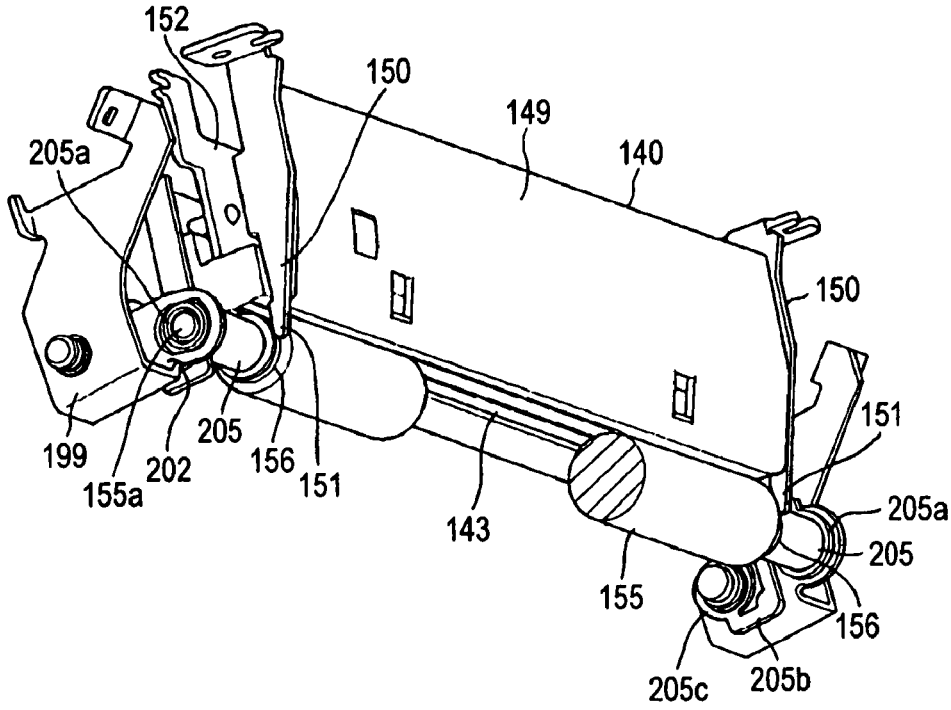
FIG. 30B is a perspective view showing the state in which the platen roller and the thermal head are moved close to each other.

As to such thermal head 140 and platen roller 155, when the top chassis 102 closes the base chassis 101, the sliding pieces 150 are inserted to the aperture section 40 of the ink ribbon cartridge 2, and are faced to the flange sections 156 of the platen roller 155. The thermal head 140 goes through the aperture section 40 of the ink ribbon cartridge 2, and is faced to the platen roller 155 via the ink ribbon 10 being extended to the aperture section 40. At this time, as shown FIGS. 26 and 27, the rotation axis 155*a* of the platen roller 155 is moved down to the side of the main surface 110 of the base chassis 101 by the switch mechanism 190. As shown in FIG. 30A, the platen roller 155 is thus faced to the head section 143 of the thermal head 140 with a slight clearance therefrom. As shown in FIGS. 28 and 29, when the switch mechanism 190 moves up the platen roller 155, the flange sections 156 provided to the rotation axis 155*a* of the platen roller 155 slide in contact with the slide-contact sections 151 of the sliding pieces 150 as shown in FIG. 30B. This makes the flange sections 156 to be guided by the sliding pieces 150 so that the platen roller 155 is allowed to face and abut the head section 143 of the thermal head 140 with high accuracy.

Thereafter, between the head section 143 and the platen roller 155, the printing paper 4 already transferred to the side of the rear surface 3*c* of the device body 3 is directed to the side of the front surface 3*a*, and the printing operation is started. For moving the printing paper 4 to the side of the rear surface 3*c* of the device body 3, or for ejecting outside of the device body 3 the printing paper 4 through with the printing operation, the switch mechanism 190 moves down the rotation axis 155*a*, and the head section 143 and the platen roller 155 are moved away from each other (FIG. 30A).

Described next is the cartridge support unit 160 disposed to the main surface 110 of the base chassis 101 for supporting the ink ribbon cartridge 2 moved to the printing position. The cartridge support unit 160 serves to support the cartridge. body 13 for positioning at the printing position when the ink ribbon cartridge 2 attached in the ink ribbon cartridge holder 7 comes inside of the device body 3, and to form a ribbon path as a running path for the ink ribbon 10 being extended to the aperture section 40.

Figure 13:
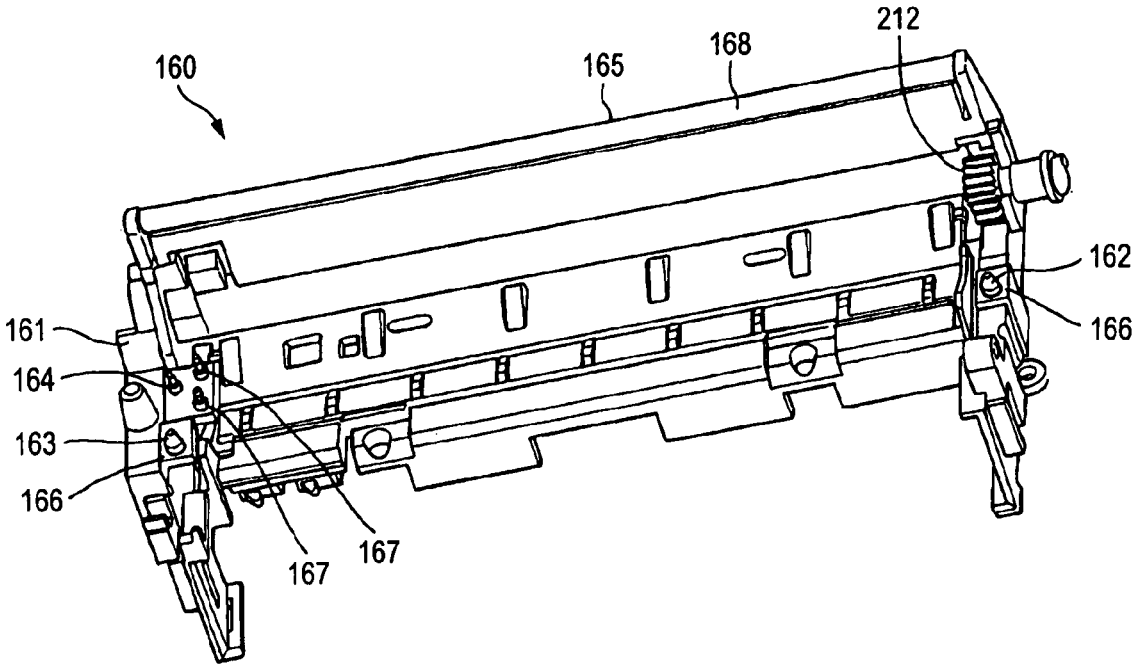
FIG. 13 is a perspective view of a cartridge support unit.

As shown in FIG. 18, this cartridge support unit 160 is disposed on the main surface 110 of the base chassis 101. As shown in FIG. 13, the cartridge support unit 160 is formed with a substantially-rectangular-shaped unit body 161, the first and second positioning convex sections 162 and 163, the detection switch(es) 164, and the ribbon guide 165. The first and second positioning convex sections 162 and 163 are provided on the both end portions of the unit body 161 in the longitudinal direction, and are used to position the cartridge body 13. The detection switch(es) 164 are used to define the ink ribbon cartridge 2 by type based on the type or others of the ink ribbon 10 housed in the cartridge body 13. The ribbon guide 165 goes through the aperture section 40 of the cartridge body 13, and forms a ribbon path.

The unit body 161 is disposed on the main surface 110 of the base chassis 101, and thus is positioned on the side of the front surface 3*a* of the device body 3. This unit body 161 is formed with support surface sections 166 and 166 on both end sides in the longitudinal direction. The support surface sections 166 are shaped substantially rectangular for supporting the placement surface 70 of the cartridge body 13. From the support surface sections 166, the first and second positioning convex sections 162 and 163 are protruding for insertion into the first and second positioning holes 72 and 73, respectively. The first and second positioning holes 72 and 73 are those protruding from the placement surface 70 of the cartridge body 13. The support surface sections 166 are each disposed thereon with the placement surface 70 of the cartridge body 13, thereby being used as a reference for positioning of the ink ribbon cartridge 2 moved to the printing position.

Because the first and second positioning convex sections 162 and 163 are substantially conical in shape, the engagement with the first and second positioning holes 72 and 73 is achieved with ease. Also with such conical shape, the first and second positioning convex sections 162 and 163 can position the cartridge body 13 by being inserted into the first and second holes 72 and 73 as far as they can go. Note here that, as to the first and second positioning convex sections 162 and 163, because the second positioning hole 73 is formed long in length, even if the second positioning hole 73 is not correctly abut with the second positioning convex section 163 with accuracy, such position displacement can be absorbed by the first positioning hole 72 being inserted with the first positioning convex section 162.

Figure 26:
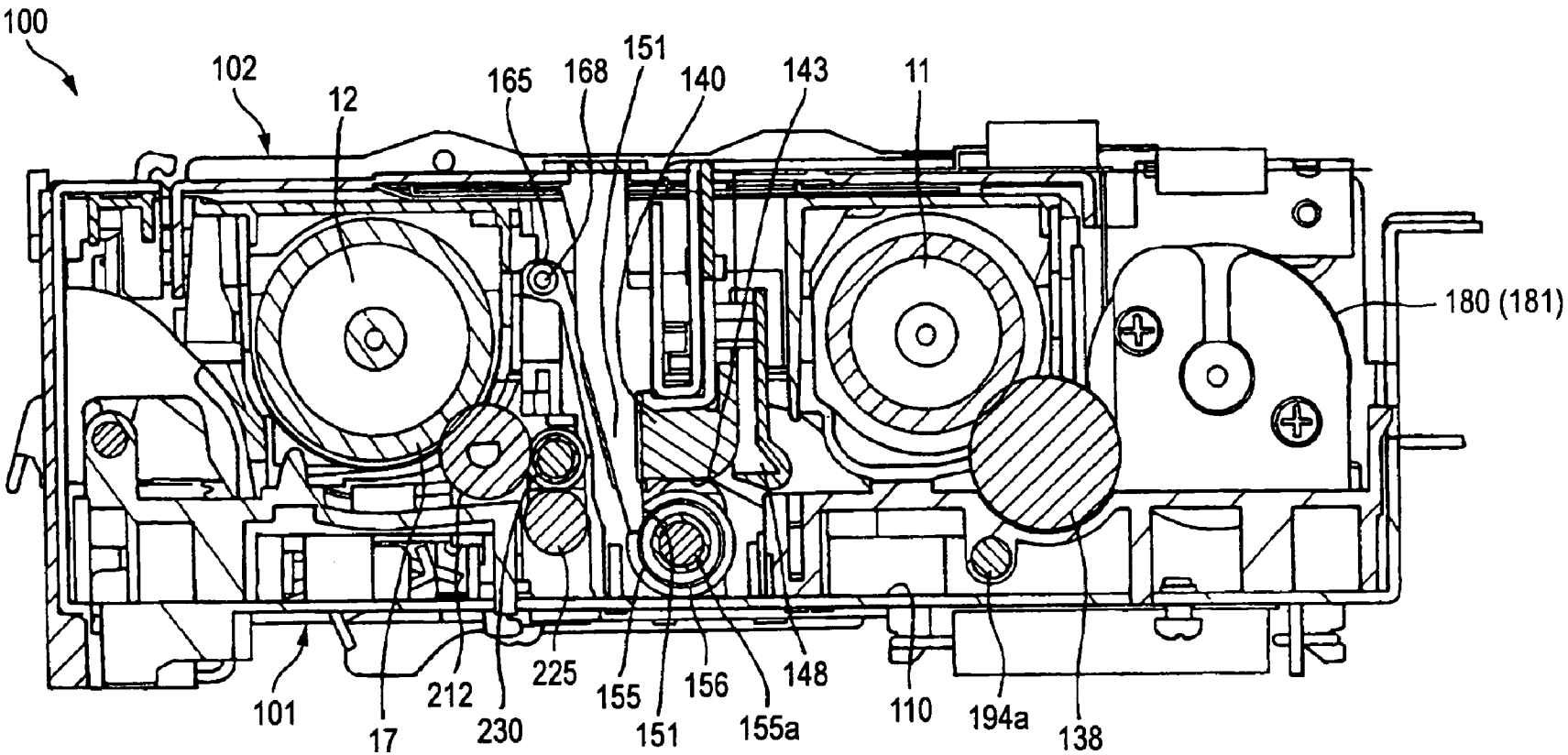
FIG. 26 is a cross sectional view of the main chassis in which a platen roller is moved down.

Moreover, through positioning of the ink ribbon cartridge 2 by the first and second positioning convex sections 162 and 163 being inserted into the first and second positioning holes 72 and 73, the running gear 212 of the ink ribbon running mechanism 210 formed to the printer device 1 is engaged with the latchet gear 17 of the take-up spool 12 so that the ink ribbon 10 becomes ready to run (refer to FIG. 26). Here, the latchet gear 17 is the one facing outside from the gear-use aperture section 48 of the ink ribbon cartridge 2.

In the vicinity of the second positioning convex section 163, the detection switch(es) 164 are provided to define the ink ribbon cartridge 2 by type. Such detection switch(es) 164 are each provided with one or more protruding detection pins 167 for insertion into the ID hole(s) 74 punched in the cartridge body. As described above, the detection pin(s) 167 are inserted or made to abut the open or closed ID hole(s) 74 depending on the type of the ink ribbon cartridge 2, and their pressing states are detected for the printer device 1 so that the ink ribbon cartridge 2 is defined by type.

Specifically, in the detection switch(es) 164, the detection pin(s) 167 are provided corresponding to the ID hole(s) 74 of the ink ribbon cartridge 2, indicating whether the wide ink ribbon 10W is now wound around the spool or the narrow ink ribbon 10N is wound therearound. As described in the foregoing, when the narrow ink ribbon 10N is wound around the spool, the ID hole(s) 74 are closed, and are open when the wide ink ribbon 10W is wound around the spool. Accordingly, if detecting that the detection pin(s) 167 are pressed when the ink ribbon cartridge 2 is moved to the printing position, the detection switch(es) 164 acknowledge that the attached ink ribbon cartridge 2 is of the wide ink ribbon 10W, and if detecting that the detection pin(s) 167 are not pressed, the detection switch(es) 164 acknowledge that the attached ink ribbon cartridge 2 is of the narrow ink ribbon 10N.

The ribbon guide 165 serving to guide the ink ribbon 10 of the ink ribbon cartridge 2 after moved to the printing position supports the ink ribbon 10 across the width direction, thereby forming a ribbon path for the ink ribbon 10 in the device body 3. The ribbon guide 165 is formed to protrude in the upper direction of the base chassis 101, i.e., the direction substantially orthogonal to the running direction of the ink ribbon 10. The ink ribbon guide 165 is formed at a position corresponding to the aperture section 40 of the cartridge body 13, and is inserted into the aperture section 40 when the ink ribbon cartridge 2 comes at the printing position. The ink ribbon guide 165 is located closer to the side of the front surface 3*a* of the device body 3 than the thermal head 140 inserted in the aperture section 40, i.e., on the side of the take-up spool housing section 24.

Such a ribbon guide 165 is provided with, at an upper end portion, a guide roller 168 across the width direction of the ink ribbon 10. The guide roller 168 configures a ribbon path for the ink ribbon 10 by being formed at the upper end of the ribbon guide 165, and ensures smooth running of the ink ribbon 10.

When the top chassis 102 is closed and when the ink ribbon cartridge holder 7 attached with the ink ribbon cartridge 2 comes at the printing position, as shown in FIG. 25, the ribbon guide 165 is inserted into the aperture section 40 of the cartridge body 13, and the guide roller 168 supports, across the width direction, the ink ribbon 10 being extended to the aperture section 40. Through such supporting, the ribbon guide 165 makes stand the ink ribbon 10 steeply above the base chassis 101, and guides the ink ribbon 10 to the height substantially the same as that of the slit 50 being in charge of guiding the ribbon to the take-up spool housing section 24. Herein, the ink ribbon 10 is the one being guided by the head cover 148 of the thermal head 140, and extended between the head section 143 and the platen roller 155.

After passing through the head section 143 of the thermal head 140, the ink ribbon 10 is made to stand steeply by the ribbon guide 165 and is then guided upward. As such, the ink ribbon 10 is thermally compressed to the printing paper 4 by being sandwiched between the head section 143 and the platen roller 155, and can be peeled off with efficiency from the printing paper 4 coming to the side of the front surface 3*a* of the device body 3. At this time, after being thermally compressed to the printing paper 4 by the head section 143 of the thermal head 140, the ink ribbon 10 is directed to the side of the front surface 3*a* together with the printing paper 4 while being supported by the substantially-arc-shaped lower side edge of the cover member 149. Thereafter, the ink ribbon 10 is peeled off from the printing paper 4 by the ribbon guide 165. It accordingly means that the ink ribbon 10 heated by the head section 143 is cooled before being peeled off, thereby being easily peeled off from the printing paper 4. That is, although the ink ribbon is not easily peeled off from the printing paper immediately after heating, the cover member 149 guiding the ink ribbon 10 at the lower side edge enables the ink ribbon 10 to run while being tightly attached to the printing paper 4 after heated by the head section 143. In the meantime, the ink ribbon 10 is cooled before being peeled off, thereby leading to the better efficiency for peeling.

Note here that because the lower side edge of the cover member 149 is shaped substantially like an arc, the ink ribbon 10 can be guided to smoothly stand, and accidents are favorably prevented, e.g., erroneous ribbon cutting.

With such a configuration, i.e., the top chassis 102 rotating in the vertical direction of the base chassis 101 is provided with the ink ribbon cartridge holder 7 and the thermal head 140, the ink ribbon cartridge 2 is moved in the vertical direction for position change from the insertion/removal position to the printing position, and the base chassis 101 is provided with the ribbon guide 165, only moving the ink ribbon cartridge 2 to the printing position accordingly allows the thermal head 140 and the ribbon guide 165 to form a ribbon path for use by the ink ribbon 10 to run inside of the device body 3. This favorably eliminates the need for the ink ribbon cartridge 2 to include a mechanism of forming a ribbon path when attached in the printer device 1.

As shown in FIG. 17, the front surface wall 113 of the base chassis 101 is formed with, on the side of the front surface 3*a* of the device body 3, a paper feed/eject roller 170 and a sub roller 171 for the printing paper 4. The paper feed/eject roller 170 serves to pull out the printing paper 4 from the printing paper tray 5 attached from the front surface 3*a* of the device body 3, and transfer the printing paper 4 from the side of the front surface 3*a* to the side of the rear surface 3*c* and vice versa. The sub roller 171 works with the paper feed/eject roller 170 to eject the printing paper 4 in the device body 3 to outside of the device body 3. The device body 3 is formed with the aperture section 8 for attachment of the printing paper tray 5 below the paper feed/eject roller 170, and the printing paper 4 housed in the printing paper tray 5 is located below the paper feed/eject roller 170.

The paper feed/eject roller 170 is provided with a roller portion 170*a* and an axis portion 170*b*. The roller portion 170*a* is made to abut the printing paper 4, and the axis portion 170*b* supports the roller portion 170*a*. The roller portion 170*a* is a hollow cylindrical body made of a rubber material, and is supported by the axis portion 170*b* by being inserted therethrough. The axis portion 170*b* is supported by, at their both ends, the front surface wall 113 of the base chassis 101 to be able to freely rotate, and is provided with a paper feed/eject gear 172 at the end portion protruding toward the side of the left side wall 111. When this paper feed/eject gear 172 is rotated by a gear string 227 of the transfer mechanism 220 (will be described later), the paper feed/eject roller 170 is driven.

As shown in FIGS. 16, 24, and others, the front surface wall 113 is formed with a press lever 173 for pressing the printing paper 4 in the printing paper tray 5 against the paper feed/eject roller 170. The press lever 173 is inserted into the printing paper tray 5 by the printing paper tray 5 being attached to the aperture section 8. The press lever 173 thus pushes up the printing paper 4 for pressing it against the paper feed/eject roller 170, thereby taking out the printing paper 4 from the printing paper tray 5 into the device body 3. Such a press lever 173 is provided with a press portion 173*a* and an axis portion 173*b*. The press portion 173*a* is substantially a rectangular cotton swab, and the axis portion 173*b* supports the press portion 173*a*. The press portion 173*a* is protruding to the side of the front surface 3*a* of the device body 3, and then is inserted into the printing paper tray 5. The axis portion 173*b* is wound with the press portion 173*a* being a cotton swab, and is supported by the main surface 110 of the base chassis 101 to be able to rotate. The axis portion 173*b* is formed with an engagement convex section 174 at the end portion protruding to the side of the left side wall 111 for engagement with a cam gear 226 of the transfer mechanism 220 (refer to FIGS. 32 and 34). The axis portion 173*b* is latched by one end of a coil spring (not shown) so that the press portion 173*a* is biased to rotate downward. Herein, the other end of the coil spring is being latched to the main surface 110 of the base chassis 101. In such a press lever 173, the cam shape of the cam gear 226 guides the engagement convex section 174 by the cam gear 226 being driven, and the axis portion 173*b* and the press portion 173*a* are rotated in the vertical direction.

Note here that the front surface wall 113 is disposed with an engagement member (not shown) for latching of the first latching protrusion section 118, which is protruding to the front side surface of the top chassis 102. The engagement member is disposed to be able to freely slide in the lateral direction of the base chassis 101, and is biased in the right or left direction by a biasing member for latching of the first latching protrusion section 118 of the top chassis 102. The engagement member is coupled with the open button 107 of the device body 3, and when the open button 107 is operated to slide, the engagement with the first latching protrusion section 118 is released so that the top chassis 102 is made ready to rotate upward.

As shown in FIGS. 18 and 19, on the side of the rear surface wall 114 of the base chassis 101, disposed are a switch/running motor 180 and a capstan motor 181. Herein, the switch/running motor 180 serves as a drive source for the switch mechanism 190 serving to move up and down the platen roller 155, and as a drive source for the ink ribbon running mechanism 210 for use to run the ink ribbon 10. The capstan motor 181 serves as a drive source for the capstan roller 225 of the transfer mechanism 220 for use to transfer the printing paper 4. The switch/running motor 180 is so disposed that a drive axis 180*a* is directed to the side of the right side wall 112 of the base chassis 101, and the drive axis 180*a* is provided with a motor gear 180*b* at its tip end. The capstan motor 181 is so disposed that a drive axis 181*a* is directed to the side of the left side wall 111 of the base chassis 101, and the drive axis 181*a* is provided with a motor gear 181*b* at its tip end.

The switch/running motor 180 and the capstan motor 181 drive the switch mechanism 190 and the ink ribbon running mechanism 210 or the transfer mechanism 220 by being driven in the forward or reverse direction.

Figure 31A:
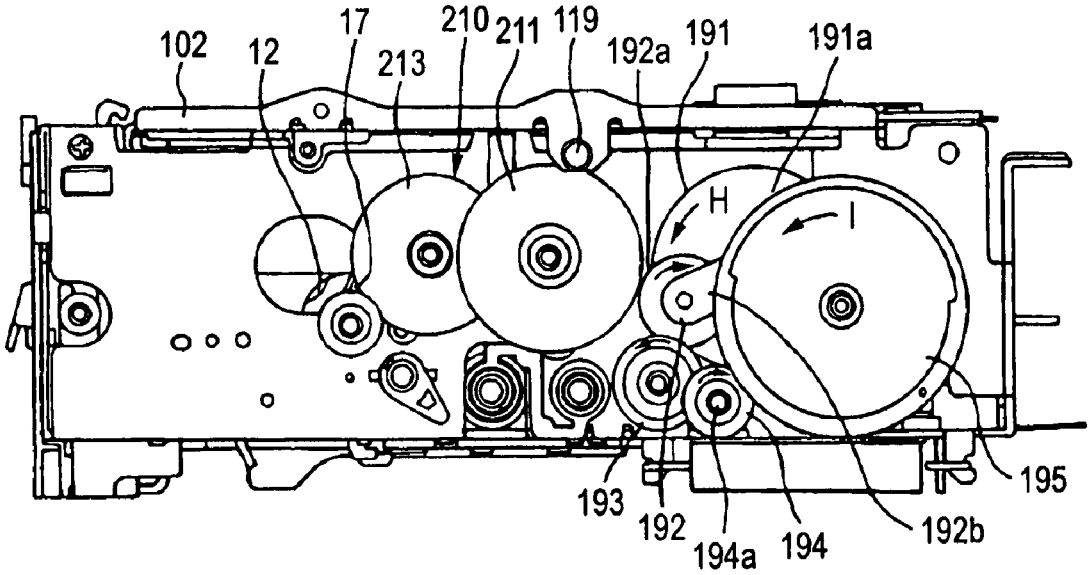
FIGS. 31A and 31B are both a side view of the switch mechanism and a running mechanism.

Described next is the switch mechanism 190 that is driven by the switch/running motor 180 for moving up and down the platen roller 155 with respect to the thermal head 140. The switch mechanism 190 is formed to the right side wall 112 of the base chassis 101, and as shown in FIGS. 27 and 31A, includes a two-stage gear 191, a mode switch gear 192, first and second coupling gears 193 and 194, a pair of right and left cam gears 195, and a pair of right and left ascent/descent plates 196. The two-stage gear 191 is engaged with the motor gear 180*b* provided to the drive axis 180*a* of the switch/running motor 180, and the mode switch gear 192 moves to swing in accordance with the rotation direction of the two-stage gear 191. The first and second coupling gears 193 and 194 are both engaged with the mode switch gear 192, and the cam gears 195 are both engaged with the second coupling gear 194. The ascent/descent plates 196 are both engaged with the cam gears 195 to move up and down the platen roller 155.

The two-stage gear 191 is provided coaxial to the mode switch gear 192, and supports the mode switch gear 192 to be able to freely rotate. In the two-stage gear 191, a large-diameter gear 191*a* is being engaged with the motor gear 180*b*, and a small-diameter gear 191*b* is being engaged with the mode switch gear 192. The mode switch gear 192 is provided with a gear portion 192*a* at one end of a plate 192*b* long in length, and the plate 192*b* is supported coaxial to the two-stage gear 191 at substantially the center portion to be able to freely swing. In this mode switch gear 192, the gear portion 192*a* is moved to swing between the first coupling gear 193 and a third coupling gear 211, which configures the running mechanism 210 for the ink ribbon 10 (will be described later).

When the two-stage gear 191 is rotated in the direction of an arrow H of FIGS. 27 and 31A and in the direction opposite to the direction of the arrow H in accordance with the rotation direction of the switch/running motor 180, the plate 192*b* is moved to swing in the same direction as the two-stage gear 191. With such swing motion, in the mode switch gear 192, the gear portion 192*a* is engaged with either the first coupling gear 193 or the third coupling gear 211. When the mode switch gear 192 is engaged with the first coupling gear 193, the ascent/descent plates 196 are operated to move in the vertical direction via the second coupling gear 194 and the cam gears 195.

The first coupling gear 193 to be engaged with the mode switch gear 192 is supported by the right side wall 112 of the base chassis 101 to be able to rotate. As shown in FIG. 19, the second coupling gear 194 to be engaged with the first coupling gear 193 includes an axis portion 194*a*, and on the both ends of the axis portion 194*a*, right and left gear portions 194*b* and 194*c* are formed. The axis portion 194*a* is disposed across the right and left side walls 111 and 112 of the base chassis 101. The right gear portion 194*b* is disposed outside of the right side wall 112, and the left gear portion 194*c* is disposed outside of the left side wall 111. These right and left gear portions 194*b* and 194*c* are engaged with right and left cam gears 195*a* and 195*b*, respectively.

The cam gear 195 for moving up and down the ascent/descent plates 196 is provided in pair, i.e., right and left cam gears 195*a* and 195*b*. The right cam gear 195*a* is engaged with the right gear portion 194*b* of the second coupling gear 194, and the left cam gear 195*b* is engaged with the left gear portion 194*c*. These right and left cam gears 195*a* and 195*b* are respectively supported by the right and left side walls 111 and 112 to be able to freely rotate. The right and left cam gears 195*a* and 195*b* are each formed with a cam groove on the surface facing the corresponding side wall of the base chassis 101, and respectively engaged with a right ascent/descent plate 196*a* and a left ascent/descent plate 196*b*.

The ascent/descent plate 196 is provided in pair, i.e., the right and left ascent/descent plates 196*a* and 196*b*, for supporting the both ends of the rotation axis 155*a* of the platen roller 155. The right and left ascent/descent plates 196*a* and 196*b* are respectively supported by the right and left side walls 111 and 112 of the base chassis 101 to be able to freely rotate. The ascent/descent plates 196 are each provided with an engagement plate 198 and an ascent/descent plate 199. The engagement plate 198 is formed with an engagement arm 197 for engagement with the cam grooves formed to the cam gears 195. The ascent/descent plate 199 moves up and down the rotation axis 155*a* of the platen roller 155 by being rotated together with the engagement plate 198. When the engagement arm 197 extended to the rear surface side is engaged with the cam grooves as such, the engagement plate 198 is rotated across the fore and aft direction of the right and left side walls 111 and 112 in response to the rotation of the cam gears 195. The engagement plate 198 is formed with, at an upper portion, the latching piece 201 for latching to the second latching protrusion sections 119, which are formed on the right and left sides of the top chassis 102.

The ascent/descent plate 199 is coupled with the engagement plate 198 via the engagement plate 198 and a spring member 200, and is configured to be able to rotate together with the engagement plate 198. This ascent/descent plate 199 is formed with an insertion section 202, by which the rotation axis 155*a* of the platen roller 155 is supported through insertion thereinto.

Figure 31B:
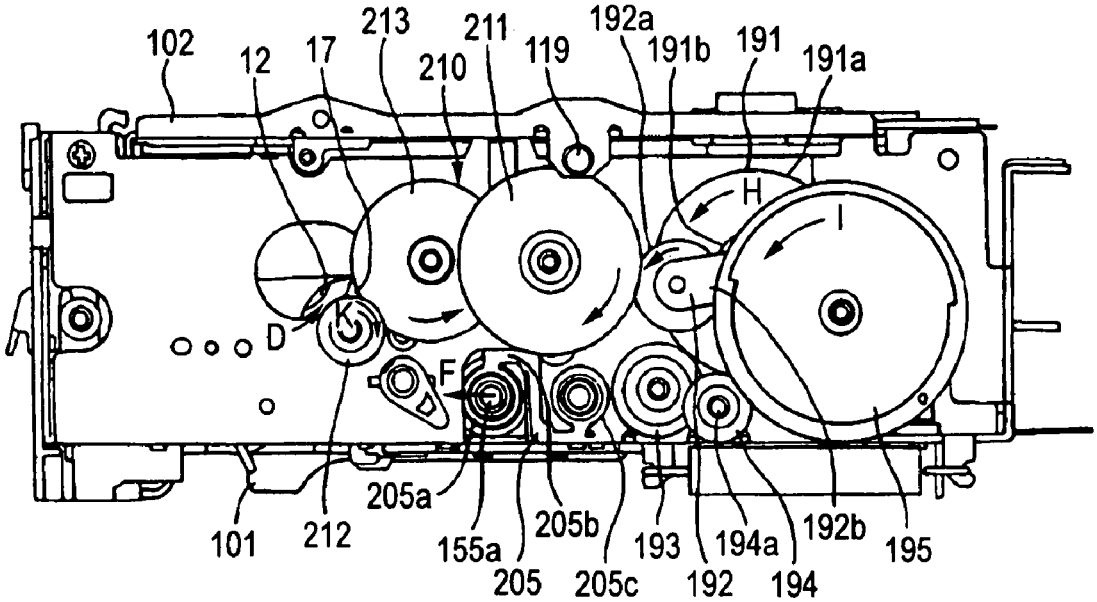

Note here that the rotation axis 155*a* of the platen roller 155 inserted as such into the insertion section 202 of the ascent/descent plate 199 is inserted into a press member 205. This press member 205 serves to move up the platen roller 155 with high accuracy with respect to the head section 143 of the thermal head 140. The press member 205 is a mold of synthetic resin, and as shown in FIGS. 30A and 30B and FIG. 31B, includes a cylindrical portion 205*a*, a press portion 205*b*, and a support portion 205*c*. The cylindrical portion 205*a* is inserted into both the rotation axis 155*a* and the insertion section 202 of the ascent/descent plate 199, and the press portion 205*b* presses the cylindrical portion 205*a* against the insertion section 202. The support portion 205*c* supports the press member 205 to be able to rotate. The support portion 205*c* being coaxial to the ascent/descent plate 196 is supported by the right side wall 112 of the base chassis 101, and allows the press member 205 to rotate. The press portion 205*b* is so disposed as to be curved to substantially look like a letter S between a part of the rim of the cylindrical portion 205*a* and the support portion 205*c*. The press portion 205*b* is made flexible and curved, thereby pressing the cylindrical portion 205*a* against the inner portion of the insertion section 202 in the direction of an arrow F of FIG. 31B.

The ascent/descent plate 199 is inserted with the rotation axis 155*a* of the platen roller 155 via such a press member 205. When the cam gears 195 are rotated in the direction of an arrow I of FIG. 27, the engagement plate 198 and the ascent/descent plate 199 are guided by the cam grooves so that the ascent/descent plate 196 goes through reciprocating rotation in two directions, i.e., the direction of an arrow J of FIG. 27 and the direction opposite to the arrow J. This enables the ascent/descent plate 196 to move up and down the rotation axis 155*a* inserted in the insertion section 202 of the ascent/descent plate 199. At this time, because the press member 205 is pressing the rotation axis 155*a* against the inner portion of the insertion section 202 of the ascent/descent plate 199, the platen roller 155 is prevented from fluctuating in the insertion section 202 of the rotation axis 155*a*. This thus increases the position accuracy of the platen roller 155 against the head section 143 of the thermal head 140 so that the platen roller 155 can face the head section 143 without fail.

When the switch/running motor 180 is rotated in the forward direction, in the switch mechanism 190, the two-stage gear 191 engaged with the motor gear 180*b* is rotated in the direction of an arrow H of FIGS. 27 and 31A, and the plate of the mode switch gear 192 is moved to swing in the same direction so that the gear portion 192*a* is coupled with the first coupling gear 193. As a result, the driving force of the switch/running motor 180 is transferred from the first coupling gear 193 to both the second coupling gear 194 and the right cam gear 195*a* so that the right cam gear 195*a* is rotated in the direction of an arrow I of FIG. 27. The left cam gear 195*b* being engaged with the left gear portion 194*c* of the second coupling gear 194 is also rotated in the same direction. The right and left ascent/descent plates 196*a* and 196*b* being engaged with the right and left cam gears 195*a* and 195*b* can operate the platen roller 155 to move up and down by the engagement arm 197 of the engagement plates 198 being operated by the cam gears 195, and by the ascent/descent plate 199 going through reciprocating rotation in the direction of an arrow J of FIG. 27 and in the direction opposite to the arrow J.

Note that the ascending/descending state of such a platen roller 155 is detected by whether a mode detection switch is turned on or off by the left ascent/descent plate 196*b*. The mode detection switch is the one mounted to a rigid substrate attached to the left side wall 111 of the base chassis 101.

Described next is the running mechanism 210 for making the ink ribbon 10 to run. As shown in FIG. 31B, the ink ribbon running mechanism 210 is provided with the third coupling gear 211, the ink ribbon running gear 212, and a fourth coupling gear 213. The third coupling gear 211 is engaged with the mode switch gear 192, and the ink ribbon running gear 212 makes the ink ribbon 10 to run by rotation-driving the take-up spool 12 housed in the ink ribbon cartridge 2. The fourth coupling gear 213 serves to couple together the third coupling gear 211 and the ink ribbon running gear 212.

The third coupling gear 211 is a two-stage gear, which is attached to the right side wall 112 of the base chassis 101 to be able to freely rotate. In the third coupling gear 211, a large-diameter gear is engaged with the mode switch gear 192, and a small-diameter gear is engaged with the fourth coupling gear 213. The fourth coupling gear 213 is also attached to the right side wall 112 of the base chassis 101 to be able to freely rotate.

As shown in FIG. 19, the ink ribbon running gear 212 to be rotated by the fourth coupling gear 213 is provided with a cylindrical support portion 212*a*, an axis portion 212*b*, a first gear portion 212*c*, and a second gear portion 212*d* (refer to FIG. 13). The support portion 212*a* is attached to the right side wall 112 of the base chassis 101, and the axis portion 212*b* goes through the support portion 212*a*, and is extended from/to inside to/from outside of the right side wall 112. The first gear portion 212*c* is provided at one end of the axis portion 212*b*, and is engaged with the fourth coupling gear 213 toward outside of the right side wall 112. The second gear portion 212*d* is provided at the other end of the axis portion 212*b*, and is engaged with the take-up spool 12 of the ink ribbon cartridge 2 inside of the base chassis 101. The second gear portion 212*d* is engaged with the latchet gear 17 by the ink ribbon cartridge 2 being moved to the printing position, and allows the take-up spool 12 to rotate. The latchet gear 17 here is the one being faced outside from the gear-use aperture section 48 of the take-up spool housing section 24.

When the switch/running motor 180 is rotated in the reverse direction, in the ink ribbon running mechanism 210, the two-stage gear 191 engaged with the motor gear 180*b* is rotated in the direction opposite to the arrow H of FIG. 31B, and the plate of the mode switch gear 192 is also moved to swing in the same direction so that the gear portion 192*a* is coupled with the third coupling gear 211. As a result, the driving force of the switch/running motor 180 is transferred from the third coupling gear 211 to both the fourth coupling gear 213 and the ink ribbon running gear 212 so that the first gear portion 212*c* and the second gear portion 212*d* of the ink ribbon running gear 212 are rotated in the direction of an arrow K of FIG. 31B. As such, the ink ribbon running gear 212 can rotate the take-up spool 12 being engaged with the second gear portion 212*d* in the direction of an arrow D, i.e., the direction of taking up the ink ribbon 10, so that the ink ribbon 10 is directed from the supply spool 11 to the take-up spool 12.

When the switch/feed mechanism 180 is rotated in the forward direction, the two-stage gear 191 is rotated in the direction of the arrow H, and the gear portion 192*a* of the mode switch gear 192 is moved to swing in the same direction so that the ink ribbon running mechanism 210 is moved away from the third coupling gear 211. This cuts off the coupling between the switch/running motor 180 and the ink ribbon running gear 212, and thus the take-up spool 12 is stopped in operation, and the ink ribbon 10 is stopped running.

Figure 32:
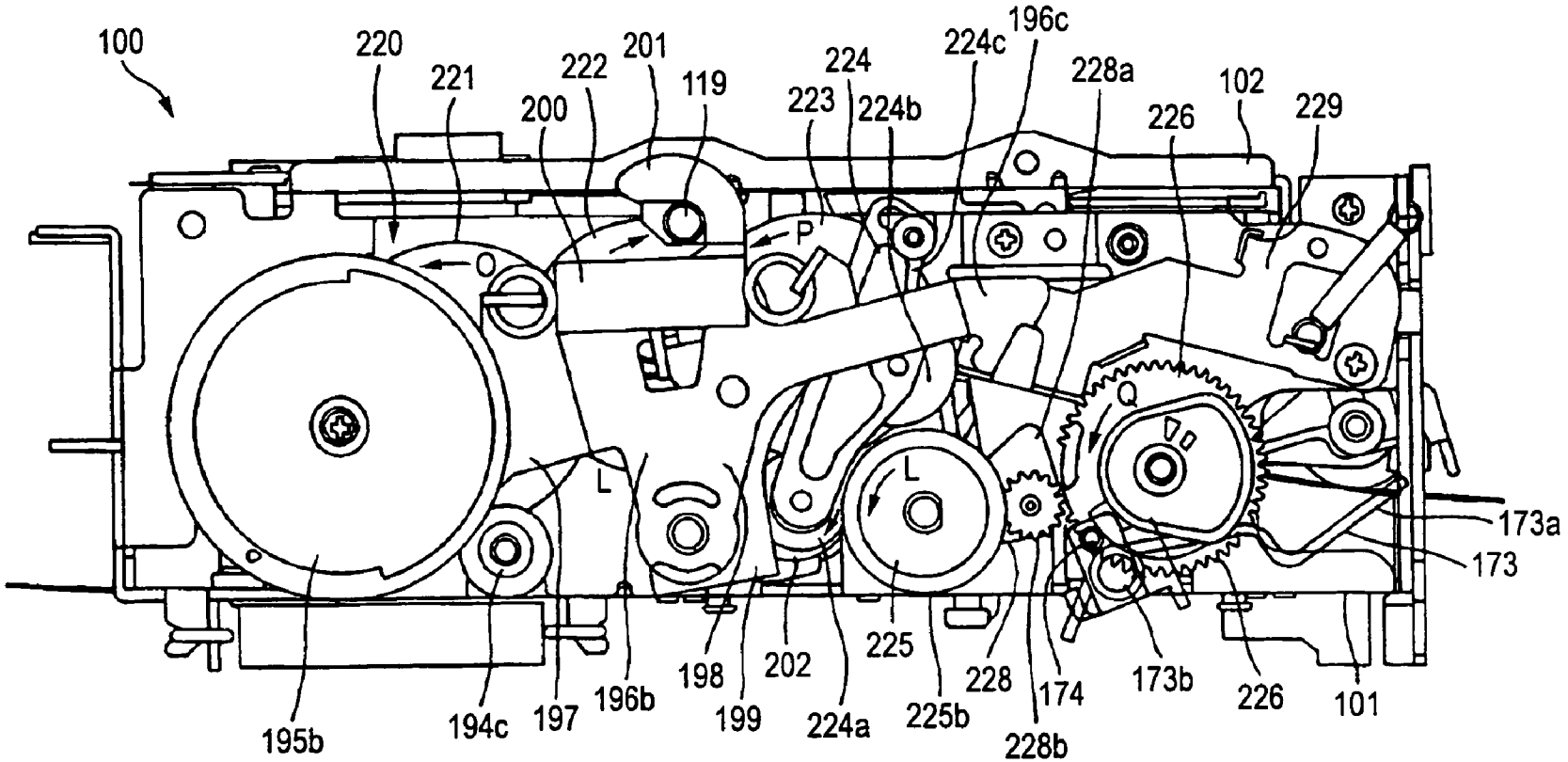
FIG. 32 is a side view of a transfer mechanism that feeds printing papers.
Figure 33:
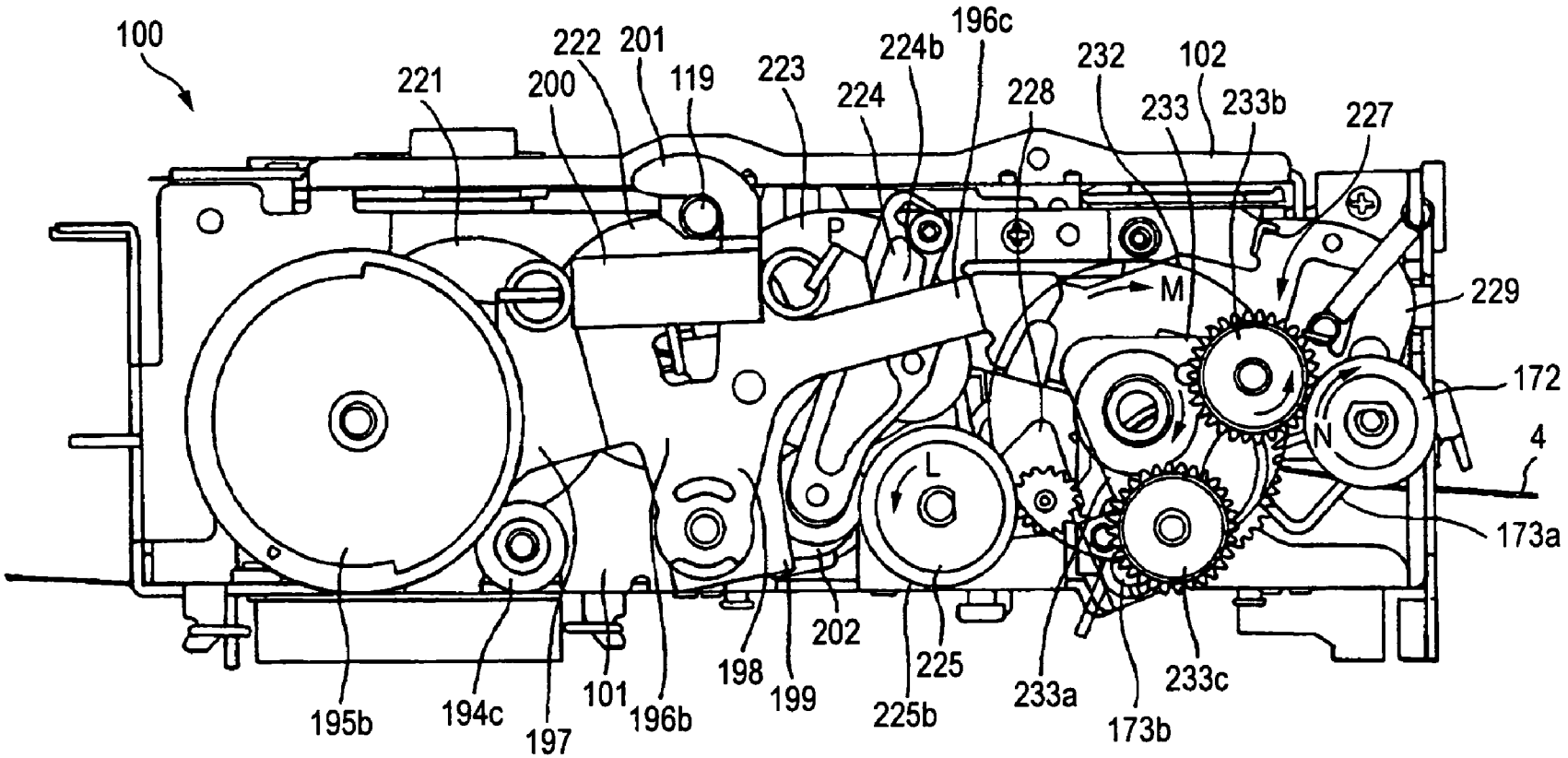
FIG. 33 is another side view of the transfer mechanism that feeds the printing papers.

Described next is the transfer mechanism 220 for transferring the printing paper 4 from/to inside to/from and outside of the device body 3. The transfer mechanism 220 is provided to the left side wall 111 of the base chassis 101, and as shown in FIGS. 32 and 33, includes a two-stage gear 221, a fifth coupling gear 222, a sixth coupling gear 223, a first swing gear 224, a capstan roller 225, a cam gear 226, and the gear string 227. The two-stage gear 221 is to be engaged with the motor gear 181*b* of the capstan motor 181. The fifth coupling gear 222 is to be engaged with the two-stage gear 221, and the sixth coupling gear 223 is to be engaged with the fifth coupling gear 222. The first swing gear 224 being coaxial to the sixth coupling gear 223 is supported thereby, and is moved to swing in the rotation direction of the sixth coupling gear 223. The capstan roller 225 is engaged with the first swing gear 224, and is used to transfer the printing paper 4. The cam gear 226 is provided to drive the press lever 173 in such a manner as to press it against the printing paper 4 in the printing paper tray 5. The gear string 227 is provided to drive the paper feed/eject roller 170.

The gear components, i.e., the two-stage gear 221, the fifth coupling gear 222, and the sixth coupling gear 223, are all supported by the left side wall 111 of the base chassis 101 to be able to freely rotate. The first swing gear 224 being coaxial to sixth coupling gear 223 is supported thereby, and includes a substantially-long plate 224*c*. The plate 224*c* is supported by, at substantially in the middle portion in the longitudinal direction, the sixth coupling gear 223 being coaxial thereto, and is moved to swing in the same direction as the rotation direction of the sixth coupling gear 223. The first swing gear 224 is formed with first and second gear portions 224*a* and 224*b* at one end of the plate 224*c* and at the middle portion thereof, respectively. Either of the first or second gear portion 224*a* or 224*b* is engaged with the capstan roller 225 depending on the swing direction of the plate, thereby rotating the capstan roller 225 in the forward or reverse direction.

The capstan roller 225 is extended across the left and right side walls 111 and 112 in the base chassis 101, and transfers the printing paper 4 from/to inside to/from outside of the device body 3 in accordance with the rotation direction thereof. This capstan roller 225 includes a roller body 225*a*, which is supported to be able to rotate around the support member protruding from the main surface 110 of the base chassis 101. As shown in FIG. 16, this roller body 225*a* is so disposed as to face a pinch roller 230, which is also supported parallel in the base chassis 101. The pinch roller 230 is supported by the right and left side walls 111 and 112 of the base chassis 101 to be able to freely rotate. The pinch roller 230 is also pressed against the capstan roller 225 by being supported by an arm member (not shown). The arm member is being biased by the spring member to rotate to the side of the capstan roller 225. When the transfer mechanism 220 is driven, the capstan roller 225 is rotated together with the pinch roller 230, and is transferred while sandwiching therewith the printing paper 4. The capstan roller 225 is provided with a roller gear portion 225*b* at an end portion facing outside of the left side wall 111. This roller gear portion 225*b* is engaged with the first and second gear portions 224*a* and 224*b* of the first swing gear 224, and receives the driving force of the capstan motor 181.

The capstan roller 225 is also provided with a second swing gear 228 that moves to swing in accordance with the rotation direction of the capstan roller 225 by being supported coaxially thereto. The second swing gear 228 includes an arm portion 228*a* coaxially supported by the capstan roller 225, and a gear portion 228*b* provided at the tip end of the arm portion 228*a*. The arm portion 228*a* moves to swing in the same direction as the rotation direction of the capstan roller 225, and moves the gear portion 228*b* to be close to or away from the cam gear 226. The gear portion 228*b* is always engaged with the roller gear portion 225*b* of the capstan roller 225, and when engaged with the cam gear 226, transfers the rotation force of the capstan roller 225 to the cam gear 226. In such a second swing gear 228, when the capstan roller 225 is rotated in the direction of an arrow L of FIG. 32, i.e., the direction of transferring the printing paper 4 to the side of the rear surface 3*c* of the device body 3, the arm portion 228*a* is rotated upward so that the gear portion 228*b* and the cam gear 226 are engaged together. In the second swing gear 228, when the capstan roller 225 is rotated in the direction opposite to an arrow L of FIG. 34, i.e., the direction of feeding the printing paper 4 to the side of the front surface 3*a* of the device body 3, the arm portion 228*a* is rotated downward so that the gear portion 228*b* and the cam gear 226 are moved to be away from each other.

The cam gear 226 to be engaged with the second swing gear 228 serves to press the printing paper 4 in the printing paper tray 5 against the side of the paper feed/eject roller 170 by operating the press lever 173 to move up and down. The cam gear 226 is supported by the left side wall 111 of the base chassis 101 to be able to freely rotate, and is formed with a cam groove on the side surface facing the left side wall 111 for engagement with the engagement convex section 174 formed to the axis portion 173*b* of the press lever 173.

When the capstan roller 225 is rotated in the direction of an arrow L of FIG. 32, i.e., the direction of transferring the printing paper 4 into the device body 3, the cam gear 226 is engaged with the second swing gear 228 and then is rotated. As a result, in the press lever 173 in which the axis portion 173*b* is engaged with the cam groove of the cam gear 226, the press portion 173*a* is rotated upward, and the printing paper 4 housed in the printing paper tray 5 is pressed against the paper feed/eject roller 170. This accordingly directs, into the device body 3, only the printing paper 4 abutting the paper feed/eject roller 170 as is at the top of the pile of papers stacked on the printing paper tray 5.

Figure 34:
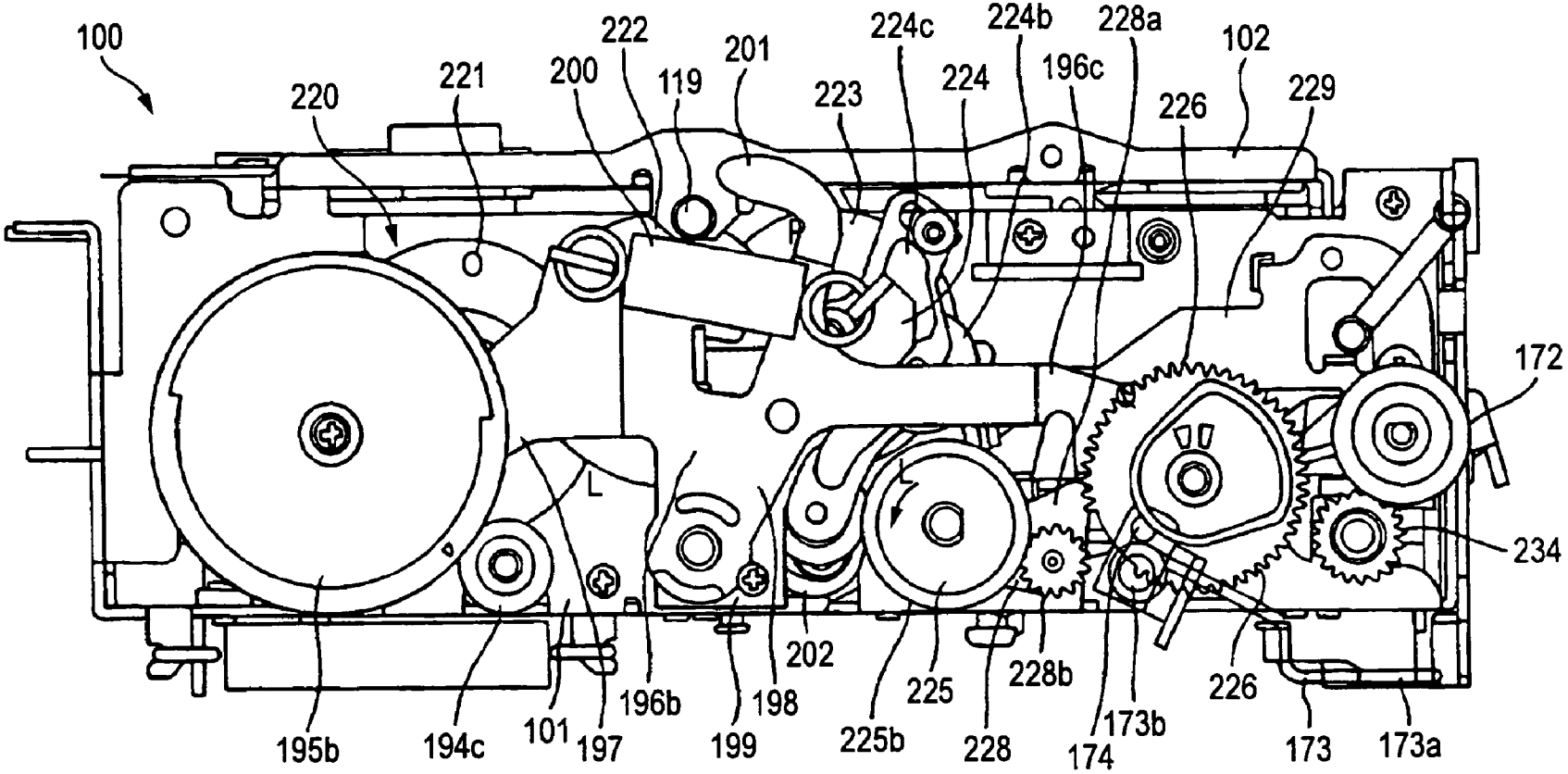
FIG. 34 is a side view of the transfer mechanism that puts back the printing papers.

The cam gear 226 is partially formed with no gear for use to release the engagement with the second swing gear 228. With such engagement release, the printing paper 4 is sandwiched by the capstan roller 225 and the pinch roller 230, and the press portion 173*a* of the press lever 173 is moved upward to the side of the paper feed/eject roller 170. Thereafter, when the platen roller 155 is moved down for ejecting the printing paper 4 to outside of the device body 3, the arm portion 196*c* of the left ascent/descent plate 196*b* is rotated downward. As a result, the cam gear 226 is pressed via a stopper piece 229, and is slightly rotated in the reverse direction. The press lever 173 being engaged with the cam gear 226 is thus guided by the cam groove so that the press portion 173*a* is moved down (FIG. 34). At this time, the second swing gear 228 is not caused to rotate in the reverse direction even if the cam gear 226 is rotated in the reverse direction as is away from the cam gear 226 by being pressed by the stopper piece 229. This accordingly puts the second swing gear 228 into the state ready for engagement with the cam gear 226 again. When the capstan roller 225 is rotated in the direction of an arrow L of FIG. 32 for the aim of directing the printing paper 4 into the device body 3 again, the second swing gear 228 and the cam gear 226 are rotated so that the press lever 173 is moved up.

Figure 35:
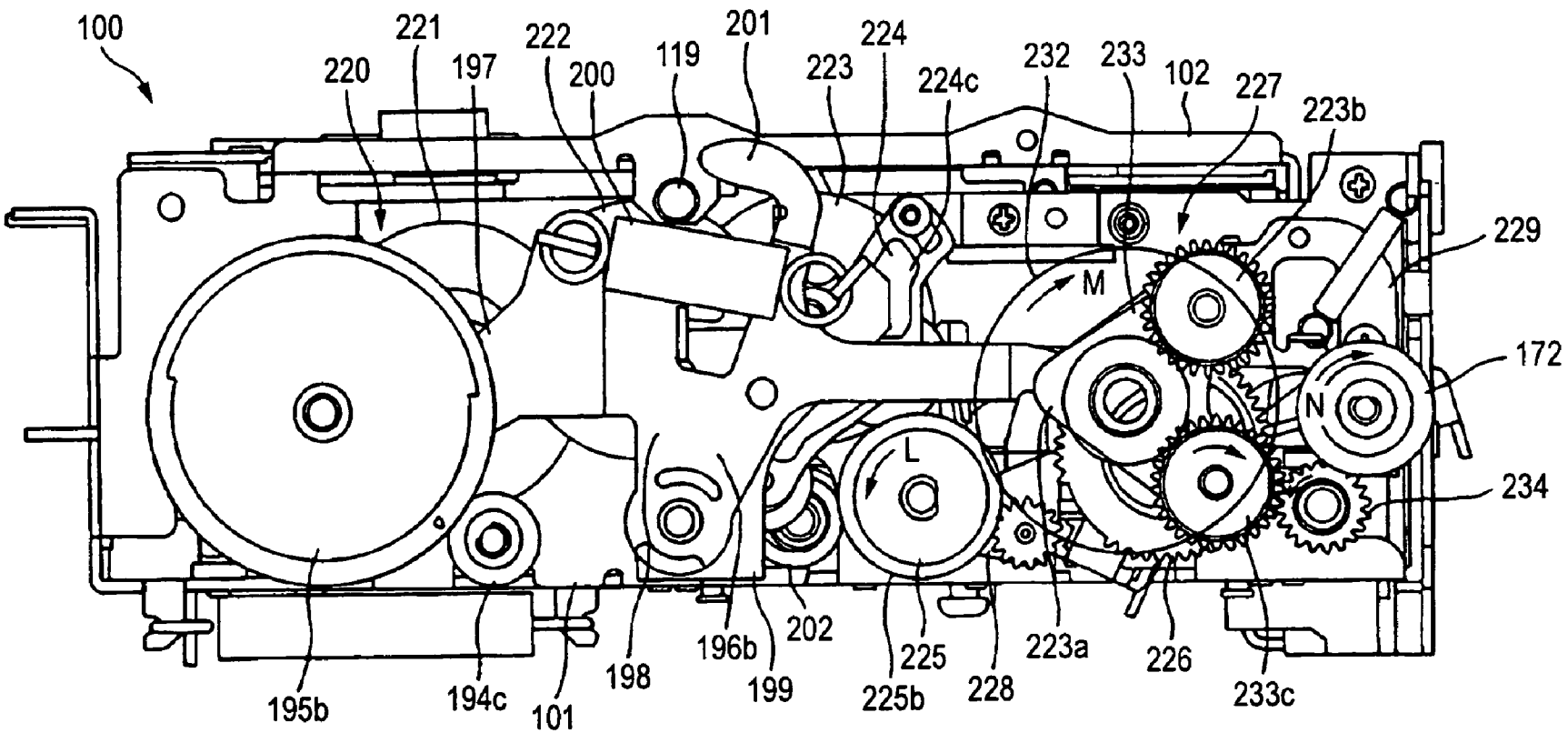
FIG. 35 is a side view of the transfer mechanism that ejects therefrom the printing papers.

As shown in FIGS. 33 and 35, the gear string 227 for driving the paper feed/eject roller 170 is provided with a seventh coupling gear 232, a third swing gear 233, and an eighth coupling gear 234. The seventh coupling gear 232 is to be engaged with the roller gear portion 225*b* of the capstan roller 225. The third swing gear 233 is supported coaxial to the seventh coupling gear 232, and is moved to swing in accordance with the rotation direction of the seventh coupling gear 232. The eighth coupling gear 234 is to be engaged with both the third swing gear 233 and a paper feed/eject gear 172, which is formed to the axis portion 170*b* of the paper feed/eject roller 170.

The seventh coupling gear 232 is disposed at a position over the cam gear 226 by being attached to a support wall to be able to freely rotate. The support wall is the one attached to the left side wall 111 of the base chassis 101. The seventh coupling gear 232 is a two-stage gear, in which a large-diameter gear is engaged with the roller gear portion 225*b* of the capstan roller 225, and a small-diameter gear is engaged with the third swing gear 233. The third swing gear 233 engaged with the seventh coupling gear 232 as such includes a swing plate 233*a*, and first and second gear portions 233*b* and 233*c*. The swing plate 233*a* is coaxial to the seventh coupling gear 232, and is supported thereby to be able to swing. The first and second gear portions 233*b* and 233*c* are both provided to the swing plate 233*a* to be able to freely rotate. The swing plate 233*a* is so configured as to be able to swing in the direction same as the rotation direction of the seventh coupling gear 232. In accordance with the swing direction, the swing plate 233*a* moves the first gear portion 233*b* to be close to or away from the paper feed/eject gear 172, and moves the second gear portion 233*c* to be close to or away from the eighth coupling gear 234. The first and second gear portions 232*b* and 232*c* are always engaged with the small-diameter gear of the seventh coupling gear 232, and are rotated in accordance with the rotation of the seventh coupling gear 232. The eighth coupling gear 234 is engaged with or released from the second gear portion 233*c* by the second gear portion 233*c* of the third swing gear 233 being moved to swing to reach the position for engagement with the seventh coupling gear 232.

In such a gear string 227, when the capstan roller 225 is rotated in the direction of an arrow L of FIG. 33, i.e., the direction of transferring the printing paper 4 into the device body 3, the seventh coupling gear 232 is rotated in the direction of an arrow M of FIG. 33. As a result, in the third swing gear 233, the swing plate 233*a* is rotated in the same direction, the first gear portion 233*b* is engaged with the paper feed/eject gear 172 of the paper feed/eject roller 170, and the second gear portion 233*c* is moved away from the eighth coupling gear 234. When the seventh coupling gear 232 is rotated in the direction of an arrow M of FIG. 33, the paper feed/eject gear 172 rotates the paper feed/eject roller 170 in the direction of an arrow N of FIG. 33 via the first gear portion 233*b*, i.e., the direction of pulling in the printing paper 4 in the printing paper tray 5. At this time, the printing paper tray 5 is inserted with the press portion 173*a* of the press lever 173, and is moved upward. As such, the paper feed/eject roller 170 is allowed to direct, into the device body 3, the printing paper 4 sandwiched with the press lever 173.

In the gear string 227, when the capstan roller 225 is rotated in the direction of an arrow L of FIG. 35, i.e., the direction of ejecting the printing paper 4 to the outside of the device body 3, the seventh coupling gear 232 is rotated in the direction of an arrow M of the drawing. Through such rotation, in the third swing gear 233, the swing plate 233*a* is rotated in the same direction, the second gear portion 233*c* is engaged with the eighth coupling gear 234 that is already engaged with the paper feed/eject gear 172, and the first gear portion 233*b* is moved away from the paper feed/eject gear 172. When the seventh coupling gear 232 is rotated in the direction of a narrow M of FIG. 35, the paper feed/eject gear 172 is rotated in the direction of an arrow N in the drawing via the second gear portion 233*c* and the eighth coupling gear 234, i.e., the direction of ejecting the paper feed/eject roller 170 to the outside of the device body 3. At this time, because the printing paper 4 is transferred between the paper feed/eject roller 170 and the sub roller 171, the paper feed/eject roller 170 and the paper feed/eject gear 172 are rotated in the direction same as the direction of taking in the printing paper 4 from the printing paper tray 5.

The printer device 1 equipped with such a transfer mechanism 220 is of going through a printing operation by the printer paper 4 being reciprocated, for a plurality of times, between the front surface 3*a* and the rear surface 3*c* of the device body 3 by the transfer mechanism 220. During such a printing operation of the printer device 1, the transfer mechanism 220 goes through various operations, i.e., paper feeding operation, image printing operation, paper putting-back operation, and paper ejecting operation. The paper feeding operation is of pulling out the printing paper 4 from the printing paper tray 5 and directing the paper into the device body 3. The image printing operation is of printing the printing paper 4 while transferring the paper being at the side of the rear surface 3*c* of the device body 3 to the side of the front surface 3*a* thereof. The paper putting-back operation is of transferring the printing paper 4 being at the side of the front surface 3*a* to the side of the rear surface 3*c* for image printing again. The paper ejecting operation is of ejecting the printing paper 4 through with image printing to the front surface 3*a* of the device body 3.

As shown in FIG. 32, in the paper feeding operation, the platen roller 155 is moved up by the switch/running motor 180 being driven in the forward direction. The capstan roller 181 is then driven in the forward direction, and the two-stage gear 221 is rotated in the direction of an arrow O of FIG. 32. In response, the sixth coupling gear 223 is rotated in the direction of an arrow P of FIG. 32 via the fifth coupling gear 222 being engaged with the two-stage gear 221, and the first swing gear 224 being coaxially supported by the sixth coupling gear 223 is moved to swing in the same direction. This accordingly engages the first gear portion 224*a* of the first swing gear 224 with the capstan roller 225, and rotates the roller body 225*a* of the capstan roller 225 in the direction of an arrow L of FIG. 32, i.e., the direction of transferring the printing paper 4 to the side of the rear surface 3*c* of the device body 3. When the roller body 225*a* is rotated in the direction of an arrow L of FIG. 32, in the second swing gear 228 being coaxially supported by the capstan roller 225, the arm portion 228*a* is moved to swing in the same direction, and the gear portion 228*b* is engaged with the cam gear 226. When receiving the driving force via the gear portion 228*b*, the cam gear 226 is rotated in the direction of an arrow Q of FIG. 32. In the press lever 173 being engaged with the cam gear 226, the press portion 173*a* is rotated upward so that the printing paper 4 in the printing paper tray 5 is pressed against the paper feed/eject roller 170.

On the other hand, when the capstan roller 225 is rotated in the direction of an arrow L of FIG. 33, the seventh coupling gear 232 being engaged with the roller body 225*a* of the capstan roller 225 is rotated in the direction of an arrow M. In response, in the third swing gear 233 being coaxially supported by the seventh coupling gear 232, the swing plate 233*a* is moved to swing in the same direction, and the first gear portion 232*b* is engaged with the paper feed/eject gear 172 of the paper feed/eject roller 170. When receiving the driving force via the first gear portion 232*b*, in the paper feed/eject roller 170, the paper feed/eject gear 172 and the roller portion 170*a* are rotated in the direction of an arrow N of FIG. 33. At this time, as the printing paper 4 housed in the printing paper tray 5 is located below the paper feed/eject roller 170, the printing paper 4 is transferred to the side of the rear surface 3*c* of the device body 3 by the paper feed/eject roller 170 being rotated in the direction of an arrow N of FIG. 33.

Figure 36:
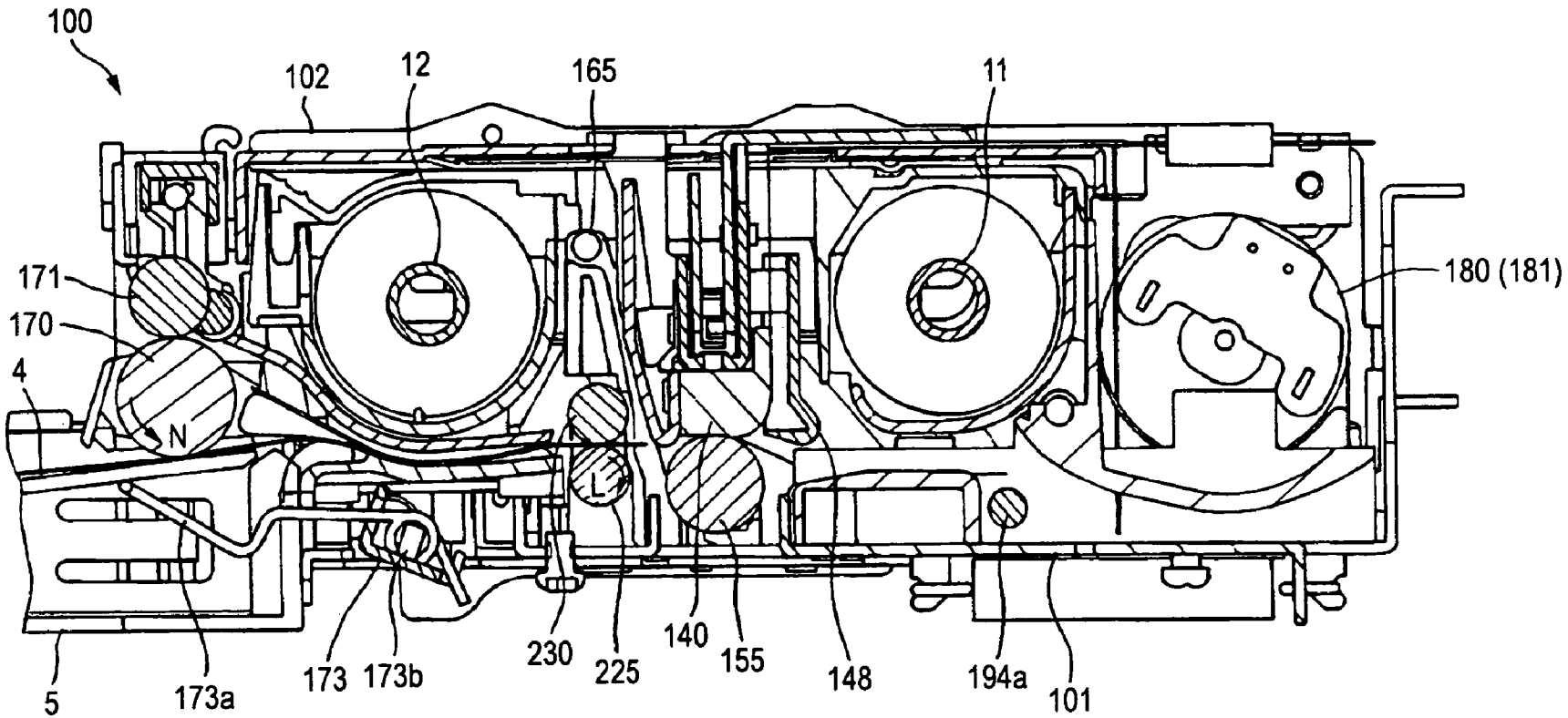
FIG. 36 is a cross sectional view of the printer device to be provided with the printing papers.

As such, as shown in FIG. 36, after the printing paper 4 in the printing paper tray 5 is transferred to the side of the rear surface 3*c* of the device body 3, the paper 4 is sandwiched by the capstan roller 225 and the pinch roller 230. The procedure then returns to the paper putting-back operation, and when the capstan roller 225 is rotated in the direction of an arrow L of the drawing, the printing paper 4 is transferred, to a further degree, to the side of the rear surface 3*c* of the device body 3.

Figure 37:
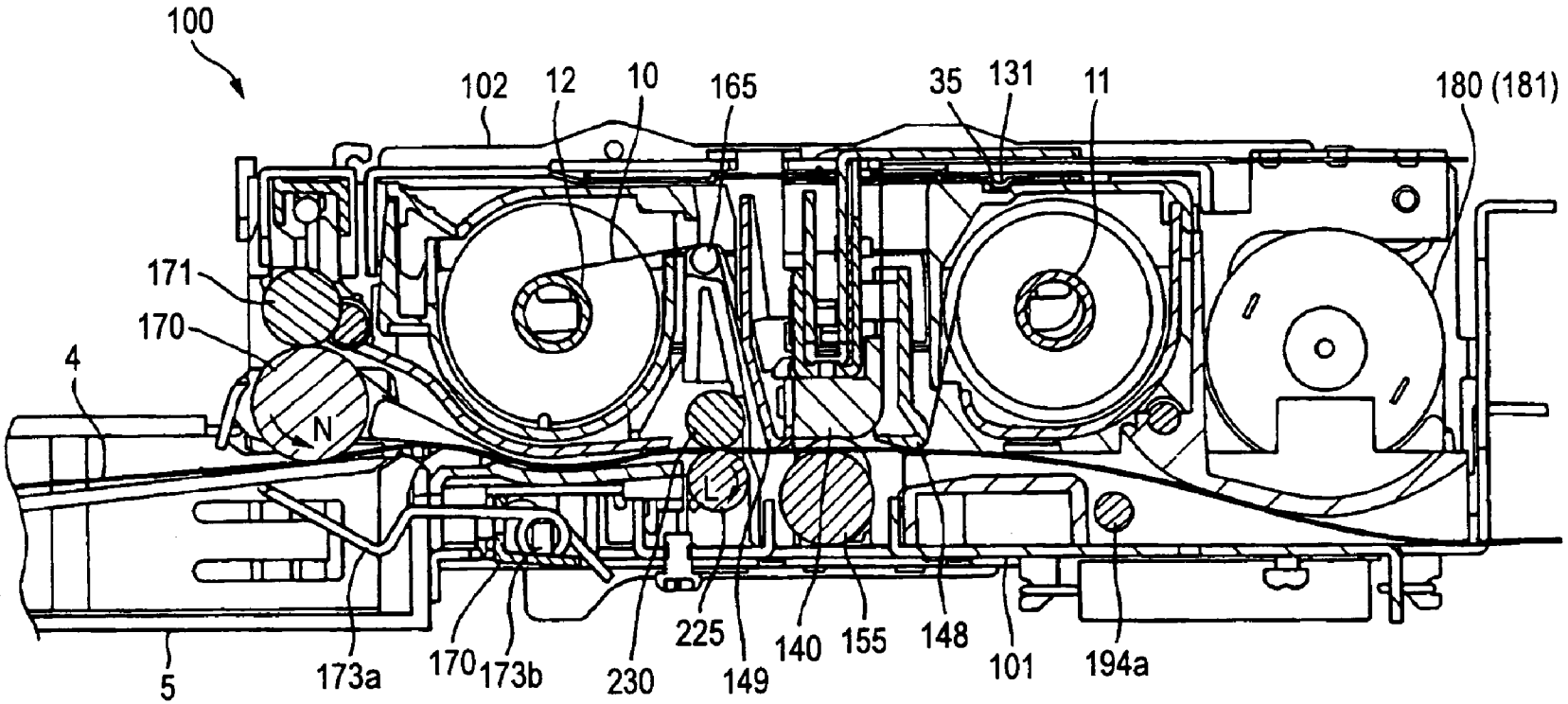
FIG. 37 is another cross sectional view of the printer device to be provided with the printing papers.

In the paper putting-back operation, in the printer device 1, the pair of right and left cam gears 195 are rotated to a further degree by the switch/running motor 180 rotating to a further degree in the forward direction. The ascent/descent plate 196 guided by the cum gears 195 is then rotated so that the platen roller 155 is moved down. As shown in FIG. 37, the thermal head 140 and the platen roller 155 are thus moved away from each other, thereby leaving a transfer space for the printing paper 4. When the capstan roller 225 is rotated in the direction of an arrow L of FIG. 37, the printing paper 4 is transferred to the side of the rear surface 3*c* of the device body 3. When the printing paper 4 reaches at a predetermined position, the capstan roller 225 is stopped in operation by the control of a photo sensor and an encoder. The photo sensor is used for edge detection of the printing paper 4, and the encoder is used to count the rotation of the capstan roller 225.

Figure 38:
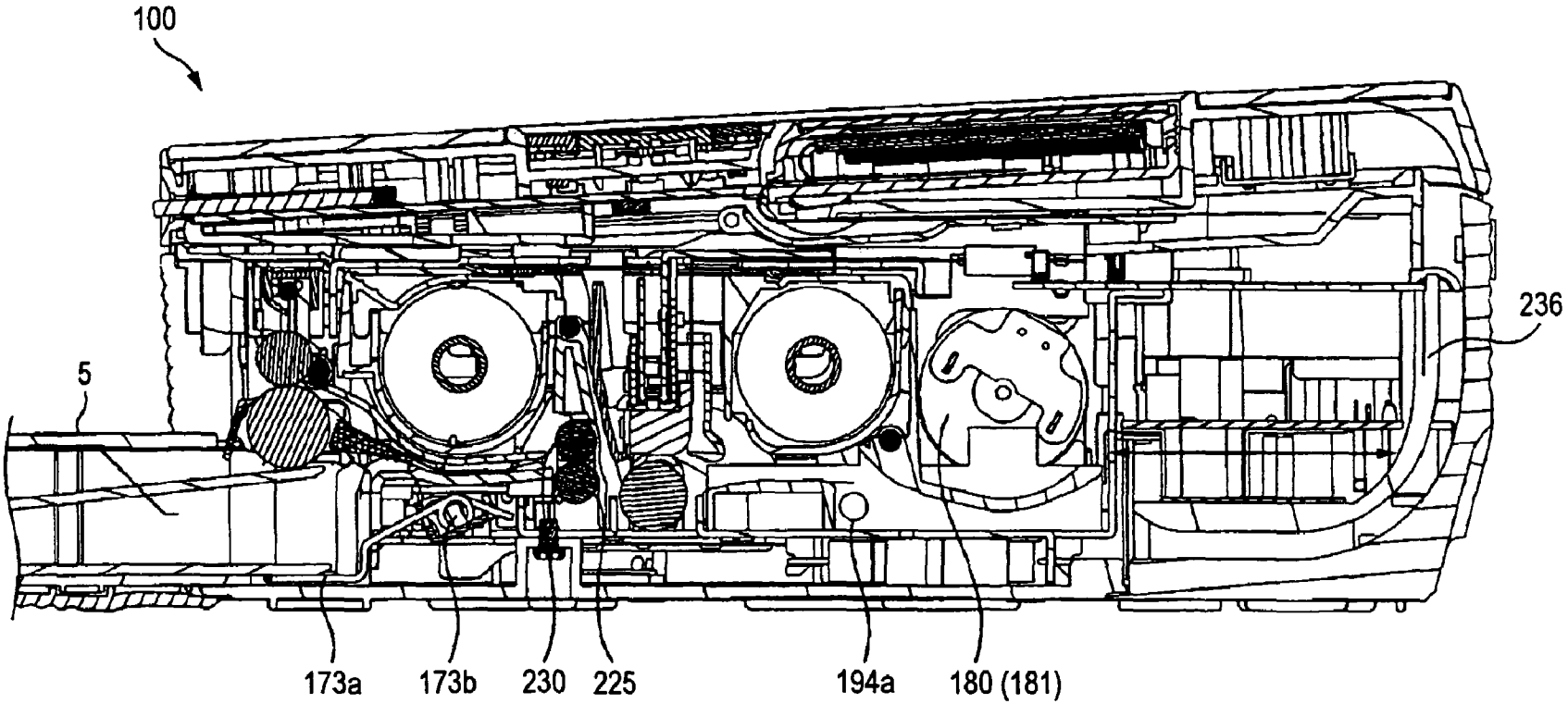
FIG. 38 is a cross sectional view of the device body of the printer device.

As shown in FIG. 38, the main chassis 100 of the printer device 1 is formed smaller than the device body 3 in the fore and aft direction, and its end surface on the rear surface is disposed with a determined clearance C from the rear surface wall of the device body 3. This clearance C is formed with an arc-shaped guide wall 236 for use to guide the printing paper 4 to be above the device body 3 when the printing paper 4 reached at the side of the rear surface 3*c* of the device body 3 is ejected from the rear surface of the main chassis 100. Because the guide wall 236 is so disposed that its curved inner surface is faced to the side of the front surface 3*a* of the device body 3, the printing paper 4 coming to the side of the rear surface 3*c* of the device body 3 is guided upward while being moved to slide. With such a configuration, when the printing paper 4 comes to the side of the rear surface 3*c* of the device body 3, the printing paper 4 is curved and housed in the clearance C between the rear surface of the device body 3 and the main chassis 100 while being guided by the guide wall 236. As such, the printer device 1 can be favorably reduced in size with no size increase of the device body 3 in the fore and aft direction even if the printing paper 4 is transferred in the fore and aft direction.

While the printing paper 4 is being transferred to the side of the rear surface 3*c* of the device body 3, the switch/running motor 180 is driven in the reverse direction so that the head edge of the ink ribbon 10 is found. Thereafter, the coloring material layer 10*b* of yellow (Y) is disposed between the thermal head 140 and the platen roller 155, for example.

Figure 39:
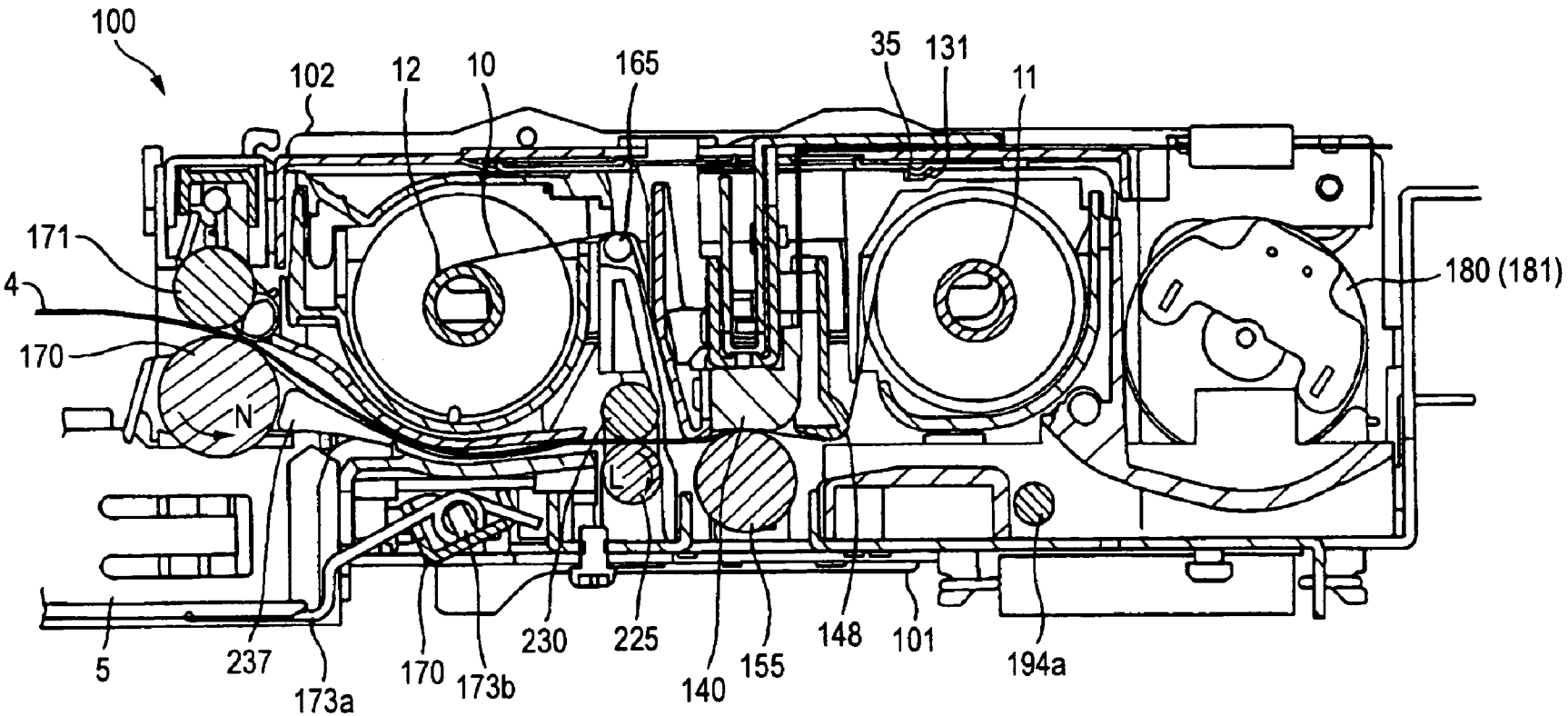
FIG. 39 is a cross sectional view of the printer device that performs image printing to the printing papers.

In the image printing operation, in the printer device 1, the right and left cam gears 195 are rotated to a further degree by the switch/running motor 180 being driven in the forward direction to a further degree. In response, the ascent/descent plates 196 guided by the cam gears 195 are rotated so that the platen roller 155 is moved up. As a result, as shown in FIG. 39, the printing paper 4 and the ink ribbon 10 are both sandwiched by the thermal head 140 and the platen roller 155.

The capstan motor 181 is then driven in the reverse direction, and the two-stage gear 221 is rotated in the direction opposite to an arrow O. In response, the sixth coupling gear 233 is rotated in the direction opposite to an arrow P via the fifth coupling gear 222 being engaged with the two-stage gear 221, and the first swing gear 224 coaxially supported by the sixth coupling gear 223 is moved to swing in the same direction. This moves the first gear portion 224*a* of the first swing gear 224 to be away from the capstan roller 225, and engages the second gear portion 224*b* with the capstan roller 225. In response, the roller body 225*a* of the capstan roller 225 is rotated in the direction opposite to an arrow L, i.e., the direction of transferring the printing paper 4 to the side of the front surface 3*a* of the device body 3.

When the capstan roller 225 is rotated in the direction opposite to an arrow L, the seventh coupling gear 232 being engaged with the roller body 225*a* of the capstan roller 225 is rotated in the direction opposite to an arrow M. In response, in the third swing gear 233 coaxially supported by the seventh coupling gear 232, the swing plate 233*a* is moved to swing in the same direction so that the first gear portion 232*b* is moved away from the paper feed/eject gear 172, and the second gear portion 232*c* is engaged with the eighth coupling gear 234. Because the eighth coupling gear 234 is engaged with the paper feed/eject gear 172, when the capstan roller 225 is driven, the paper feed/eject roller 170 is rotated via the seventh and eighth coupling gears 232 and 234.

As to the paper feed/eject gear 172 coupled with the seventh coupling gear 232 via the eighth coupling gear 234, when the seventh coupling gear 232 is rotated in the direction opposite to an arrow M, the paper feed/eject gear 172 and the roller portion 170*a* are rotated in the direction of an arrow N. After being transferred to the side of the front surface 3*a* of the device body 3 by being sandwiched between the capstan roller 225 and the pinch roller 230, the printing paper 4 is so guided as to be directed between the paper feed/eject roller 170 and the sub roller 171 by a flapper 237 disposed to the main surface 110 of the base chassis 101 (refer to FIG. 39). As such, because the printing paper 4 is transferred above the paper feed/eject roller 170, the paper feed/eject roller 170 is rotated in the direction of an arrow N so that the tip end portion of the printing paper 4 is directed outside from the front surface 3*a* of the device body 3.

Note here that when the roller body 225*a* is rotated in the direction opposite to an arrow L, in the second swing gear 228 being coaxially supported by the capstan roller 225, the arm portion 228*a* is moved to swing in the same direction, and the gear portion 228*b* is moved away from the cam gear 226 (FIG. 35).

As described above, in the printer device 1, the thermal head 140 performs thermal transfer in the process of transferring the printing paper 4 from the rear surface 3*c* of the device body 3 to the side of the front surface 3*a* thereof so that images are printed. Such a printing job is executed by thermally transferring the ink ribbon 10, i.e., the coloring material layers 10*b* to lad of yellow (Y), magenta (M), and cyan (C) and the protection layer 10*e*, to the printing paper 4. Every time the printing paper 4 is transferred once from the rear surface 3*c* to the front surface 3*a*, the thermal transfer takes place for one coloring material layer or the protection layer. It means that, for printing of an image, the printing image 4 is reciprocated for four times between the front surface 3*a* and the rear surface 3*c* of the device body 3.

When the fourth reciprocating movement of the printing paper 4 is completed from the rear surface 3*c* to the front surface 3*a*, and when the thermal transfer of the protection layer 10*e* is completed, the procedure goes to the paper ejecting operation. In the paper ejecting operation, the platen roller 155 is moved down by the switch/running motor 180 being driven in the forward direction, and the platen roller 155 and the thermal head 140 having been sandwiching the ink ribbon 10 and the printing paper 4 therebetween are moved away from each other. Thereafter, by the capstan roller 181 being driven as in the image printing operation, the capstan roller 225 is. rotated in the direction opposite to an arrow L, and the paper feed/eject roller 170 is rotated in the direction of an arrow N. In response to such rotations, the image-printed printing paper 4 is ejected onto the printing paper tray 5 from the paper feed/eject roller 170 and the sub roller 171. When the printing paper 4 is determined as being ejected through edge detection made by a sensor for the printing paper 4, the driving of the capstan motor 181 is stopped.

Described next is the operation of the printer device 1, i.e., the operation from attachment of the ink ribbon cartridge 2 to the ejection thereof with the image printing operation in the process. During standby for the image printing operation, in the printer device 1, by the engagement member provided to the front surface wall 113 of the base chassis 101 being engaged with the first latching protrusion section 118 protruding from the top chassis 102, the top plate 6 and the top chassis 102 are closed as opposing the biasing force of the twisted coil spring 116. Also in the printer device 1, the ascent/descent plate 196 of the switch mechanism 190 is moved to swing in the direction of an arrow J of FIG. 27 so that the platen roller 155 is moved down. As to the ascent/descent plate 196, the engagement is released between the latching piece 201 and the second latching protrusion sections 119. Herein, the latching piece 201 is the one provided above the engagement plate 198, and the second latching protrusion sections 119 are those formed on the right and left side surfaces of the top chassis 102.

For attachment of the ink ribbon cartridge 2, the open button 107 provided to the front surface 3*a* of the device body 3 is made to slide to rotate upward the top plate 6. By the open button 107 being slid as such, the engagement is released between the engagement member of the base chassis 101 and the first latching protrusion section 118 of the top chassis 102. As a result, the twisted coil spring 116 rotates upward the top chassis 102 and the top plate 6, and the ink ribbon cartridge holder 7 is made to face outside from the side of the front surface 3*a* of the device body 3 (FIG. 2).

The ink ribbon cartridge 2 is inserted into the ink ribbon cartridge holder 7 by the holding section 32 being held by a user (FIG. 3). The holding section 32 is the one formed to the front surface portion 13*a* of the cartridge body 13. When the ink ribbon cartridge 2 is inserted as such, the guide sections 31 bulging from the right and left side surfaces are supported, on their upper and lower surfaces and side surfaces, by the guide support section 125 having the cross section shaped substantially like a laterally-inverted-letter-U. With the holding section 32 formed to the ink ribbon cartridge 2 as such, the holding section 32 is held by the user with his or her thumb placed on the upper surface thereof, and with his or her index finger placed to the lower surface thereof. This accordingly explicitly indicates the insertion direction to the ink ribbon cartridge holder 7. In the ink ribbon cartridge holder 7, the to-be-pressed section 66 of the spool lock 61 is pressed against the reception portion 125*a* of the guide support section 125. The spool lock 61 here is the one protruding below the aperture sections 33 punched in the lower surface of the guide sections 31. As such, the spool lock 61 releases the engagement between the latchet portions 65*a* and 65*b* of the elastic engagement pieces 64*a* and 64*b* and the latchet gears 17 and 17 of the supply spool 11 and the take-up spool 12, and allows the supply spool 11 and the take-up spool 12 to rotate. In the ink ribbon cartridge 2, the concave section 35 provided to the upper surface 13*b* of the cartridge body 13 for temporary positioning use is engaged with the convex section 131 protruding below the coupling section 126 of the ink ribbon cartridge holder 7 also for temporary positioning use. Through such engagement, the ink ribbon cartridge 2 is temporarily positioned inside of the ink ribbon cartridge holder 7. As such, after the top chassis 102 is closed to the side of the base chassis 101, the insertion is eased for the first and second positioning convex sections 162 and 163 protruding in the device body 3 into the positioning holes 72 and 73 provided to the lower surface portion 13*c* of the cartridge body 13 so that the positioning of the ink ribbon cartridge 2 is favorably eased.

At this time, by the protection plate 132 formed to the coupling section 126 of the ink ribbon cartridge holder 7 being rotated upward, the thermal head 140 provided to the top chassis 102 is covered thereby, and is made not visible from the front surface 3*a* for users. As such, the protection plate 132 serves to prevent the head section 143 of the thermal head 140 from getting dirty by the users' erroneous touch, or protect the users from injuries, e.g., accidental touching to the head section 143 being hot if it is immediately after the image printing operation (FIG. 2).

As such, the printer device 1 is so configured as to allow the ink ribbon cartridge 2 to be attached to and removed from the side of the front surface 3*a* of the device body 3. With such a configuration, compared with a printer device in which an ink ribbon cartridge is inserted to and removed from the side surface of the device body 3, there is no more need to keep some space for insertion and removal of the ink ribbon cartridge 2. The printer device 1 thus does not need that much space for placement. What is more, because there is no insertion/removal port for the ink ribbon cartridge 2 on the right and left side surfaces of the device body 3, the printer device 1 allows disposition of the components on the right and left side surfaces, i.e., the running mechanism 210 for the ink ribbon 10, and the transfer mechanism 220 for the printing paper 4, whereby the device body 3 can be favorably reduced in size.

Closing the top plate 6 moves the ink ribbon cartridge 2 attached to the ink ribbon cartridge holder 7 to the printing position of the device body 3. The ink ribbon cartridge 2 is positioned at the printing position when the positioning holes 72 and 73 punched in the placement surface 70 of the cartridge body 13 are inserted with the first and second positioning convex portions 162 and 163 protruding from the cartridge support unit 160 disposed in the device body 3.

To be specific, when the top plate 6 is closed, the first latching protrusion section 118 provided to the front side surface of the top cover 102 is latched by the latching member disposed to the front surface wall 113 of the base chassis 101 so that the device body 3 is closed as opposing the biasing force of the twisted coil spring 116. At this time, in the ink ribbon cartridge holder 7 attached to the top chassis 102, the protection plate 132 provided to the coupling section 126 is sandwiched between the top chassis 102 and the coupling section 126. Because the press piece 133 always has the biasing force of rotating upward the protection plate 132 upward against the coupling section 126, the protection plate 132 is pressed by the top chassis 102 in the direction opposite to the biasing direction by the press piece 133. Accordingly, the biasing force of the press piece 133 acts in the opposite direction, i.e., downward against the ink ribbon cartridge holder 7 and the ink ribbon cartridge 2, and presses the cartridge body 13 to the cartridge support unit 160 in the device body 3. In the cartridge body 13, the placement surface 70 is thus supported by the support surface section 166 of the cartridge support unit 160 without fail, and is positioned in the device body 3. At the same time, the upper and lower shells 21 and 22 configuring the cartridge body 13 are both biased in the direction of abutting together. Therefore, the support wall 42 of the bearing sections 25 to 28 formed to the lower shell 22 to support the spindle sections 16 and the protrusion sections 18 of the supply spool 11 and the take-up spool 12 are tightly attached to the support pieces 43 to 46 formed to the upper shell 21 corresponding to the support wall 42. Through such abutting, the spindle sections 16 and the protrusion sections 18 of the supply spool 11 and the take-up spool 12 are supported in all directions by the bearing sections 25 to 28 and the support pieces 43 to 46. Accordingly, the supply spool housing section 23 or the take-up spool housing section 24 can be precise in height (FIG. 8).

The ink ribbon cartridge 2 is defined by type through detection of the state of the ID hole(s) 74 formed to the placement surface 70, i.e., whether open or not, using the detection switch(es) 164 provided to the cartridge support unit 160. For example, the ink ribbon cartridge 2 is defined by type whether it is wound with the wide ink ribbon 10W or with the narrow ink ribbon 10N.

When the ink ribbon cartridge 2 is moved to the printing position of the device body 3, the top chassis 102 is rotated to the side of the base chassis 101 together with the top plate 6. In response, the aperture section 40 is inserted with the thermal head 140 provided to the top chassis 102 and the ribbon guide 165 protruding from the main surface 110 of the base chassis 101. Herein, the aperture section 40 is the one provided between the supply spool housing section 23 and the take-up spool housing section 24 of the cartridge body 13. As a result, for the ink ribbon 10 placed across the supply spool 11 and the take-up spool 12 and extended to the aperture section 40, a ribbon path is formed by the thermal head 140 and the guide roller 168 of the ribbon guide 165. This ribbon path works as a running path in the device body 3. That is, to form such a ribbon path, only moving the ink ribbon cartridge 2 attached to the ink ribbon cartridge holder 7 to the printing position will do. This accordingly eliminates the need, after the ink ribbon cartridge 2 is attached at the printing position, for configuring in advance a ribbon path in the device body 3, and the need for going through the operation of forming a ribbon path or any member taking charge of such an operation.

To be specific, when the thermal head 140 is inserted into the aperture section 40, the ink ribbon 10 is guided by the head cover 148 formed to the rear surface side of the head section 143, and the cover member 149 formed to the front surface side of the head section 143. After guided as such, the ink ribbon 10 is supported at the height substantially the same as the head section 143, and is allowed to run in the horizontal direction. Accordingly, the ink ribbon 10 is directed substantially parallel to the printing paper 4 that is transferred by the transfer mechanism 220 from the side of the rear surface 3*c* to the side of the front surface 3*a*. This thus enables to tightly attach the ink ribbon 10 to the printing paper 4 to a further extent so that the printer device 1 can have better printing characteristics. Moreover, because the ribbon guide 165 protruding from the main surface 110 of the base chassis 101 is inserted into the aperture section 40 from the opposite direction where the thermal head 140 is located. Through such insertion, the ink ribbon 10 is made to stand steeply by the guide roller 168 formed to the upper end of the ribbon guide 165, i.e., from the height substantially the same as the head section 143 to the height substantially the same as the slit 50 of the take-up spool housing section 24. This thus enables the ink ribbon 10 to be peeled off from the printing paper 4 with efficiency, i.e., after thermally transferred to the printing paper 4 by being heated by the head section 143, the ink ribbon 10 is cooled while being guided by the cover member 149, and then is made to stand steeply.

In this case, the thermal head 140 and the platen roller 155 are disposed to face each other with a predetermined distance therebetween, and the slide-contact section 151 of the sliding pieces 150 protruding from the both sides of the thermal head 140 are faced to the flange sections 156 provided to the both end portions of the platen roller 155 in the longitudinal direction with a predetermined distance therebetween (FIG. 30A).

When the ink ribbon cartridge 2 is attached at the printing position, the second gear portion 212*d* of the ink ribbon running gear 212 provided in the device body 3 is engaged with the latchet gear 17 being faced outside from the gear-use aperture section 48 formed to the take-up spool housing section 24 so that the take-up spool 12 is allowed to freely rotate (FIG. 26). At this time, the take-up gear 138 provided in the device body 3 is engaged with the latchet gear 17 being faced outside from the gear-use aperture section 47 formed to the supply spool housing section 23 (FIG. 22).

In the ink ribbon cartridge 2, the guide sections 31 to be supported by the guide support section 125 of the ink ribbon cartridge holder 7 are bulged toward the side surfaces of the cartridge body 13 at the height higher than the lower surface of the cartridge body 13. This thus enables to keep a space below the guide section 31 and the guide support section 125 supporting the guide sections. In the printer device 1, the area below such a guide support section 125 is disposed with the second gear portion 212*d* of the ink ribbon running gear 212, the roller body 225*a* of the capstan roller 225, and the both end portions of the pinch roller 230. By utilizing such a space, the device body 3 is accordingly reduced in size.

The procedure then goes to the printing operation for images. In the printing operation, first of all, the printing paper tray 5 is attached to the aperture section 8 formed to the side of the front surface 3*a* of the device body 3. At this time, in the printing paper tray 5, the press portion 173*a* of the press lever 173 is inserted at the bottom surface of the tray (FIG. 38). Thereafter, through operation of the operation panel 104, the LCD panel 105 is used for selection of images for printing, paper size, the number of copies, the image quality, or others, and the printing job is started. The LCD panel 105 displays thereon images provided by various types of recording media, personal computers, and others.

In response to the operation to start printing, a paper feeding operation is first executed to feed the printing paper 4 in the printing paper tray 5. In the paper feeding operation, as shown in FIG. 32, by the switch/running motor 180 being driven in the forward direction, the ascent/descent plate 196 is rotated in the direction of moving up the platen roller 155. In response, in the second swing gear 228, the arm portion 228*a* is allowed to swing upward, and the gear portion 228*b* is ready to be engaged with the cam gear 226. Herein, the second swing gear 228 is the one coaxially supported by the capstan roller 225, and is engaged with the cam gear 226.

Thereafter, by the capstan motor 181 being driven in the forward direction, the capstan roller 225 is rotated in the direction of an arrow L of FIG. 32, and the paper feed/eject roller 170 is rotated in the direction of an arrow N of FIG. 33. Moreover, by the capstan roller 225 being driven in the direction of an arrow L as such, the arm portion 228*a* of the second swing gear 228 is rotated in the same direction, and the gear portion 228*b* is engaged with the cam gear 226. Because the cam gear 226 is then rotated in the direction of an arrow Q of FIG. 32, in the press lever 173 being engaged with the cam groove of the cam gear 226, the press portion 173*a* is rotated upward so that the printing paper 4 in the printing paper tray 5 is pressed against the paper feed/eject roller 170.

As a result, the printing paper 4 located at the top of the pile of papers stacked in the printing paper tray 5 is directed into the device body 3 by the roller portion 170*a* of the paper feed/eject roller 170, and is passed to the capstan roller 225 and the pinch roller 230. Note that, at this time, the printing paper 4 goes below the flapper 237 disposed to the main surface 110 of the base chassis 101.

After the paper feeding operation, the procedure goes to the paper putting-back operation. In the paper putting-back operation, the platen roller 155 is moved down by the switch/running motor 180 being driven in the forward direction, and forms a transfer space for the printing paper 4 with the thermal head 140 (FIG. 30A). As the capstan roller 225 is rotated in the direction of an arrow L of FIG. 37, the printing paper 4 is directed to the side of the rear surface 3*c* of the device body 3. When the printing paper 4 reaches at a predetermined position, the capstan roller 225 is stopped in operation by the control of a photo sensor and an encoder. The photo sensor is used for edge detection of the printing paper 4, and the encoder is used to count the rotation of the capstan roller 225.

While the printing paper 4 is being transferred to the side of the rear surface 3*c* of the device body 3, the switch/running motor 180 is driven in the reverse direction so that the head edge of the ink ribbon 10 is found, and the coloring material layer 10*b* of yellow (Y) is disposed between the thermal head 140 and the platen roller 155, for example.

Note that because the cam gear 226 is rotated by the gear portion 228*b* of the second swing gear 228, when the cam gear 226 is rotated to the portion not engaged with the gear portion 228*b*, the rotation is stopped. At this time, the press portion 173*a* of the press lever 173 is being rotated upward. Then in the paper putting-back operation, when the arm portion 196*c* of the left ascent/descent plate 196*b* is rotated downward, the cam gear 226 is pressed via the stopper piece 229, and is slightly rotated in the reverse direction. As to the second swing gear 228, the arm portion 228*a* is also rotated downward so that the cam gear 226 and the gear portion 228*b* are put in the state ready for engagement with the cam gear 226 again. By the cam gear 226 being rotated in the reverse direction, the engagement of the press leer 173 with the cam groove of the cam gear 226 is released for once, and the press portion 173*a* is rotated downward by the biasing force of the coil spring.

After the paper putting-back operation, the procedure goes to the image printing operation. In the image printing operation, by the switch/running motor 180 being driven in the forward direction to a further degree, the platen roller 155 is moved up. The platen roller 115 thus pinches the ink ribbon 10 and the tip end portion of the printing paper 4 together with the head section 143 of the thermal head 140. At this time, the flange sections 156 provided to the rotation axis 155*a* of the platen roller 155 slide in contact with the slide-contact sections 151 of the sliding pieces 150 provided to both sides of the thermal head 140. As such, because the flange sections 156 are guided by the sliding pieces 150, the platen roller 155 can face and abut the head section 143 of the thermal head 140 with high accuracy (FIG. 30B).

Thereafter, the capstan motor 181 is driven in the reverse direction, and the roller body 225*a* of the capstan roller 225 is rotated in the direction opposite to an arrow L, i.e., the direction of transferring the printing paper 4 to the side of the front surface 3*a* of the device body 3. The thermal head 140 then thermally transfers the coloring material layer 10*b* of yellow (Y) while the printing paper 4 is being transferred to the side of the front surface 3*a*. As to the ink ribbon 10, by the switch/running motor 180 being driven in the reverse direction, and by the ink ribbon running gear 212 being driven, the take-up spool is rotated in the direction of an arrow D of FIG. 10 so that the ink ribbon 10 is made to run.

Note that the ink ribbon 10 is supported by a plurality of ribs 41 formed to the supply spool housing section 23 and the take-up spool housing section 24 in an intermittent manner. Therefore, the ink ribbon 10 can run smoothly in the cartridge body 13.

After the image printing operation, the procedure goes to the paper putting-back operation, and the printing paper 4 is directed to the side of the rear surface 3*c*. Also at this time, the platen roller 155 is moved down by the switch/running motor 180 being driven in the forward direction, and forms a transfer space for the printing paper 4 with the thermal head 140. As the capstan roller 225 is rotated in the direction of an arrow L of FIG. 37, the printing paper 4 is directed to the side of the rear surface 3*c* of the device body 3. During the paper putting-back operation, the head edge of the ink ribbon 10 is found, and the coloring material layer 10*c* of magenta (M) comes between the thermal head 140 and the platen roller 155

The procedure then goes to the image printing operation, and the platen roller 155 is moved up. The coloring material layer of magenta (M) is then thermally transferred while the printing paper 4 is being transferred to the side of the front surface 3*a*. Once the image printing of magenta (M) is through, the procedure returns to the paper putting-back operation, and the platen roller 155 is moved down. When the printing paper 4 is transferred to the side of the rear surface 3*c*, at the same time, the ink ribbon 10 is made to run, and the head edge of the coloring material layer 10*d* of cyan (C) is found. Similarly, the platen roller 155 is moved up, and the coloring material layer of cyan (C) is thermally transferred while the printing paper 4 is being transferred to the side of the front surface 3*a*. Once the image printing of cyan (C) is through, the procedure returns to the paper putting-back operation, and the platen roller 155 is moved down. When the printing paper 4 is transferred to the side of the rear surface 3*c*, at the same time, the ink ribbon 10 is made to run, and the head edge of the protection layer 10*e* is found.

After the transfer operation is through for the protection layer 10*e*, the procedure goes to the paper ejecting operation. In the paper ejecting operation, the platen roller 155 is moved down, and the thermal head 140 and the platen roller 155 stop sandwiching the printing paper 4 therebetween. The roller body 225*a* of the capstan roller 225 is rotated in the direction opposite to an arrow L, i.e., the direction of transferring the printing paper 4 to the side of the front surface 3*a* of the device body 3, and the paper feed/eject gear 172 is rotated in the direction of an arrow N in the drawing, i.e., the direction of ejecting the paper feed/eject roller 170 to the outside of the device body 3. The printing paper 4 to be transferred to the side of the front surface 3*a* of the device body 3 by the capstan roller 225 is so guided as to be directed between the paper feed/eject roller 170 and the subroller 171 by the flapper 237 disposed to the main surface 110 of the base chassis 101 (FIG. 39). As such, because the printing paper 4 goes above the paper feed/eject roller 170, the paper feed/eject roller 170 is rotated in the direction of an arrow N so that the printing paper 4 is directed outside from the front surface 3*a* of the device body 3, and is ejected onto the printing paper tray 5. When the printing paper 4 is ejected as such, the capstan motor 181 is stopped being driven, and waits for the next operation to start the printing job.

As such, according to the printer device 1, the platen roller 155 is so disposed as to be close to or away from the thermal head 140, and the printing paper 4 can be directed to the direction of the rear surface or the front surface in accordance with the rotation direction of the capstan roller 225. As such, depending on the combination, i.e., whether the platen roller 155 is ascended or descended and which direction the capstan roller 225 is rotated, the various modes are implemented, i.e., the paper feeding operation, the paper putting-back operation, the image printing operation, and the paper ejecting operation.

For ejecting the ink ribbon cartridge 2 from the device body 3, e.g., for exchanging the ink ribbon 10 after it is used up, the open button 107 provided to the front surface 3*a* of the device body 3 is made to slide. Because the open button 107 is being coupled with the latching member that is engaged with the first latching protrusion section 118 of the top chassis 102, sliding the open button releases the engagement between the latching member and the first latching protrusion section 118. As such, the top chassis 102 is rotated upward of the base chassis 101 when receiving the biasing force of the twisted coil spring 116 (FIG. 16).

Note that, at this time, because the printer device 1 is through with the image printing operation, the platen roller 155 is moved down for ejecting the printing paper 4. It means that in the ascent/descent plate 196 for use to move the platen roller 155 up and down, the engagement is released between the latching piece 201 provided to the engagement plate 198 and the second latching protrusion sections 119 formed to the right and left side surfaces of the top chassis 102.

When the top chassis 102 is rotated upward the base chassis 101, the ink ribbon cartridge holder 7 is rotated upward by being latched by the rotation protrusion section 136 protruding from the arm portion 135*a* of the coupling member 135 provided to the top chassis 102, and is made to face outside from the side of the front surface 3*a* of the device body 3. The rotation protrusion section 136 of the coupling member 135 is latched to the support piece section 127 after the top chassis 102 is rotated upward to some degree from the position where the base chassis 101 is closed, thereby rotating the ink ribbon cartridge holder 7. In the mean time after the top chassis 102 starts rotating upward but before the ink ribbon cartridge holder 7 starts rotating upward, the gear section 137 formed to the arm portion 135*a* of the coupling member 135 rotates the take-up gear 138 provided inside of the base chassis 101 in the direction of an arrow C of FIG. 21. In response to the take-up gear 138 being rotated in the direction as such, the latchet gear 17 of the supply spool 11 being engaged with the large-diameter gear 138*b* of the take-up gear 138 is rotated in the direction of an arrow C of FIG. 21. It means that the supply spool 11 is rotated in the direction of taking up the ink ribbon 10, and the sagged ink ribbon 10 on the way to the take-up spool 12 can be taken up. This allows the immediate ejection of the ink ribbon cartridge 2 after the top plate 6 is opened.

The ink ribbon cartridge 2 is pulled out from the ink ribbon cartridge holder 7 by the holding section 32 being held similarly to the case of attachment. The ink ribbon cartridge 2 pulled out from the ink ribbon cartridge holder 7 is controlled not to rotate in the direction of pulling out the ink ribbon 10 for storage with the aim of recycling or throwing away, and the ink ribbon 10 is thus prevented from sagging. This is because the latchet section 65 formed to the elastic engagement piece 64 of the spool lock 61 is engaged with the latchet gear 17 of the supply spool 11 and that of the take-up spool 12.

As such, described is the printer device to which the invention is applied. The invention is not restrictive to the above-described configuration, i.e., the ink ribbon cartridge holder 7 and the top chassis 102 are both supported to be able to rotate about the support protrusion sections 117, and the ink ribbon cartridge holder 7 is coupled with the top chassis 102 via the rotation protrusion section 136 of the coupling member 135 so that the ink ribbon cartridge holder 7 is rotated above the base chassis 101. As an alternative configuration, like a pop-up videocassette holder for use for videocassette recorders or video cameras, an ascent/descent mechanism including a pantograph mechanism or link mechanism may be used for moving either the ink cartridge holder 7 or the top chassis 102 or both of these against the base chassis 101.

In the above embodiment, the ink ribbon cartridge holder 7 is coupled to the coupling member 135 via the rotation protrusion section 136, and when the top chassis 102 is moved upward, the ink ribbon cartridge 7 is also moved upward. This configuration is surely not the only possibility, and the top chassis 102 and the ink ribbon cartridge holder 7 are not coupled together but may be moved individually. With this being the case, in the resulting printer device 1, moving the top chassis 102 upward leaves a space for the ink ribbon cartridge holder 7 to move upward, and thus the ink ribbon cartridge holder is allowed to move. Moreover, moving down the top chassis 102 accordingly moves down also the ink ribbon cartridge holder 7 in an indirect manner.

Figure 40:
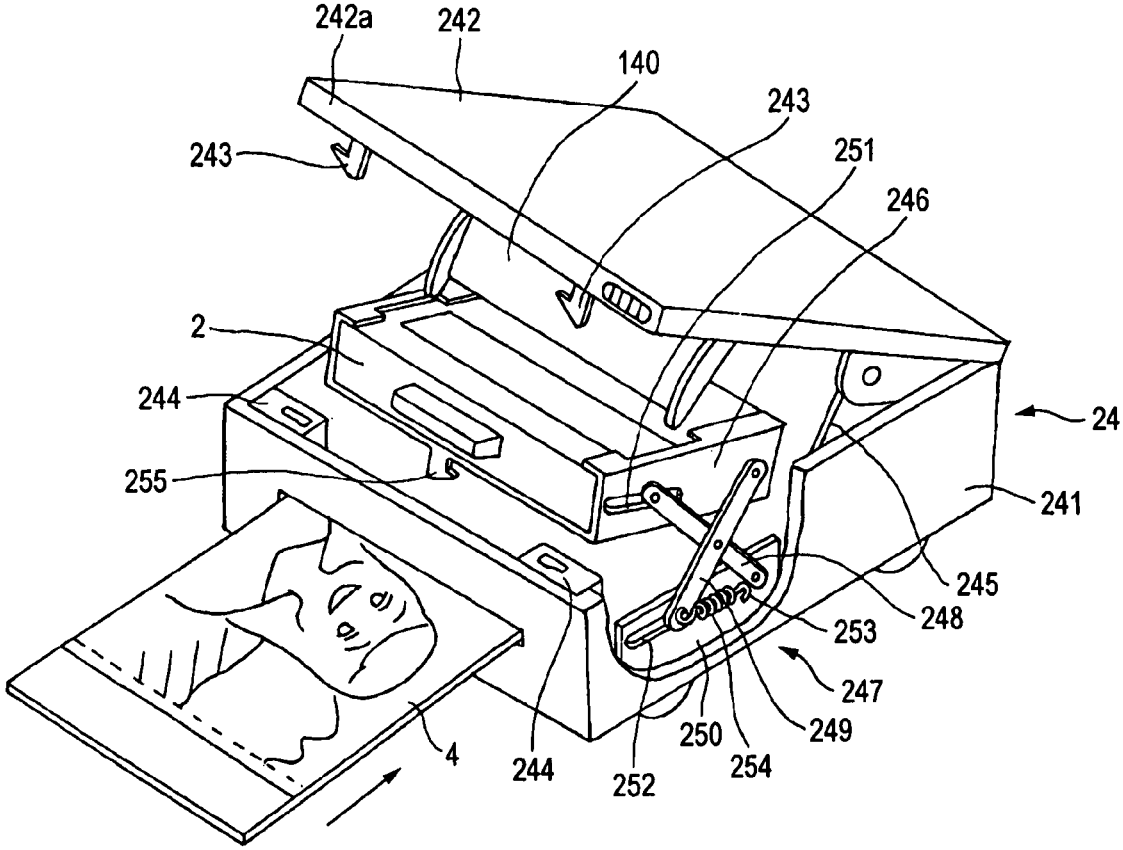
FIG. 40 is a perspective view of a main chassis of a printer device of another embodiment.

By referring to the accompanying drawings, more detailed description will be given. Herein, any components similar to those in the above-described embodiment are provided with the same reference numerals, and not described in detail again. As shown in FIG. 40, a main chassis 240 of this printer device 1 is provided with a base chassis 241 and a top chassis 242. The top chassis 242 is connected to the top plate 6, and is attached to be able to rotate in the vertical direction of the base chassis 241.

The top chassis 242 is not provided with the coupling member 135, and is biased to rotate above the base chassis 101 separately from an ink ribbon cartridge holder 246. Such biasing is applied by the twisted coil spring 116 based on the support protrusion sections 117. The top chassis 242 is provided with a first lock piece 243 on the side of a front surface 242*a*. The first lock piece 243 serves to close the top chassis 242 against the base chassis 241 as opposing the biasing force of the twisted coil spring 116. The top chassis 242 is closed by the first lock piece 243 by being latched to a top chassis lock section 244 formed to the base chassis 241 corresponding to the first lock piece 243. Through sliding operation of the first lock piece 243 or the top chassis lock section 244, the engagement is released between the first lock piece 243 and the top chassis lock section 244, and the top chassis 242 is allowed to rotate upward. The rotation area of the top chassis 242 is controlled by the latching piece 121 being latched to the rotation control piece 120 formed to the base chassis 241 similarly to the top chassis 102. As shown in FIG. 40, the rotation area maybe controlled by being attached with one end of a rotation control arm 245, the other end of which is latched by the base chassis 241.

The ink ribbon cartridge 246 disposed between the base chassis 241 and the top chassis 242 is so configured as to be able to move up and down with respect to the base chassis 241 by the ascent/descent mechanism 247 disposed on the way to the base chassis 241. As shown in FIGS. 40 and 41, the ascent/descent mechanism 247 is of so-called pantograph structure in which a pair of ascent/descent arms are intersected on the right and left side surfaces, respectively. More specifically, the ascent/descent mechanism 247 is provided with, on the right and left side surfaces, first and second ascent/descent arms 248 and 249, respectively.

One end of the first ascent/descent arm 248 is latched, on the rear surface side, to a support plate 250 provided to the base chassis 241 to be able to freely rotate, and the other end thereof is latched to a slit 251 punched in the side surface of the ink ribbon cartridge holder 246. The support plate 250 is a substantially rectangular plate that is stood in the vicinity of the both side surfaces of the base chassis 241, and is disposed along the side wall of the base chassis 241 in the longitudinal direction. The slit 251 is formed to the side surface portion of the ink ribbon cartridge holder 246 along the insertion/removal direction of the ink ribbon cartridge 2. The first ascent/descent arm 248 is formed with, at the other end, a shaft and a roller bearing for accepting the shaft, which are not described in detail, so that the slit 251 is allowed to smoothly move.

One end of the second ascent/descent arm 249 is latched to the rear surface side of the side surface of the ink ribbon cartridge holder 246 to be able to freely rotate, and the other end thereof is latched to a slit 252 of the support plate 250. The second ascent/descent arm 249 is also formed with, at the other end, a shaft and a roller bearing for accepting the shaft, which are not described in detail, so that the slit 252 is allowed to smoothly move. This slit 252 is formed along the longitudinal direction of the support plate 250. The support plate 250 is provided with a protrusion section 253 protruding in the vicinity of the slit 252, and a spring member 254 is disposed across the other end of the second ascent/descent arm and the protrusion section 253. With such a configuration, the other end portion of the second ascent/descent arm 249 is always biased toward the rear surface side of the base chassis 241.

These first and second ascent/descent arms 248 and 249 are intersected each other in substantially the middle portion in the longitudinal direction, and are both latched to be able to rotate. Therefore, when the other end of the second ascent/descent arm 249 receiving the biasing force of the spring member 254 is moved to slide toward the rear surface side of the base chassis 241, the ascent/descent mechanism 247 accordingly moves the ink ribbon cartridge 7 upward. The ascent/descent mechanism 247 also moves the ink ribbon cartridge holder 246 down into the base chassis 241 when the other end of the second ascent/descent arm 249 is moved to slide toward the front surface side of the base chassis 241 as opposing the biasing force of the spring member 254.

The ink ribbon cartridge holder 246 operated to move up and down by the ascent/descent mechanism 247 is provided with a second lock piece 255 at the front surface section. By being latched to a holder lock section 256, the second lock piece 255 retains the ink ribbon cartridge holder 246 in the state of being moved down to the side of the base chassis 241 as opposing the biasing force of the spring member 254. The holder lock section 256 is the one formed to the base chassis 241 corresponding to the second lock piece 255. When the engagement is released between the second lock piece 255 and the holder lock section 256 in response to the sliding operation of the second lock piece 255 or the holder lock section 256, the ink ribbon cartridge holder 246 is allowed to move upward. Note that the area allowed for the ink ribbon cartridge holder 246 to move up is put under the control, in terms of a moving-up position, the base chassis 241. Such control is applied by, similarly to the ink cartridge holder 7 described above, the latching protrusion section 128 being engaged with the long hole 129 to be able to freely move, and by the latching protrusion section 128 being latched to the upper end of the long hole 129. Herein, the long hole 129 is the one formed to the base chassis 241 in the vertical direction.

Figure 41A:
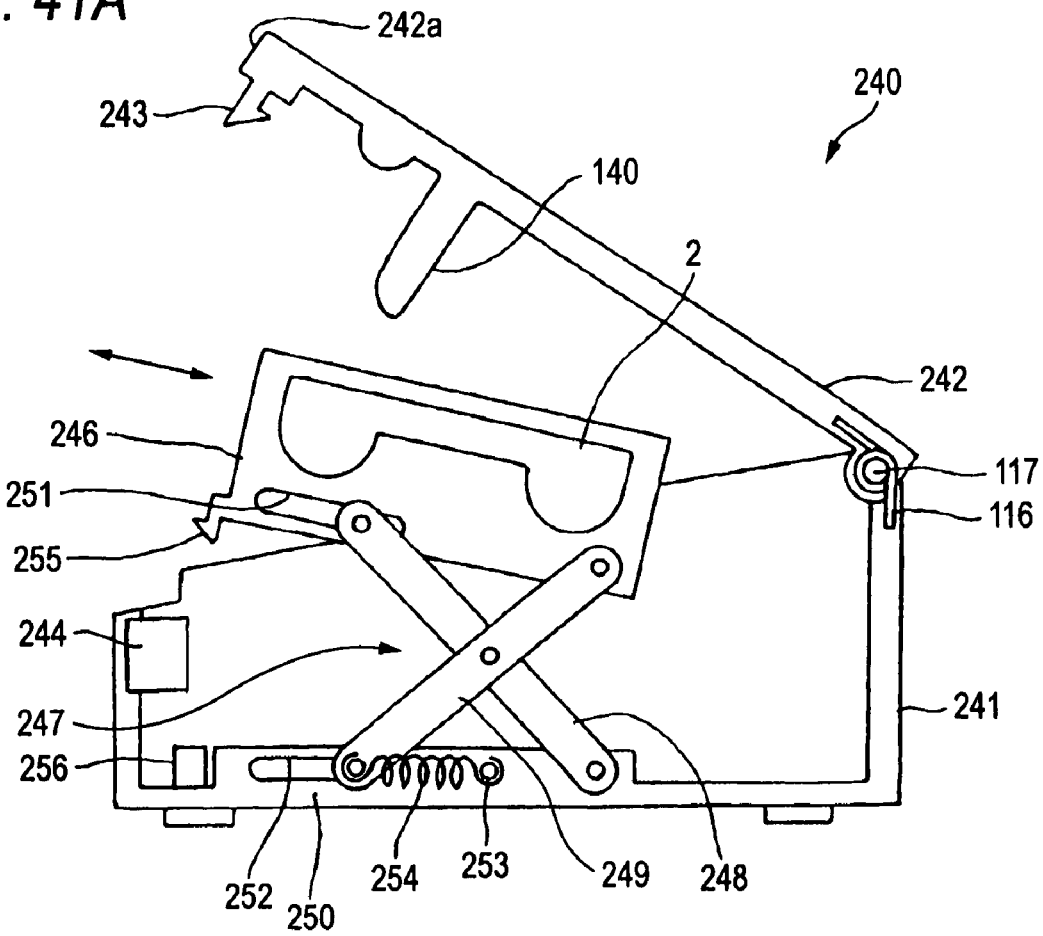
FIGS. 41A and 41B are both a diagram showing the open/close operation of the printer device of the embodiment.

As shown in FIG. 41A, in such a printer device 1, in response when the engagement is released between the first lock piece 243 and the top chassis lock section 244, the top chassis 242 is rotated upward by the biasing force of the twisted coil spring 116. In response when the engagement is released between the second lock piece 255 and the holder lock section 256, the ink ribbon cartridge holder 246 is moved upward by the ascent/descent mechanism 247 receiving the biasing force of the spring member 254. At this time, in the top chassis 242, the latching piece 121 is latched by the rotation control piece 120, and in the ink ribbon cartridge holder 246, the latching protrusion section 128 is latched at the upper end of the long hole 129. Accordingly, as shown in FIG. 41A, the top chassis 242 is rotated at an acute angle with respect to the base chassis 241, and the ink ribbon cartridge holder 246 is made to face outside from the front surface side between the base chassis 241 and the top chassis 242.

In the printer device 1, the lock release of the top chassis 242 is associated with the lock release of the ink ribbon cartridge holder 246 so that the ink ribbon cartridge holder 246 is moved upward at the same time when the top chassis 242 is rotated. For example, the open button 107 provided to the device body 3 may be coupled with the first lock piece 243 for engagement with the top chassis lock section 244, and using a plunger mechanism, the second lock piece 255 may be engaged with the holder lock section 256. Through operation of the open button 107, the first lock piece 243 may be moved to slide so as to release the engagement with the top chassis lock section 244. At the same time, a power supply may be made by the plunger mechanism so as to cancel the retention force of the second lock piece 255, and the engagement may be released between the second lock piece 255 and the holder lock section 256.

Alternatively, in the printer device 1, without associating the lock release of the top chassis 242 with the lock release of the ink ribbon cartridge holder 246, a lock release button may be individually provided for lock release through each individual operation.

Figure 41B:
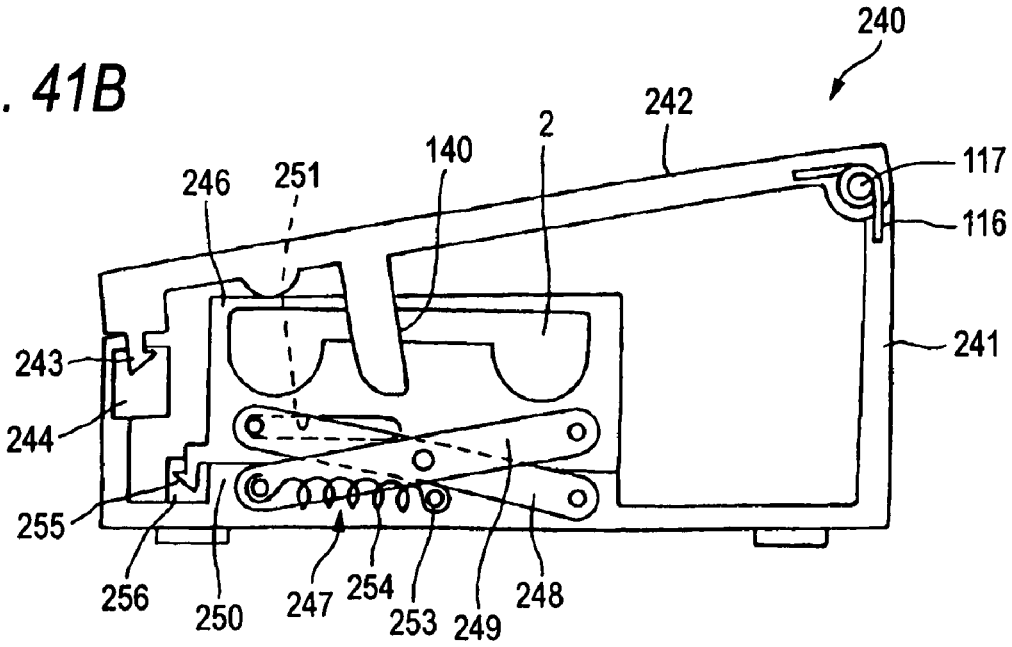

When the ink ribbon cartridge 2 is attached inside of the ink ribbon cartridge holder 246, as shown in FIG. 41B, the top chassis 242 is pushed down toward the side of the base chassis 241. The ink ribbon cartridge holder 246 is also moved down by being pressed against the top chassis 242, and the ink ribbon cartridge 2 is moved to the printing position. By the top chassis 242 being pushed down toward the side of the base chassis 241, the first lock piece 243 is engaged with the top chassis lock section 244, and the top chassis 242 closes the base chassis 241 as opposing the biasing force of the twisted coil spring 116. In the ink ribbon cartridge holder 246 moved down by the top chassis 242, through the engagement between the second lock piece 255 and the holder lock section 256, the other end of the second ascent/descent arm 249 is moved to the side of the front surface of the slit 252 as opposing the biasing force of the spring member 254. In this manner, the ink ribbon cartridge holder 246 moves the ink ribbon cartridge 2 to the printing position.

In the printer device 1, the ink ribbon cartridge 2 is not restrictive to be pushed down by the top chassis 242 to the side of the base chassis 241. Alternatively, after the ink ribbon cartridge 2 is attached, the ink ribbon cartridge holder 246 may be first pushed down by a user to the side of the base chassis 241, and then the top chassis 242 may be so closed as to be pushed down to the side of the base chassis 241.

With such a configuration, i.e., the ascent/descent mechanism 247 of the ink ribbon cartridge holder 246 is provided separately from the top chassis 242, the first lock piece 243 may be provided for locking the top chassis 242, and the second lock piece 255 may be provided for locking the ink ribbon cartridge holder 246. With this being the configuration, these components can be locked without fail. Accordingly, by controlling the plunger mechanism in charge of locking the ink ribbon cartridge holder 246 not to release any lock during the operation of the printer device 1, for example, even if the top chassis 242 is erroneously rotated upward in the printing operation, the ink ribbon cartridge holder 246 is prevented from moving upward together with the top chassis 242. This favorably prevents accidents such as jamming of the ink ribbon 10 when it is running, and paper jamming of the printing paper 4 when it is transferred.

The main chassis 240 is not configured like the main chassis 100, i.e., the top chassis 102 and the ink ribbon cartridge holder 7 are both pivoted about the support protrusion sections 117 protruding from the base chassis 101, but is configured that the ink ribbon cartridge holder 246 is moved up by the ascent/descent mechanism 247 such as pantograph mechanism. There is thus no need to dispose the main chassis 240 with a large slanting angle with respect to the main chassis 241 at the insertion/removal position of the ink ribbon cartridge 2. That is, in the main chassis 100, the top chassis 102 and the ink ribbon cartridge holder 7 are operated to move up and down by coaxially rotated by the support protrusion sections 117. Therefore, if the ink ribbon cartridge holder 7 is rotated against the base chassis 101 to the position where the ink ribbon cartridge 2 can be inserted and removed, the rotation amount of the top chassis 102 is required to be larger than the rotation amount of the ink ribbon cartridge holder 7 so that the rotation amount against the main chassis 101 is increased. On the other hand, when the ink ribbon cartridge holder 246 is moved up by the ascent/descent mechanism 247, even if the ink ribbon cartridge holder 246 is moved up to the height at which the ink ribbon cartridge 2 can be inserted and removed, the components can be disposed without increasing the rotation amount of the top chassis 242. Accordingly, the printer device 1 can be compact in size, requiring no need to keep a space at the upper portion for the top plate 6 and the top chassis 242 to rotate. The resulting printer device 1 can be thus disposed at a position with a structure formed above, i.e., at the middle level or the bottom level of a shelf.

On the other hand, the printer device 1 equipped with such a main chassis 100 takes the configuration of including no ascent/descent mechanism, the top chassis 102 and the ink ribbon cartridge holder 7 being coaxially pivoted about the support protrusion sections 117, and using the coupling member 135 to move the ink ribbon cartridge holder 7 in response to the movement of the top chassis 102. Accordingly, the number of components is not that many, and the move-up operation can be executed with the simple configuration.

As described above, the printer device applied with the invention is provided with the thermal head 140 on the side of the top chassis 102 or 242, and the ribbon guide 165 is provided on the side of the base chassis 101 or 241. This is surely not restrictive, and the ribbon guide 165 may be provided on the side of the top chassis 102 or 242, and the thermal head 140 may be provided on the side of the base chassis 101 or 241. In either configurations, the ink ribbon cartridge 2 is moved to the printing position inside of the device body 3, and the thermal head 140 and the ribbon guide 165 are inserted into the aperture section 40 formed to the cartridge body 13 so that a ribbon path is formed.

Moreover, the printer device applied with the invention is not restrictive to the above-described configuration of being attached with the printing paper tray 5 including therein a plurality of printing papers 4, and automatically transferring the papers by the transfer mechanism into the device body. Alternatively, as shown in FIG. 40, a piece of printing paper 4 may be directed into the device body for every printing operation.

It should be understood by those skilled in the art that various modifications, combinations, sub-combinations and alterations may occur depending on design requirements and other factors insofar as they are within the scope of the appended claims or the equivalents thereof.

What is claimed is:

1. A printer device that prints an image to a printing medium by heating the printing medium with an ink ribbon closely attached thereto, the printer device comprising:

a base chassis that accepts therein and ejects therefrom the printing medium;

a top chassis that is disposed to be able to freely open and close in a direction vertical to the basis chassis;

an ink ribbon cartridge holder that is operably connected to the top chassis, is disposed between the top chassis and the base chassis, and is attached with an ink ribbon cartridge including therein the ink ribbon;

a thermal head that prints an image to the printing medium by heating the ink ribbon in the ink ribbon cartridge attached to the ink ribbon cartridge holder; and a protection plate sized to cover, at least in part, the thermal head, the protection plate being pivotably mounted to the ink ribbon cartridge holder, wherein when the printer device is to be opened, the top chassis moves to an opened position angularly away from the base chassis and the ink ribbon cartridge holder moves at least in part simultaneously with the top chassis to an insertion/removal position where the ink ribbon cartridge is inserted to and removed from a front surface side of the base chassis while being faced outside of an upper surface thereof, and when the printer device is to be closed, the top chassis moves to a closed position to cover the base chassis and the ink ribbon cartridge moves at least in part simultaneously with the top chassis to a printing position inside the printer device where the printing medium is printed and the protection plate pivots relative to the ink ribbon cartridge and is in slidable contact with the thermal head as the top chassis moves between the opened position and the closed position.

2. The printer device according to claim 1, wherein the ink ribbon cartridge holder is coupled with the top chassis, is moved to the insertion/removal position when the top chassis is rotated upward, and is moved to the printing position when the top chassis is rotated downward.

3. The printer device according to claim 1, further comprising an ascent/descent mechanism that operates the ink ribbon cartridge holder to move up and down, wherein the ink ribbon cartridge is moved up and down by the ascent/descent mechanism in a range between the insertion/removal position and the printing position.

4. The printer device according to claim 3, wherein the ascent/descent mechanism is of pantograph structure.

5. The printer device according to claim 1, wherein the top chassis is rotated at an acute angle based on a rear surface side of the base chassis.

6. The printer device according to claim 1, wherein the thermal head is provided to the top chassis.

7. The printer device according to claim 6, wherein the protection plate shields the thermal head from a front surface side of the base chassis when the top chassis is rotated upward.

8. The printer device according to claim 1, wherein the ink ribbon cartridge is provided with, along a running direction of the ink ribbon, a pair of housing sections each including a spool for winding of the ink ribbon, and an aperture section is formed between the housing sections, and from the base chassis, a guide member forming a running path for the ink ribbon is protruding by being inserted in the aperture section formed to the ink ribbon cartridge being at the printing position.

9. The printer device according to claim 1, wherein the ink ribbon cartridge is provided with, along a running direction of the ink ribbon, a pair of housing including a spool for winding of the ink ribbon, and an aperture section is formed between the housing sections, and the thermal head is provided with a cover member for protecting a head section, and for forming a running path for the ink ribbon by being sections each inserted in the aperture section formed to the ink ribbon cartridge being at the printing position with the top chassis rotated downward.

10. The printer device according to claim 1, wherein the ink ribbon cartridge includes an aperture formed thereinto and the thermal head is connected to and depends from the top chassis such that, when the top chassis is in the closed position, the thermal head is disposed in the aperture and, when the top chassis is in the opened position, the thermal head is fully withdrawn from the aperture.

* * * * *